US005113808A

United States Patent [19]

Eickmann

[11] Patent Number: 5,113,808

[45] Date of Patent: May 19, 1992

[54] DOUBLE PISTON ENGINE

[76] Inventor: Karl Eickmann, 2420 Isshiki, Hayama-machi, Kanagawa-ken, Japan

[21] Appl. No.: 275,500

[22] Filed: Nov. 23, 1988

Related U.S. Application Data

[63] Continuation-in-part of Ser. No. 934,523, Nov. 24, 1986, abandoned, which is a continuation-in-part of Ser. No. 701,315, Feb. 13, 1985, abandoned, which is a continuation-in-part of Ser. No. 529,254, Sep. 6, 1983, abandoned.

[30] Foreign Application Priority Data

Sep. 6, 1983 [DE] Fed. Rep. of Germany ..... 3341718
Nov. 23, 1983 [DE] Fed. Rep. of Germany ..... 3342183
Jun. 20, 1986 [DE] Fed. Rep. of Germany ..... 3620691

[51] Int. Cl.[5] ..... F02B 25/12

[52] U.S. Cl. ..... 123/53 BP; 123/56 AC; 123/61 R; 417/269; 417/521

[58] Field of Search ..... 123/51 BD, 53 BP, 56 B, 123/59 B, 61 R, 61 V, 62, 26, 56 AC, 56 BC, 63; 417/256, 257, 267, 269, 521

[56] References Cited

U.S. PATENT DOCUMENTS 1,487,077 3/1924 Pratt ..... 123/61 V
1,679,668 8/1928 Keas ..... 123/61 R
1,866,022 7/1932 Findeisen ..... 123/61 R
2,407,790 9/1946 Tourneau ..... 123/62
2,463,308 3/1949 Prieto ..... 123/51 BC
2,780,208 2/1957 Brown ..... 123/61 R
3,340,855 9/1967 Brown ..... 123/61 R
4,097,198 6/1978 Herron ..... 417/521
4,911,614 3/1990 Kawai et al. ..... 417/269

FOREIGN PATENT DOCUMENTS 140823 6/1930 Switzerland ..... 123/61 R

*Primary Examiner*—David A. Okonsky

[57] ABSTRACT

A double piston engine has a medial shaft between two pistons which reciprocate in opposed cylinders. From the pistons extend outer piston shafts which serve as control shafts. The outer ends of the cylinders are provided with inlet ports and control recesses while the control shafts have also control recesses and the meeting of the control recesses defines the inlet of the fluid into the cylinders. More details serve to combine a plurality of double piston engines to work in unison in timed relation, to increase the power per a given weight or to use the engine as a hydrofluid conveying combustion engine as well as the prevention of dead spaces by specific valves or configurations and locations. A piston may form a first piston portion and a plurality of secondary piston portions with the sum of the cross-sectional areas of the secondary piston portions equal to the cross-sectional area of the first piston portion.

3 Claims, 36 Drawing Sheets

PRIOR ART Fig. 2
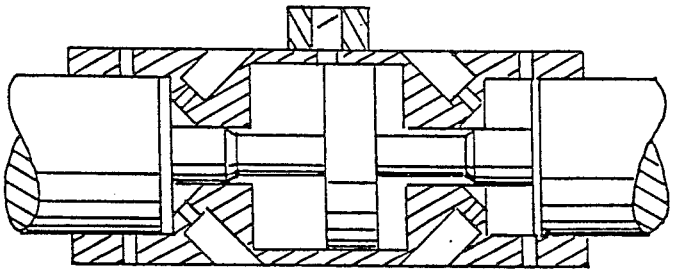
PRIOR ART Fig. 1
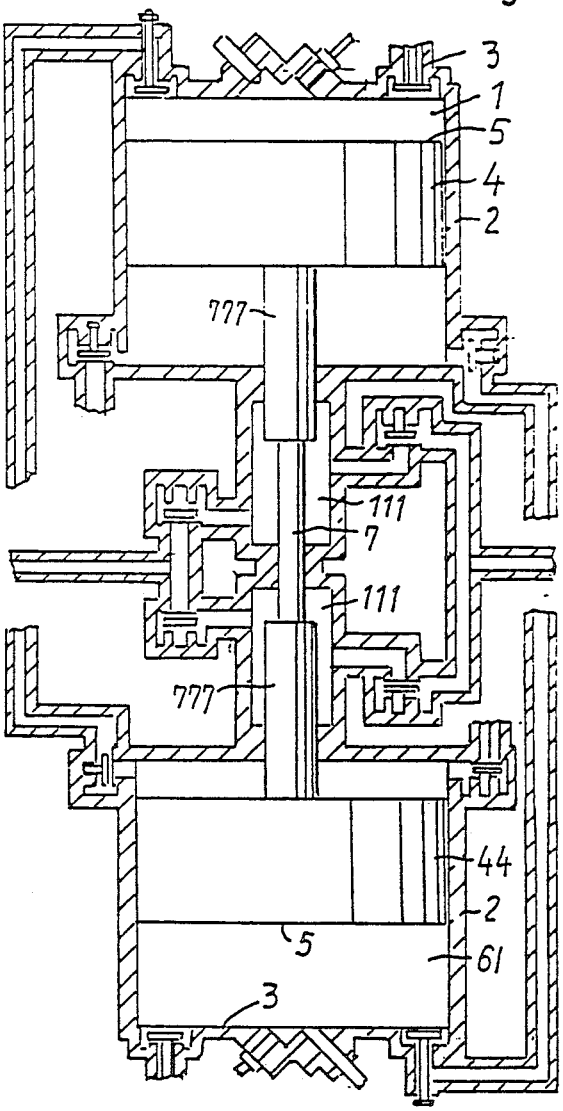
PRIOR ART Fig. 4
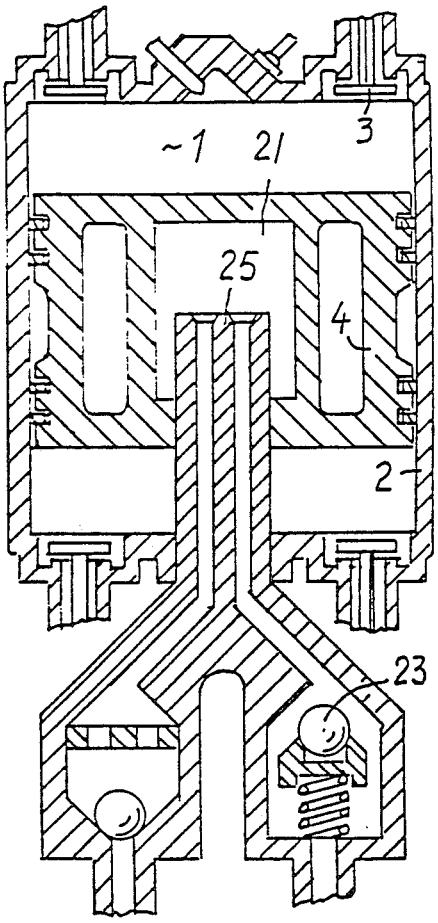

Fig. 9

| | | | | | | | | | | | | |
|---|---|---|---|---|---|---|---|---|---|---|---|---|
| 1 | $x$ = | 4 | $d$ = cm | 7 | $H_1$ = mm | 10 | $P_1$ = Bar = Kg/cm² | FOR OPEN VALUES USE CM. | | | | |
| 2 | $1-x$ = | 5 | $d^2\pi$ = | 8 | $H_1$ = cm | 11 | WEIGHT OF PISTON = G = Kg | In (30) TAKE DIFFERENCE OF INTERVAL FROM (23) | | | | |
| 3 | $1/(1-x)$ = | 6 | $F$ = | 9 | $H_1^x$ = | 12 | » MASS = G/g = ≈ kg s²/m | In (30) $P_2$ = (25) TO BE TAKEN FROM UPPER INTERVAL | | | | |

| 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 |
|---|---|---|---|---|---|---|---|---|---|---|---|---|---|---|---|---|---|---|---|---|---|---|
| | | | $1^{\square}/(H_1-H_2)$ | | (10) × (9) × (24) | INTERVAL FROM | TO: | $H_2^{1-x}$ | | ((15)(26)^x / (3)×(23)) / ((13)-(27)) | (30) × (6) | (31)/(12) | ((26)-(27))/100 | $\sqrt{2(33)/(32)}$ | (34) × (32)/2 | | ((2×(36))^3 / ±0,5 (11) × (38)) | | 1/(38) | FROM COMPRESSION REVISION (30)(39) | ENTIRE ENGINE (123)(40) | (37)(39)/75 |
| E | $H_2$ | $H_2$ | | $H_1^{-x}$ | P2 | Ja | Jb | Ja | Jb | $\bar{P}_J$ | $K_J$ | $b_J$ | $\Delta H_J$ | $t_J$ | $V_{mJ}$ | $\Sigma V_J$ | $E_{kJ}$ | $\Sigma t_J$ | EH | DH | DH | N |
| | mm | cm | cm | | Kg/cm² | cm | cm | | | Kg/cm² | Kg | m/s² | m | sec | m/s | m/s | Kgm | sec | sec | min | min | HP |

Fig. 10

| | | | | | | | | | | | | |
|---|---|---|---|---|---|---|---|---|---|---|---|---|
| 1 | $x$ = 1.35 | 4 | $d$ = 11.2838 cm | 7 | $H_1$ = 100 mm | 10 | $P_1$ = 1 Bar = Kg/cm² | FOR OPEN VALUES USE CM. | | | | |
| 2 | $1-x$ = − 0.35 | 5 | $d^2\pi$ = 400 | 8 | $H_1$ = 10 cm | 11 | WEIGHT OF PISTON = 5 Kg | In (30) TAKE DIFFERENCE OF INTERVAL FROM (23) | | | | |
| 3 | $1/(1-x)$ = −2,875 | 6 | $F$ = 100 cm² | 9 | $H_1^x$ 22,387 | 12 | » MASS = G/g = ≈ 0,5 | In (30) $P_2$ = (25) TO BETAKEN FROM UPPER INTERVAL | | | | |

| 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 |
|---|---|---|---|---|---|---|---|---|---|---|---|---|---|---|---|---|---|---|---|---|---|---|
| | | | $1^{\square}/(H_1-H_2)$ | | (10) × (9) × (24) | INTERVAL FROM | TO: | $H_2^{1-x}$ | | ((15)(26)^x / (3)×(23)) / ((13)-(27)) | (30) × (6) | (31)/(12) | ((26)-(27))/100 | $\sqrt{2(33)/(32)}$ | (34) × (32)/2 | | ((2×(36))^3 / ±0,5 (11) × (38)) | | 1/(38) | FROM COMPRESSION REVISION (30)(39) | ENTIRE ENGINE (123)(40) | (37)(39)/75 |
| E | $H_2$ | $H_2$ | | $H_1^{-x}$ | P2 | Ja | Jb | Ja | Jb | $\bar{P}_J$ | $K_J$ | $b_J$ | $\Delta H_J$ | $t_J$ | $V_{mJ}$ | $\Sigma V_J$ | $E_{kJ}$ | $\Sigma t_J$ | EH | DH | DH | HP |
| | mm | cm | cm | | Kg/cm² | cm | cm | | | Kg/cm² | Kg | m/s² | m | sec | m/s | m/s | Kgm | sec | sec | min | min | |
| 1 | 100 | 10 | | .04467 | 1 | | | | | | | - | | | | | | | | | | |
| 1.25 | 80 | 8 | 0.5 | .0804 | 1.35 | 10 | 8 | 0.4467 | 0.4830 | 1.16 | 116 | 232 | 0.02 | 0.0131 | 1.52 | 1.52 | 0.03 | 0.0131 | 76.3 | 2290 | 3961 | 0.03 |
| 1.67 | 60 | 6 | 0.5 | .0880 | 1.99 | 8 | 6 | 0.4830 | 0.5341 | 1.63 | 163 | 326 | " | 0.0111 | 1.80 | 3.52 | 0.30 | 0.0242 | 41.3 | 1240 | 2145 | 0.17 |
| 2 | 50 | 5 | 1 | .1139 | 2.55 | 6 | 5 | 0.5341 | 0.5693 | 2.25 | 225 | 450 | 0.01 | 0.0067 | 1.51 | 4.83 | 0.72 | 0.0308 | 32.5 | 974 | 1685 | 0.31 |
| 2.5 | 40 | 4 | 2 | .1539 | 3.44 | 5 | 4 | 0.5693 | 0.6156 | 2.96 | 296 | 592 | 0.005 | 0.00581 | 1.72 | 6.55 | 1.57 | 0.03471 | 28.82 | 820 | 1419 | 0.57 |
| 2.86 | 35 | 3.5 | 2 | .1843 | 4.12 | 4 | 3.5 | 0.6156 | 0.6450 | 3.76 | 376 | 752 | " | 0.00365 | 1.37 | 7.92 | 2.53 | 0.0403 | 29.81 | 744 | 1287 | 0.84 |
| 3.33 | 30 | 3 | 2 | .2269 | 5.08 | 3.5 | 3 | 0.6450 | 0.6808 | 4.57 | 457 | 914 | " | 0.00331 | 1.42 | 9.34 | 3.80 | 0.0436 | 22.94 | 688 | 1190 | 1.16 |
| 4 | 25 | 2.5 | 2 | .2903 | 6.50 | 3 | 2.5 | 0.6808 | 0.7256 | 5.73 | 573 | 1146 | " | 0.00295 | 1.69 | 11.03 | 5.66 | 0.0465 | 21.50 | 645 | 1116 | 1.62 |
| 5 | 20 | 2 | 2 | .3923 | 8.78 | 2.5 | 2 | 0.7256 | 0.7846 | 7.55 | 755 | 1510 | " | 0.00257 | 1.94 | 12.97 | 8.26 | 0.04919 | 20.37 | 611 | 1057 | 2.24 |
| 6.67 | 15 | 1.5 | 2 | .7585 | 12.95 | 2 | 1.5 | 0.7846 | 0.8678 | 10.64 | 1064 | 2128 | " | 0.00217 | 2.31 | 15.28 | 11.98 | 0.0513 | 19.49 | 585 | 1012 | 3.11 |
| 10 | 10 | 1 | 2 | 1 | 22.38 | 1.5 | 1 | 0.8678 | 1 | 16.91 | 1691 | 3382 | " | 0.00172 | 2.91 | 18.19 | 17.54 | 0.0530 | 18.87 | 566 | 979 | 4.41 |
| 12.5 | 8 | 0.8 | 5 | 1.3515 | 30.25 | 1 | 0.8 | 1 | 1.0812 | 25.95 | 2595 | 5190 | 0.002 | .000879 | 2.28 | 20.47 | 22.58 | 0.0539 | 18.55 | 557 | 964 | 5.58 |
| 16.67 | 6 | 0.6 | 5 | 1.9929 | 44.60 | 0.8 | 0.6 | 1.0812 | 1.1958 | 36.45 | 3645 | 7290 | " | .000741 | 2.70 | 23.17 | 29.31 | 0.0546 | 18.32 | 549 | 950 | 7.16 |
| 20 | 5 | 0.5 | 10 | 2.5491 | 57.05 | 0.6 | 0.5 | 1.1958 | 1.2746 | 50.38 | 5038 | 10076 | 0.001 | .000446 | 2.27 | 25.44 | 35.59 | 0.0550 | 18.18 | 545 | 943 | 8.63 |
| 25 | 4 | 0.4 | 10 | 3.4452 | 77.10 | 0.5 | 0.4 | 1.2746 | 1.3781 | 66.18 | 6618 | 13236 | " | .000389 | 2.58 | 28.02 | 43.50 | 0.0554 | 18.05 | 542 | 938 | 10.47 |
| 40 | 2.5 | 0.25 | 6.67 | 6.998 | 145.4 | 0.4 | 0.25 | 1.3781 | 1.6245 | 104.92 | 10492 | 20984 | 0.0015 | .000378 | 3.25 | 31.27 | 54.56 | 0.0558 | 17.92 | 537 | 929 | 13.04 |
| 100 | 1 | 0.10 | 6.67 | 22.38 | 501.2 | 0.25 | 0.10 | 1.6245 | 2.2387 | 261.9 | 26190 | 52380 | " | .000239 | 6.29 | 37.56 | 70.00 | 0.0561 | 17.86 | 536 | 927 | 18.91 |

PRIOR ART
Fig. 12-B
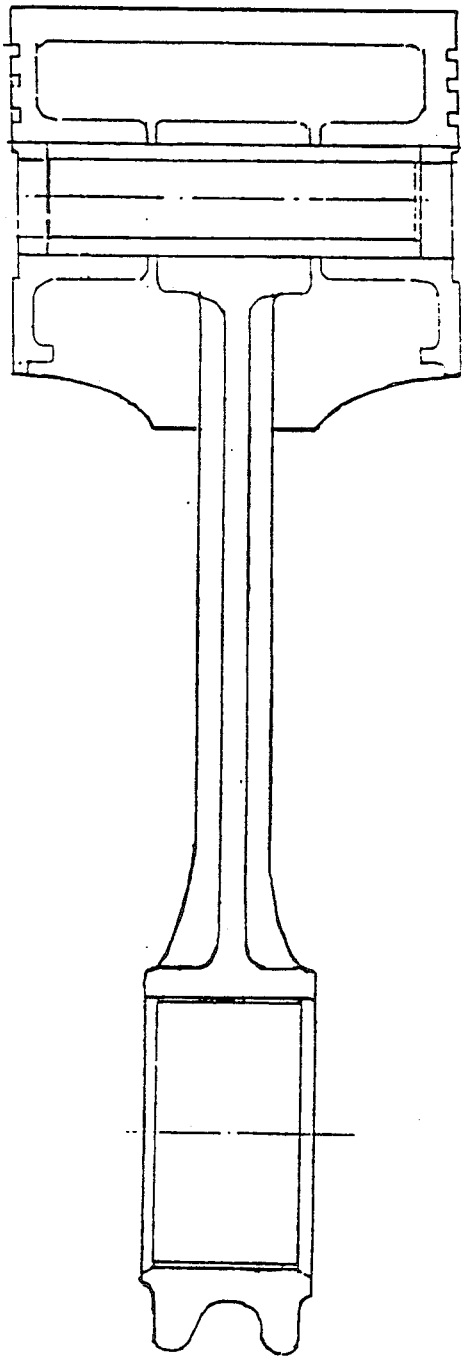
Fig. 12-A
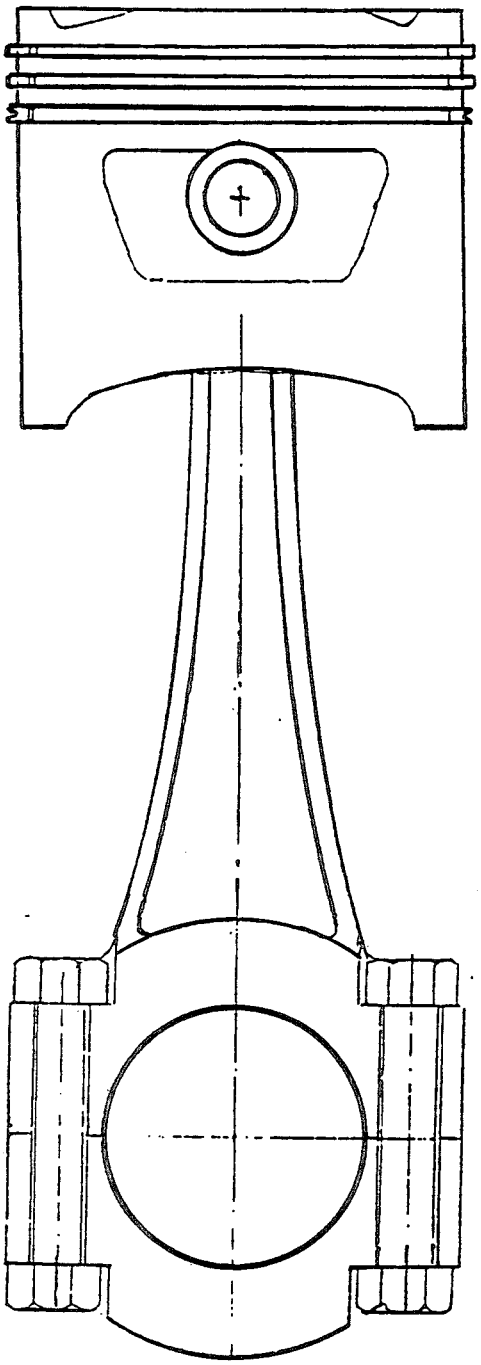

Fig. 13-A
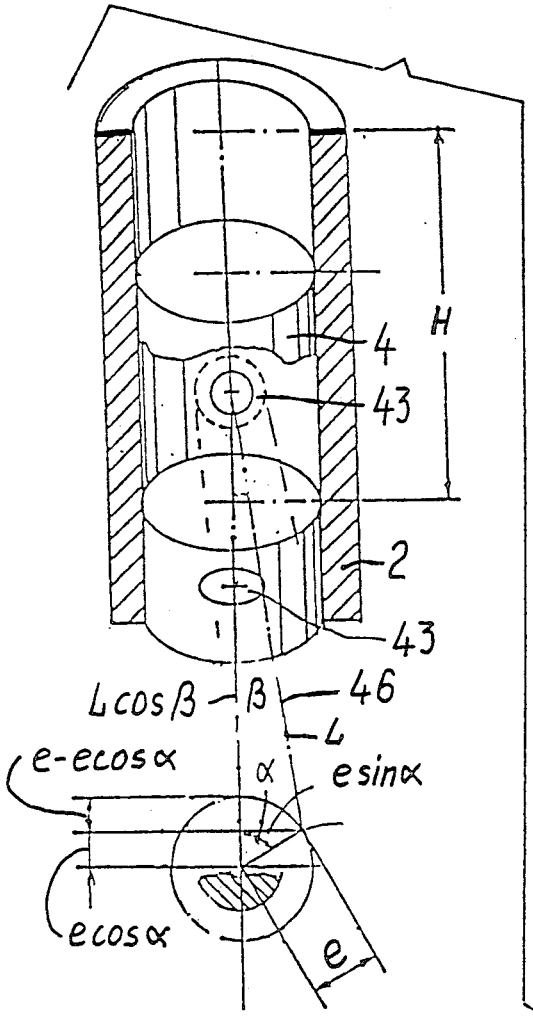
Fig. 13-B
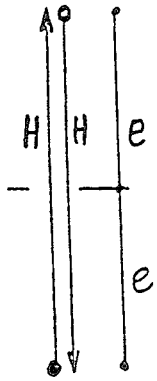
Fig. 13-C
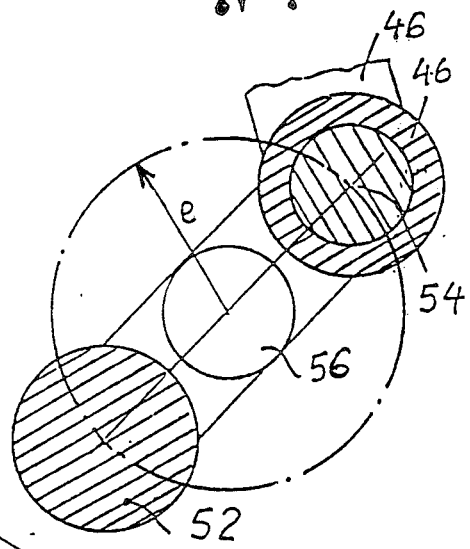
$\Delta H \approx e - e\cos\alpha$
$= \Delta H_O - \Delta H_H$ = STROKE OF PISTON
$V_e = -\omega \sin\alpha$ = VELOCITY OF PISTON
$b_e = \omega^2 e \cos\alpha$ = ACCELERATION OF PISTON
ALSO: STROKE OF PISTON $= 4e = 2H_{max}$
WAY OF CRANK'S MASS 52 $= 2e\pi$ WITH $\pi = 3.14$
WAY OF MASS OF CRANK = 1.57 × STROKE OF PISTON 333
777

Fig. 21

| | | | | | | | | | | | | | |
|---|---|---|---|---|---|---|---|---|---|---|---|---|---|
| 1 | $\varkappa$ = 1,35 | 4 | $d$ = 11.2838 cm | 7 | $H_1$ = 100 mm | 10 | $P_1$ = 1 Bar = Kg/cm² | OPEN VALUES = CM. | | | | | |
| 2 | $1-\varkappa$ = −0,35 | 5 | $d^{1/\gamma}$ = 400 | 8 | $H_1$ = 10 cm | 11 | WEIGHT OF PISTON = 5 Kg | 20 (32) TAKE THE DIFFERENCE OF INTERVAL FROM (23) | | | | | |
| 3 | $1/(1-\varkappa)$ = −2.875 | 6 | $F$ = 100 cm² | 9 | $H_1^{\varkappa}$ = 22.387 | 12 | MASS = $dh/9.81$ = 0,5 kg/m² | 20 (36) $P_1$ = (18) TO BE TAKEN FROM UPPER INTERVAL | | | | | |

| 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 |
|---|---|---|---|---|---|---|---|---|---|---|---|---|---|---|---|---|---|---|---|---|---|---|
| | | | $\frac{1^{\circ}}{H_1 - H_2}$ | | (10) × (9) × (24) | INTERVAL FROM | TO: | $H_2^{1-\varkappa}$ | | (11)(26)$^{\varkappa}$ / (3)×(23) / (28)−(29) | (30) × (6) | (31) / (12) | (33)−(32) / 100 | (2(33)) / (32) | (34) / 2 | Σ↑ (35)(36) | (35) / (37) ± (34) | | 1 / (33) | FROM COMPRESSION 30 (32) | ENTIRE ENGINE 133 (36) | (37)(33) / 75 |
| ε | $H_2$ | $H_2$ | | $H_2^{-\varkappa}$ | $P_2$ | $J_a$ | $J_b$ | $J_a$ | $J_b$ | $\bar{P}_J$ | $K_J$ | $b_J$ | $\Delta H_J$ | $t_J$ | $V_{mJ}$ | $\Sigma V_J$ | $E_{kJ}$ | $\Sigma t_J$ | EH | DH | DH | N |
| | mm | cm | cm | | Kg/cm² | cm | cm | | | Kg/cm² | Kg | m/s² | m | sec | m/s | m/s | Kgm | sec | sec | min | min | HP |
| 100 | 1 | 0,10 | 6.67 | 22.38 | 501 | | | | | | | | | | | | | | | | | |
| 40 | 2.5 | 0,25 | 6.67 | 6.496 | 145 | .10 | .25 | 2.2387 | 1.6245 | 261.9 | 26190 | 52380 | 0.0015 | .010239 | 6.29 | 0.0015 | .0094 | .010239 | 4184 | 175523 | 117152 | 0.52 |
| 25 | 4 | 0,4 | 10 | 3,445 | 77.1 | .25 | .4 | 1.6245 | 1.3781 | 104.9 | 10490 | 20984 | " | .010378 | 3.25 | .0053 | .056 | .040417 | 1620 | 43622 | 84116 | 1.21 |
| 20 | 5 | 0,5 | 10 | 2,549 | 57.05 | .4 | .5 | 1.3781 | 1.2746 | 66.18 | 6618 | 13236 | 0.001 | .010389 | 2.58 | .0122 | .148 | .101006 | 994 | 19821 | 61590 | 1.96 |
| 16.67 | 6 | 0,6 | 5 | 1.9929 | 44.60 | .5 | .6 | 1.2746 | 1.1958 | 50.38 | 5038 | 10076 | " | .010446 | 2.27 | .0209 | .301 | .101552 | 689 | 20661 | 35743 | 2.76 |
| 12.5 | 8 | 0,8 | 5 | 1.3515 | 30.25 | .6 | .8 | 1.1958 | 1.0812 | 36.45 | 3645 | 7290 | 0.002 | .011741 | 2.70 | .0375 | .641 | .102333 | 456 | 13680 | 23666 | 3.90 |
| 10 | 10 | 1 | 2 | 1 | 22.38 | .8 | 1 | 1.0872 | 1 | 25.95 | 2595 | 5150 | " | .010879 | 2.28 | .0595 | 1.152 | .103072 | 326 | 9765 | 16894 | 5.01 |
| 6.67 | 15 | 1.5 | 2 | .7585 | 12.95 | 1 | 1.5 | 1 | 0.8678 | 16.91 | 1691 | 3382 | 0.005 | .00172 | 2.91 | .1068 | 2.380 | .104732 | 209 | 6260 | 10830 | 6.63 |
| 5 | 20 | 2.0 | 2 | .3923 | 8.78 | 1.5 | 2 | 0.8678 | 0.7846 | 10.64 | 1064 | 2128 | " | .00217 | 2.31 | .1712 | 4.110 | .106367 | 144 | 4309 | 7455 | 8.08 |
| 4 | 25 | 2.5 | 2 | .2403 | 6.50 | 2 | 2.5 | 0.7846 | 0.7256 | 7.55 | 755 | 1510 | " | .00257 | 1.94 | .2529 | 6.71 | .103532 | 105. | 3147 | 5445 | 9.39 |
| 3.33 | 30 | 3 | 2 | .2269 | 5.08 | 2.5 | 3 | 0.7256 | 0.6808 | 5.73 | 573 | 1146 | " | .00295 | 1.69 | .3522 | 9.94 | .112482 | 80.12 | 2403 | 4157 | 10.62 |
| 2.86 | 35 | 3.5 | 2 | .1843 | 4.12 | 3 | 3.5 | 0.6808 | 0.6450 | 4.57 | 457 | 914 | " | .00331 | 1.42 | .4681 | 13.86 | .115732 | 63.32 | 1900 | 3286 | 11.70 |
| 2.5 | 40 | 4 | 2 | .1539 | 3.44 | 3.5 | 4 | 0.6450 | 0.6156 | 3.76 | 376 | 752 | " | .00365 | 1.37 | .6029 | 18.70 | .119432 | 51.44 | 1543 | 2669 | 12.82 |
| 2 | 50 | 5 | 1 | .1139 | 2.55 | 4 | 5 | 0.6156 | 0.5693 | 2.96 | 296 | 592 | " | .00581 | 1.72 | .8265 | 27.05 | .015252 | 39.60 | 1188 | 2055 | 14.28 |
| 1.67 | 60 | 6 | 0.5 | .0880 | 1.99 | 5 | 6 | 0.5693 | 0.5341 | 2.25 | 225 | 450 | 0.01 | .0067 | 1.51 | 1.084 | 37.46 | .03352 | 31.30 | 938 | 1624 | 15.63 |
| 1.25 | 80 | 8 | 0.5 | .0604 | 1.35 | 6 | 8 | 0.5341 | 0.4830 | 1.63 | 163 | 326 | " | 0.0111 | 1.80 | 1.552 | 55.95 | .043072 | 23.23 | 697 | 1205 | 17.33 |
| 1 | 100 | 10 | | 0.04467 | 1 | 8 | 10 | 0.4836 | 0.4467 | 1.16 | 116 | 232 | 0.02 | 0.0131 | 1.52 | 2.109 | 79.21 | .056152 | 17.81 | 534 | 924 | 18.81 |

Fig. 40

| | 23 | 28 | 29 | 30 |
|---|---|---|---|---|
| | $\frac{1^{\circ}}{H_1 - H_2}$ | $H_2^{1-\varkappa}$ | | (25)(26)$^{\varkappa}$ / (3)(23) / [(28)−(29)] |
| $H_2$ | | $J_a$ | $J_b$ | $\bar{P}$ |
| cm | | | | Kg/cm² |
| 10 | | .4467 | | |
| 8 | .5 | " | .4829 | 1.157 |
| 6 | .25 | " | .5341 | 1.397 |
| 5 | .2 | " | .5693 | 1.568 |
| 4 | .167 | " | .6156 | 1.804 |
| 3,5 | .154 | " | .6450 | 1.953 |
| 3 | .143 | " | .6808 | 2.139 |
| 2,5 | .133 | " | .7256 | 2.377 |
| 2 | .125 | " | .7846 | 2.701 |
| 1,5 | .118 | " | .8677 | 3.166 |
| 1 | .111 | " | 1 | 3.931 |
| .8 | .109 | " | 1.081 | 4.405 |
| .6 | .106 | " | 1.196 | 5.097 |
| .5 | .105 | " | 1.175 | 5.574 |
| .4 | .104 | " | 1.378 | 6.206 |
| .25 | .103 | " | 1.624 | 7.727 |
| .1 | .101 | " | 2.239 | 11.57 |

| | | | | | | | 44 | 45 | 46 | 47 | 48 |
|---|---|---|---|---|---|---|---|---|---|---|---|
| | | | | | | | $\Sigma \bar{P}_J \cdot \bar{t}_J$ ↑ | $\sqrt{\frac{2\Delta Hm}{(P_b)F}}$ | $\frac{1}{t l_{H_1}^{H_2}}$ | 30 (46) | ENTIRE ENGINE |
| ε | $H_2$ | $\bar{H}$ | $\bar{P}_J$ | $\bar{t}_J$ | $\bar{P}_J \cdot \bar{t}_J$ | $\lvert P_b \rvert$ | | $t l_{H_1}^{H_2}$ | EH/s | DH/min | 1,1(47) / DH/min |
| | cm | cm | Kg/cm² | s⁻³ | | Kg/cm² | | s⁻³ | | | |
| | | | (ΔH in (45) = $H_1 - H_2$ | | | in m) | | (ΔH)² | | | |
| 100 | .10 | | | | | | | | | | |
| 40 | .25 | 9 | 261,9 | 0.239 | 0.06259 | .38316 | | 0,051 | 19.67 | 590 | 1021 |
| 25 | .4 | 7 | 104.9 | 0.378 | .03965 | .32057 | | 0,055 | 18,14 | 544 | 941 |
| 20 | .5 | 5.5 | 66.18 | 0,389 | .02574 | .28092 | | 0,058 | 17.20 | 516 | 892 |
| 16.67 | .6 | 4.5 | 50.38 | 0,446 | .02247 | .25518 | | 0,061 | 16,48 | 494 | 855 |
| 12.5 | .8 | 3.75 | 36.45 | 0,741 | .02701 | .23271 | | 0,063 | 15.90 | 477 | 825 |
| 10 | 1.0 | 3.25 | 25,95 | 0,879 | .02281 | .20570 | | 0,066 | 15,12 | 453 | 785 |
| 6.67 | 1.5 | 2.75 | 16.91 | 1,72 | .02909 | .18289 | | 0,068 | 14,67 | 440 | 761 |
| 5 | 2.0 | 2.25 | 10.64 | 2.17 | .02309 | .15380 | | 0.072 | 13.86 | 416 | 719 |
| 4 | 2.5 | 1.75 | 7.55 | 2.57 | .01940 | .13071 | | 0,076 | 13,20 | 396 | 685 |
| 3.33 | 3.0 | 1.25 | 5.73 | 2,95 | .01690 | .11131 | | 0,079 | 12,61 | 378. | 656 |
| 2.86 | 3.5 | 0,9 | 4.57 | 3.31 | .01513 | .09441 | | 0,083 | 12,05 | .361 | 625 |
| 2.5 | 4 | 0.7 | 3.76 | 3,65 | .01372 | .07928 | | 0,087 | 11.49 | 345 | 596 |
| 2 | 5 | 0.55 | 2,96 | 5.81 | .01720 | .06556 | | 0,087 | 11.45 | 343 | 594 |
| 1.67 | 6 | 0.45 | 2.25 | 6.7 | .01507 | .04836 | | 0,091 | 10,99 | 329 | 570 |
| 1.25 | 8 | 0.315 | 1.63 | 11.1 | .01809 | .03329 | | | | | |
| 1 | 10 | 0.175 | 1.16 | 13,1 | .01520 | .01520 | | | | | |

FOR LEFT TABLE ——— ↑ RIGHT TABLE REVERSED. TAKEN FROM BOTTOM TO TOP

PRIOR ART
Fig.22
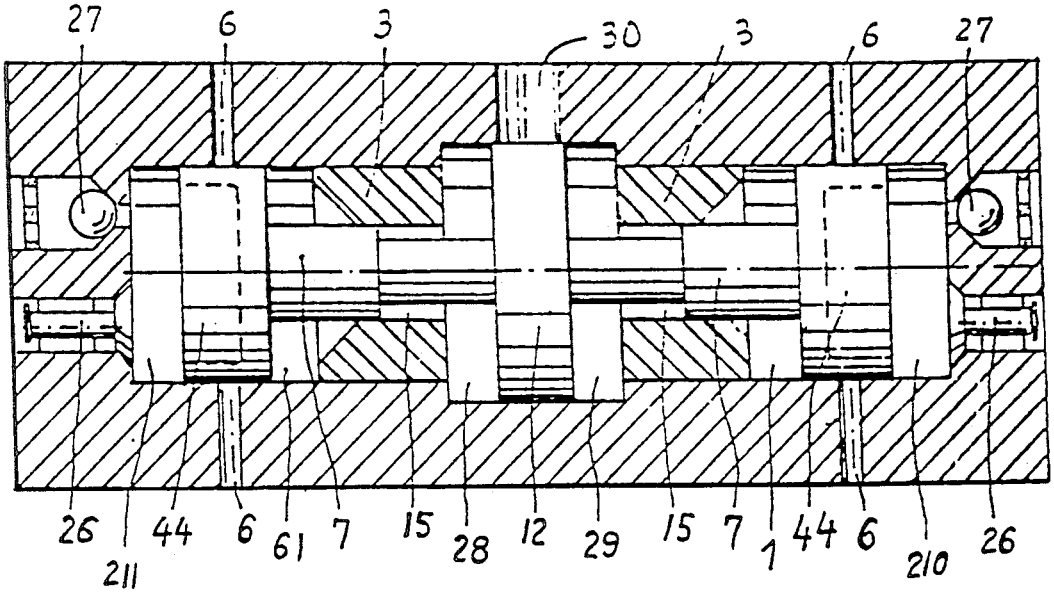
Fig.23
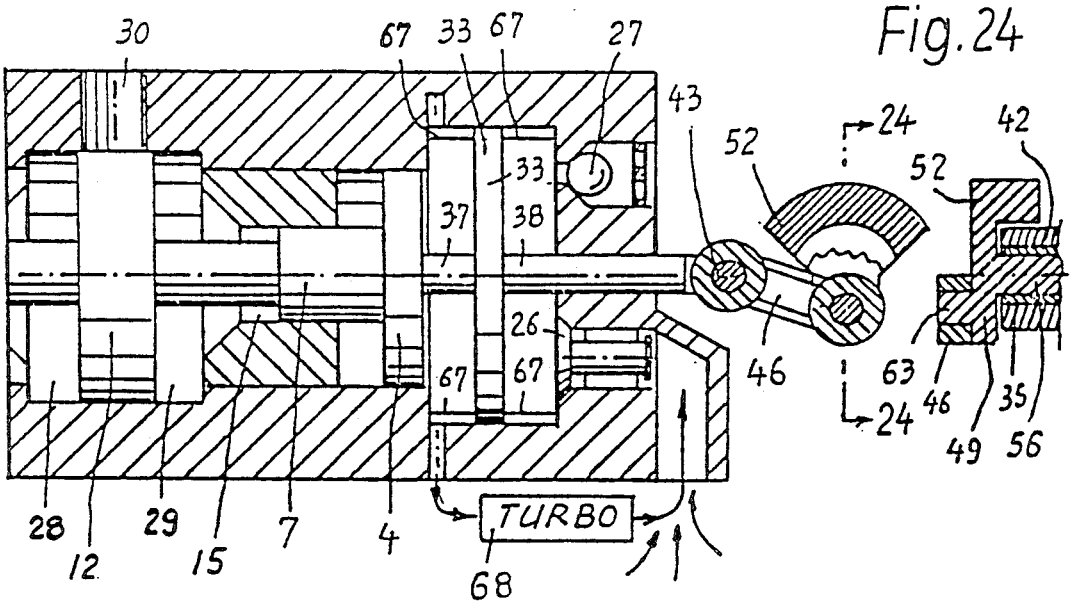
Fig.24

| | | 38 | 50 | 51 |
|---|---|---|---|---|
| | | | $\frac{2\Delta H_1^2 m}{F}$ | $\frac{50}{(\Sigma t)^2}$ |
| ε | $H_2$ | Σt | | P |
| | mm | | | Kg/cm² |
| 1 | 100 | | | |
| 1.25 | 80 | 0,0131 | 0,0002 | 1.165 |
| 1.67 | 60 | .0242 | .0004 | 0.683 |
| 2 | 50 | .0308 | .0005 | .527 |
| 2.5 | 40 | .03617 | .0006 | .459 |
| 2.86 | 35 | .0403 | .00065 | .400 |
| 3.33 | 30 | .0436 | .00070 | .368 |
| 4 | 25 | .0465 | .00075 | .347 |
| 5 | 20 | .0492 | .00080 | .3305 |
| 6.67 | 15 | .0513 | .00085 | .3230 |
| 10 | 10 | .0530 | .00090 | .3204 |
| 12.5 | 8 | .0539 | .00092 | .3167 |
| 16.67 | 6 | .0546 | .00094 | .3153 |
| 20 | 5 | .0550 | .00095 | .3140 |
| 25 | 4 | .0554 | .00096 | .3128 |
| 40 | 2.5 | .0558 | .000975 | .3131 |
| 100 | 1 | .0561 | .000990 | .3145 |

0,020
0,015
0,010
0,005
10
5
1
1000
500
200
100
0
$\bar{P}_c$
Kg/cm²
$\bar{P}|_{H1}^{H}$
$\boxed{X} = \boxed{P_b} \times \frac{EH}{S}$
$\bar{P}|$
t
DH/min
ENGINE IDLING
$t_J$
$\boxed{\bar{b}}$
S
DH/min.
m/s²
$\sum(\bar{P}_J \times \bar{t}_J) = \boxed{P_b}$
10
9
6
5
2
1
0
$\bar{P}$
Kg/cm²
$\boxed{P_b}$
Kg s/cm²
0.5
0.4
0.3
0.2
0.1
0
cm
H
H1

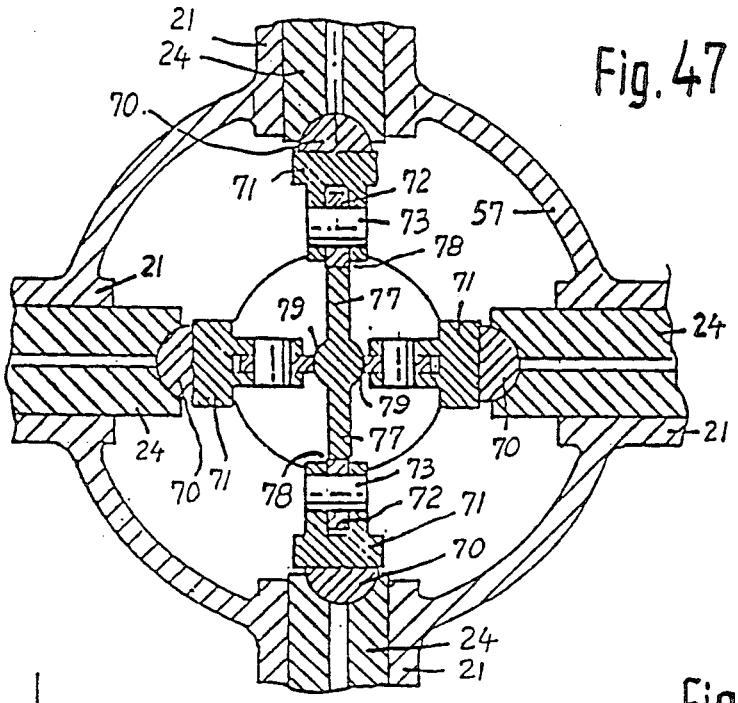
Fig. 47
Fig. 48
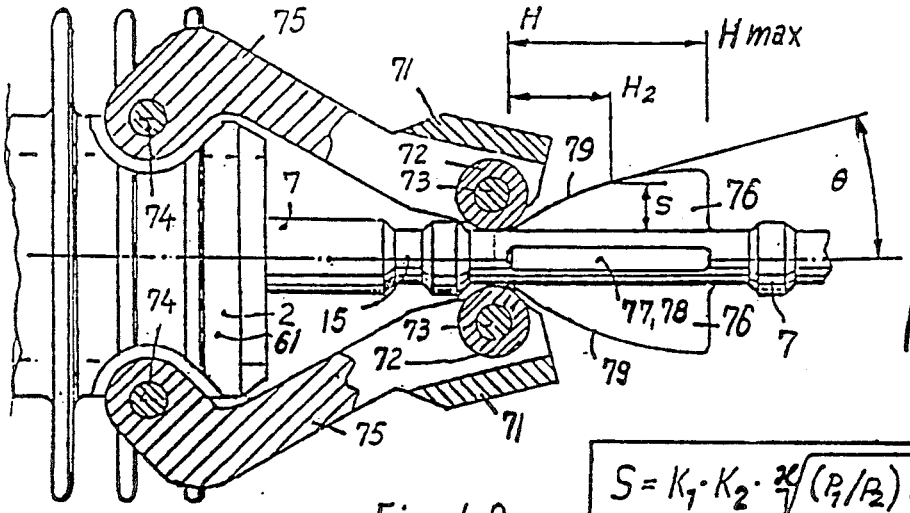
Fig. 50
$$S = K_1 \cdot K_2 \cdot \sqrt[\varkappa]{(P_1/P_2)\, H_0^{\varkappa}}$$
$$\theta = K_1 \cdot K_2 \cdot p_1 \cdot H_1^{\varkappa} \cdot \left(-\varkappa H_2^{(-\varkappa-1)}\right)$$
Fig. 49
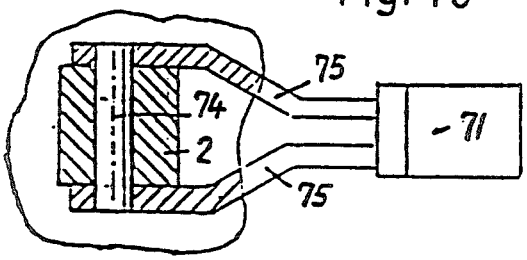

444
9
333
777
3
315
15
7
1
2
4
6
16
362
19
66
411
404
464
459
64
315
63
333
67
15
777
442
440
441
TURBO
262
262
443
443
445
9
333

508
523
506
514
511
514
502
501
501
513
519
515
513
520
517
513
512
521
513
520
518
513
501
519
503
516
503
513
502
501
504
509
505
506
507
522
508
507
510
514
504

DOUBLE PISTON ENGINE

REFERENCE TO RELATED APPLICATIONS

This is a continuation-in-part application of my co pending patent application Ser. No. 06-934,523, filed on Nov. 24, 1986, now abandoned which is a continuation-in-part of my earlier application Ser. No. 06-701,315, filed on Feb. 13, 1985, now abandoned, which is a continuation in part application of my still earlier application Ser. No. 06-529,254 which was filed on Sep. 6, 1983, abandoned. Benefit of said application Ser. No. 529,254 and of its pre decessors is claimed for all Figures and disclosures which are present in said application or its fore runners for the present application. Application Ser. No. 06-529,254 is now abandoned.

BACKGROUND OF THE INVENTION

1. Field of the Invention

This invention relates to piston engines and partially to double piston engines. Such double piston engines often operate as free piston engines. They may, however, also be provided with rotary means to control the timed relation of operation of the pistons in the cylinders.

2. Description of the Prior Art

A double piston engine is described in my U.S. patent application Ser. No. 06-529,254. In said application means are provided between the pistons to transfer the power of the combustion engine cylinders into reciprocating pistons of hydraulic pumps. Thereby the engine works as a hydrofluid combustion engine. Similar engines of hydrofluid conveying combustion engines are known from my U.S. Pat. Nos. 3,174,432; 3,260,213 and 3,269,321. A free piston engine is known from U.S. Pat. No. 4,385,597 to Frank Stelzer. The mentioned patents serve specific purposes and obtain them partially or totally. However, all of them are either still too heavy to permit the application in vertically taking off aircraft or they fail to have enough uniformity of flow if they are used to supply a flow or flows of hydraulic pressure fluid. Some of the mentioned engines also fail to have a uniform supply of power. In my mentioned earlier patents the forces of the combustion engine pistons are in equilibrium with the force consumption of the pistons of the hydraulic pumps. However, such equilibrium goes on the expense of uniformity of supply of power over time. The hydraulic hoses and pipes broke, thereby, under ununiform deliveries of fluid.

SUMMARY OF THE INVENTION

It is the object of this invention to increase the power of an engine per a unit of weight.

Another object of the invention is to provide a combustion engine with simple inlet and outlet means.

A further object of the invention is to provide a double piston of little weight in order to permit higher RPM of the engine.

Still another object of the invention is to run a plurality of double piston engines in timed relation relative to each other and to provide the means thereto by little weight of the components.

Still a further object of the invention is to provide a little weight powerful aircraft engine.

A still further object of the invention is to provide a flow of fluid or plural flows of fluid out of the engine with an almost uniform flow.

Other objects of the invention are dead space preventing valve means, inlet recesses, control shafts, control recesses and other inlet or outlet means.

More objects of the invention will become apparent from the description of the preferred embodiments and from the appended claims. The mentioned claims thereby serve partially also as the description of the aims and objects of the invention as well as a description in part of the preferred embodiments of the invention.

BRIEF DESCRIPTION OF THE DRAWINGS

FIG. 1 shows the sectional arrangement of the former art.

FIG. 2 shows also a sectional arrangement of the former art.

FIG. 4 is a spherical view into an engine to define the geometrics.

FIG. 9 shows a calculation table.

FIG. 10 shows results in a calculation table.

FIGS. 12A and 12B show an assembly of the former art in 90 degrees turned views.

FIGS. 13A, 13B, and 13C show a schematic explanation including formulas.

FIG. 21 is a calculation table with results therein.

FIG. 22 is a longitudinal sectional through an engine of the prior art.

FIG. 23 is a longitudinal sectional view through an engine.

FIG. 24 is a cross sectional view through FIG. 23 along the arrowed line.

FIG. 40 shows a calculation table with results.

FIG. 47 is a sectional view through FIG. 46 along the arrowed line 47—47.

FIG. 48 is a sectional view through a portion of an engine.

FIG. 49 is a sectional view through FIG. 48.

FIG. 50 shows the calculation respective to FIG. 48.

Figure 3:
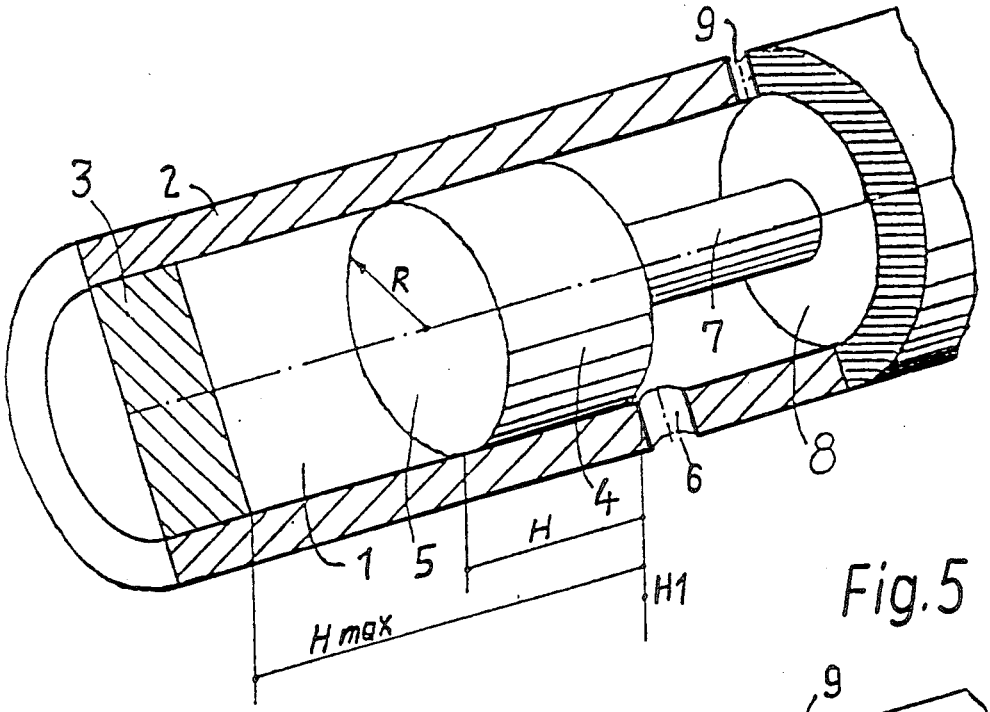
FIG. 3 shows a further arrangement of the former art.

As far as the Figures are not defined as former art, tables or diagrams, they are sectional views through engines or devices of the present invention, which partially show parts located inside of the device as portions seen from the outside in respective views.

DESCRIPTION OF THE PREFERRED EMBODIMENTS

FIG. 1 shows a sectional view of my mentioned earlier patents. It has a cylinder 2 with a therein reciprocating piston 4 which periodically varies the volume of the chamber 1. The piston shaft 777 pumps hydraulic fluid in chamber 111 when the engine cylinder 4 reciprocates. The fluid is delivered through an exit valve by which the arrangement becomes a hydrofluid conveying combustion engine.

FIG. 2 illustrates in a longitudinal sectional view the engine of the mentioned patent to Frank Stelzer. It has between the engine pistons a medial pre-charging piston with respective inlet and transfer means.

FIG. 4 is a longitudinal sectional view through another hydrofluid conveying combustion engine of my mentioned earlier patents. Engine piston 4 has an interior chamber 21 into which a stationary bar 25 sealingly extends. Bar 25 has passages with an entrance valve 22 and an exit valve 23. When the engine piston moves upwards in the compressioin stroke, the hydraulic fluid enters over valve 22 into the interior piston chamber 21. At the expansion stroke of the engine piston the valve 22 closes and the hydraulic fluid is pressed out over valve 23. Thereby the expansion or power stroke of the engine piston 4 supplies a flow of hydraulic fluid out of valve 23. The engine power is transformed into hydraulic fluid power.

However, the flow of hydraulic fluid is not uniform over time. It is therefore important in accordance with the present invention, to find a way of calculating the actual appearances.

Figure 5:
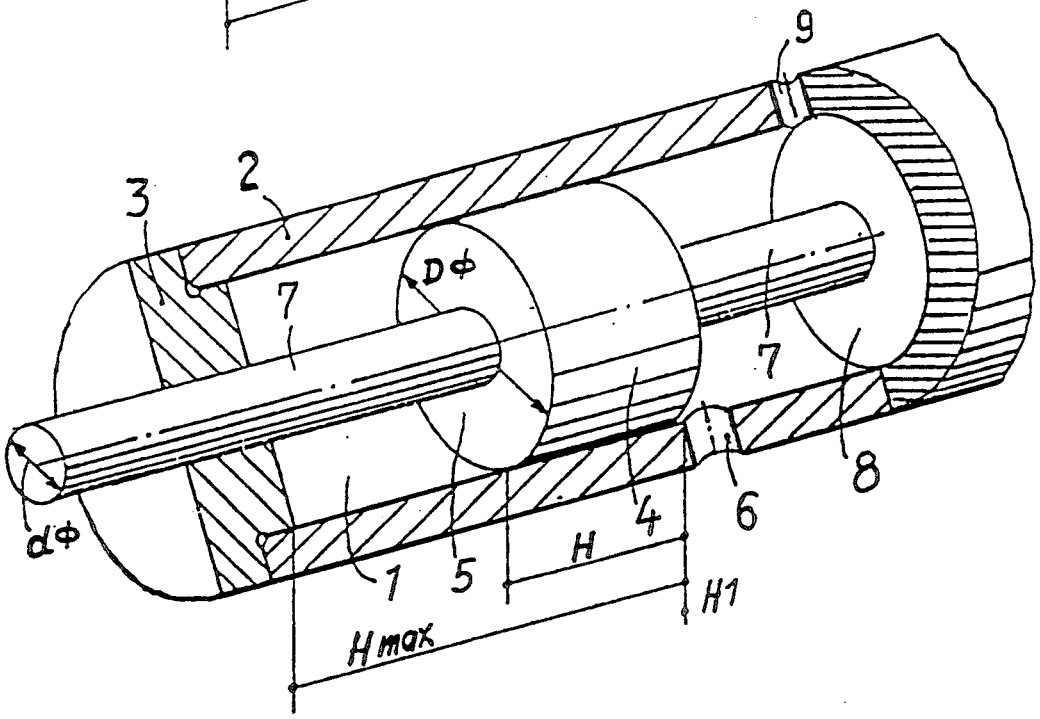
FIG. 5 is a spherical view into an engine to define also geometrics.
Figure 11:
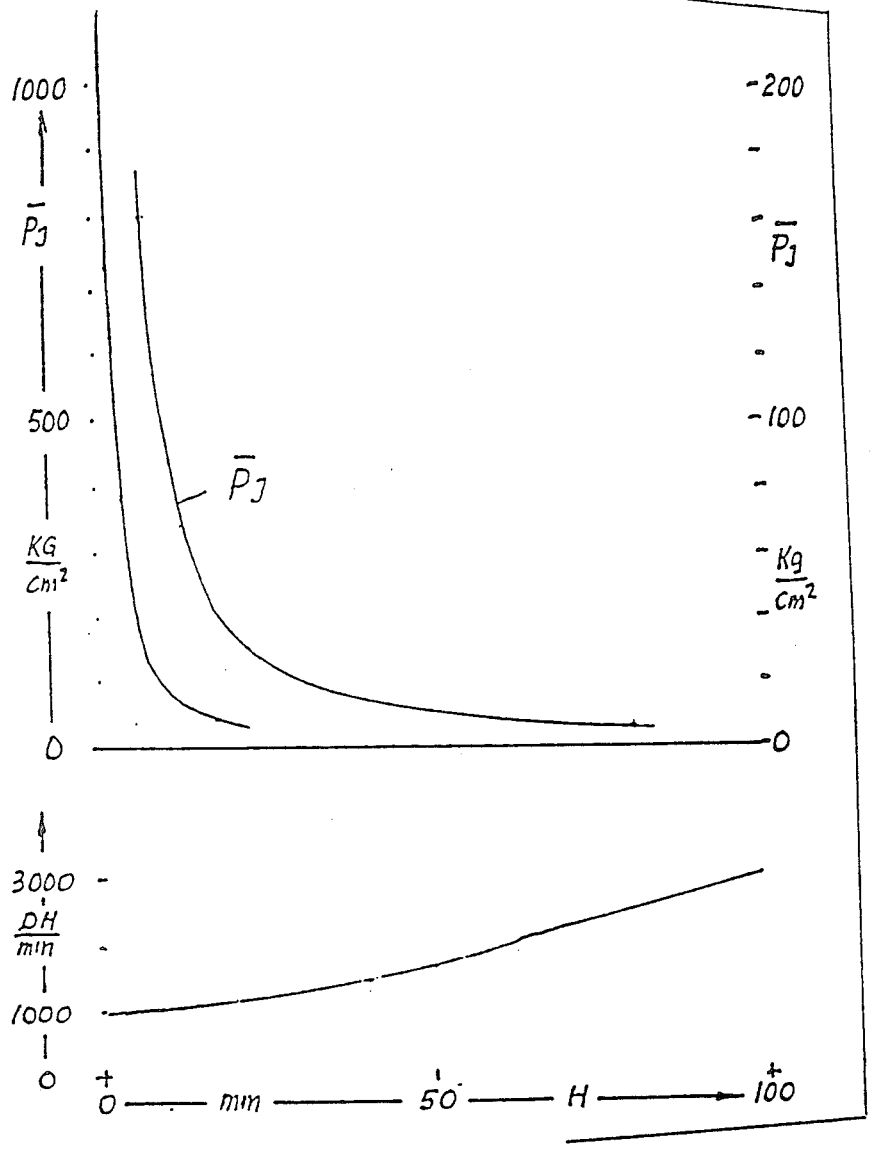
FIG. 11 is a diagram.

FIG. 3 and FIG. 5, therefore, illustrate the basic principle of the engine in a schematic with the definition of the geometrical and mathematical values. In FIG. 3 piston 4 has a shaft 7 only in one axial direction, while in FIG. 5 the engine piston 4 has two shafts 7, each one in each of the axial directions. The shafts 7 extend through the covers 8 or 8 and 3 respectively. The exhaust passage is shown by 6 and the maximum of piston stroke with compression or expansion is obtained when the top face of piston 4, the face 5 opens the exhaust passage 6.

The actual stroke of the piston at compression starts by "H1" and is defined to be: "H". Passage 9 is provided to prevent a compression of fluid below the bottom of piston 4. The radius and the diameter of the piston are shown by "R" and "D" respectively.

Figure 6:
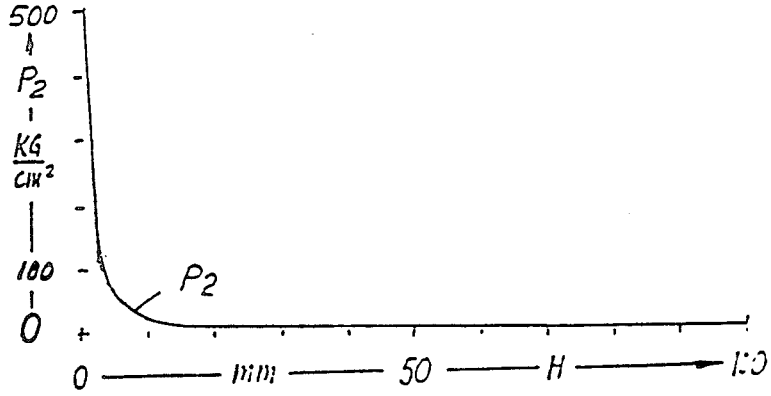
FIG. 6 is a P-V diagram.

For the compression actual pressure shown in the diagram of FIG. 6. How these pressures and other values are found will be shown in the analysis of the engine.

ANALYSIS OF THE ENGINE

For the compression or expansion of the gas in the cylinder off the engine the basic gas equation (1) applies.

$$P \times V^{\eta} = \text{constant} \quad (1)$$

Therein "P" is the pressure, "V" is the volume and "$\eta$" is the adiabatic exponent. It follows:

$$P_1 \times V_1^{\eta} = P_2 \times V_2^{\kappa} \quad (2)$$

and:

$$P_2 = P_1(V_1/V_2)^n \quad (3)$$

and:

$$P_2 = P_1 V_1^{\eta} V_2^{-\kappa} \quad (4),$$

since 1/V2 high "n" is V2 high minus n. In the following "κ" will be substitutet for "n" for the ease of typing. This exponent "n" is between 1.3 and 1.42.

The cross sectional area of the piston 4 is defined by equation (5) as:

$$F = R^2\pi \text{ or } F = D^{2\pi}/4 \quad (5)$$

with "D"=2R and "pi"=3.14.

In the sample of the analysis the maxium of stroke will be 10 cm and the cross sectional area of the piston 4 will be 100 squarecentimeter by which the cylinder chamber 1 will have a volume of 1000 CC with CC=cubiccentimeter. For the cylinder of FIG. 5 with the piston shaft of diameter "d" and the piston of diameter "D" follows equation (6):

$$F = D^{2\pi}/4 - d^{2\pi}/4 \quad (6)$$

$$D - d = \sqrt{D^2} - \sqrt{d^2} = F^4/\pi.$$

It would be helpful if equation (4) could be transformed to get "H" as the variable. At first impression such equation looks to read:

$$P_2 = P_1(^{2\pi}/4)^{\kappa} H_1^{\kappa} H_2^{-\kappa} \quad (7)$$

however, such equation would be wrong, because equation (3) would bring equation (8) as follows:

$$P2 = \frac{[(D^{2\pi}/4)H1]^{\kappa}}{[(D^{2\pi}/4)H2]^{\kappa}} = P1\,\frac{(D^{2\pi}/4)^{\kappa}H1^{\kappa}}{(D^{2\pi}/4)^{\kappa}H2^{\kappa}}; \quad (8)$$

wherein "F" appears above and below the fraction line. That simplifies the equation to equation (9) as follows:

$$P_2 = P_1 H_1^{\kappa} H_2^{-\kappa} \quad (9);$$

in which "P1" and "H1 high minus n" are constants. The variable now is the actual stroke "H"="H2".

One will find that the compression pressure may become very high and the compression pressure is shown in FIG. 6 over the actual piston stroke. The calculation is done until a distance of 1 mm of the top face 5 of piston 4 from the cover 3. The compression pressure would then be already about 500 atmospheres and if the combustion occurs with air ratio "lombda"=1, the combustion pressure would reach about 2000 atmospheres. This brings to light that at such high compression ratios the walls of the cylinders would break because they can not withstand such high internal pressures.

It is now convenient to find the medial pressure at compression or expansion because having it the power is simply this medial pressure "$\bar{p}$" multiplied by the stroke "H". In the following the respective equation(s) will be developed:

$$P2 = P1(V1/V2)^{\kappa}$$

-continued $$\left[\frac{\text{Kg}}{\text{cm}^2}\left(\frac{\text{cm}^3}{\text{cm}^3}\right)\right]$$

$$P = P1V1^{\kappa}\int(1/V2^{\kappa})dH$$

$$= P1V1^{\kappa}\frac{1}{\Delta H}\int\left(\frac{1}{V2^{\kappa}}\right)dH$$

$$= P1V1^{\kappa}\frac{1}{\Delta V}\;\frac{1}{1-\kappa}\,[V2^{1-\kappa} - V1^{1-\kappa}]$$

$$P = P1V1^{\kappa}\frac{1}{V2 - V1}\;\frac{1}{1-\kappa}\,[V2^{1-\kappa} - V1^{1-\kappa}]. \quad (10)$$

$$\left[\frac{\text{Kg}}{\text{cm}^2}\;\frac{\text{cm}^3}{\text{cm}^3}\,(\text{cm} - \text{cm}) = \frac{\text{Kg}}{\text{cm}^2}\right]$$

or:

$$P = P1V1^{\kappa}\frac{1}{H2 - H1}\;\frac{1}{1-\kappa}\,[H2^{1-\kappa} - H1^{1-\kappa}]. \quad (11)$$

$$\left[\frac{\text{Kg}}{\text{cm}^2}\;\frac{\text{cm}}{\text{cm}}\,(\text{cm} - \text{cm}) = \frac{\text{Kg}}{\text{cm}^2}\right]$$

Equation (11) follows from equation (10) since it is known from equation (8) that the areas eliminate.

From these equations it is easy to find the actual work (work "A") by multiplying the medial pressure with the area "F" and the stroke "H". The stroke difference then eliminates and it follows:

$$A = \text{work} = \frac{P1H1^{\kappa}}{1-\kappa}\,[H2^{1-\kappa} - H1^{1-\kappa}]D^{2\pi}/4. \quad (12)$$

$$\left[\frac{\text{Kg}}{\text{cm}^2}\,\text{cm}(\text{cm} - \text{cm})\text{m}^2 = \text{Kgcm.}\right]$$

Figure 8:
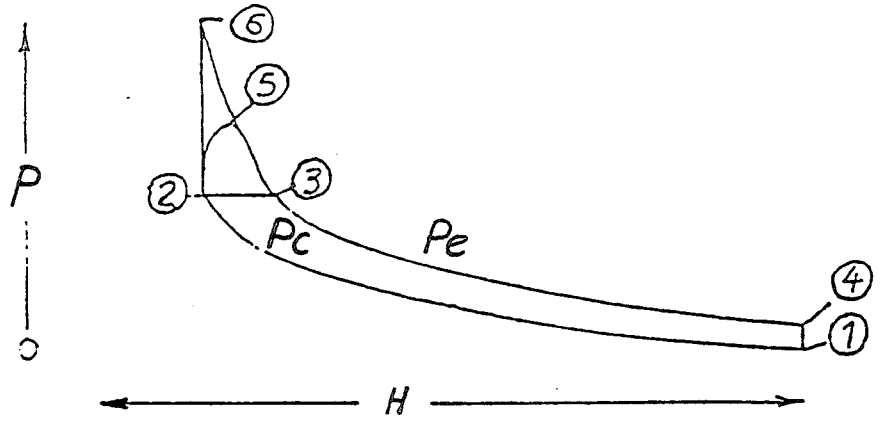
FIG. 8 is also a diagram.

FIG. 8 illustrates the known P-V diagram, however, for the values which are applied in this analysis. Introducing the indices "c" for compression, "e" for expansion; one obtains:

$$Ac = \frac{P1H1^n}{1-n}\,[H2^{1-n} - H1^{1-n}]D^{2\pi}/4; \quad (13)$$

$$Ae = \frac{P6H2^n}{1-n}\,[H2^{1-n} - H4^{1-n}]D^{2\pi}/4; \quad (14)$$

or:

$$Ae = \left\{P2(H2 - H3) + \frac{P2H3^n}{1-n}\,[H3^{1-n} - H4^{1-n}]\right\}D^{2\pi}/4. \quad (15)$$

The values which are obtained, are, as defined, works but not powers. To obtain the power therefrom, the work would have to be multiplied with the number of strokes per second. Remember;

work=Kgcm; power=Kgcm/sec.

The engine of the before mentioned patent to Frank Stelzer of the former art is called the "STELZER ENGINE" and in literature about the Stelzer Engine in magazines and newspapers in German, French and Japanese languages it is reported, that the Stelzer engine with a piston of 5 Kg makes 30,000 double strokes per minute. This requires a further investigation.

To evaluate the maximum of possible strokes of a free piston engine, Newtons law of force is brought to attention, which defines: (with force=K)

$$\text{memo: } V = bt\ [H = Vt] \tag{16}$$

$$\text{and: time-way relation: } H = bt^2/2 \left[ V = \frac{H}{t} = \frac{bt^2}{t2} = \frac{bt}{2} \right] \tag{17}$$

and with Newton:

$$k = mb \tag{18}$$

with:

V=velocity; K=force=Kg t=time (seconds)

H=way, stroke (meters)

b=acceleration (m/sec square) and:

m=mass=weight of piston/9.81 m/sec square,-gravity)

Therefrom follows the acceleration of the piston of the free piston engine as follows:

$$\left[ \frac{\text{Kg}}{\text{KgS}^2/m} = \frac{\text{Kg}}{\text{Kg}} \ \frac{m}{S^2} = \frac{m}{S^2} \right] b = K/m \tag{19}$$

and equation (17) can be transformed to:

$$\left[ \sqrt{\frac{m}{m/S^2}} = \sqrt{\frac{m}{m} S^2} = \sqrt{S^2} = S \right] t = \sqrt{2H/b} \tag{20}$$

Therein "b" may be inserted from equation (19) to obtain:

$$\left[ \sqrt{\frac{m\text{KgS}^2}{m\text{KG}}} = \sqrt{S^2} = S \right] t = \sqrt{2Hm/K} \tag{21}$$

and for the force "K" the value K=F×P may be inserted to obtain the basic acceleration equation for the free piston engine as:

$$t = \sqrt{2mH/(d^{2\pi}/4)P} \tag{22}$$

or:

$$\left[ \text{for } P = \frac{\text{Kg}}{m^2};\ H = m \right] t = \sqrt{8mH/d^2\pi P} \tag{23}$$

The number of strokes per second is obtained by multiplying with 1/t and, consequently, is:

$$EH/s = 1/t \tag{24}$$

wherein "E" indicates a single one way stroke and for "H" the difference (H1−H2) might be inserted.

Therefrom follows:

$$t = \sqrt{Bm(H1 - H2)P^{-1}} \tag{25}$$

with the constant: "B":

$$B = 8/d^2\pi \tag{26}$$

Just for memory, the constant "B" could further be shortened as follows:

$$\sqrt{B} = \sqrt{\frac{8}{\pi}/d^2} = \sqrt{2.51} \times \sqrt{d^{-2}} = 1.596\sqrt[2]{d^{-2}} = 1.596\,(d)^{\frac{-2}{2}};\ \sqrt{B} = 1.596/d \tag{27}$$

and the number of strokes (one way strokes) per second would be:

$$EH/s = 1/\sqrt{Bm(H1 - H2)P^{-1}} \text{ with } P^{-1} = \frac{1}{P} \tag{28}$$

or $$EH/s = [Bm(H1 - H2)P^{-1}]^{-0.5} \tag{29}$$

One now has a beautiful equation for the calculation of the number of strokes which are maximally possible, but it will be seen soon that it is not so easily possible to calculate with it. That will become apparent at hand of the inquiry about the announced number of strokes of the Stelzer engine.

Neglecting accuracy and assuming at first glance that the piston would be accelerated by the maximum of pressure at the combustion at eta=40 (eta=compression ratio) one would obtain with n=1.35 (in all further calculations n shall all times be 1.35 in this analysis):

$$P_2 = P_1 H_1^{\kappa} H_2^{-\kappa} = 1.100^{n} \cdot 2.5^{-\kappa} = 1.501 \cdot 0.29026 = 145.42\text{BAR} = 1454200\text{KG/m}^2$$

The constant B therein brings B=200.04 with D in meters; the mass "m" of Stelzers motor was announced to be 5 Kg; eta=40 gives H2=0.25 mm and tyhe number of strokes per second would then be:

$$EH/s = [200.04 \times 0.5 \times 0.0975 \times 1454200^{-1}]^{-0.5} = [200.04 \cdot 0.5 \cdot 0.0975 \cdot 6.877^{-7}]^{-0.5} = [6.6996^{-6}]^{-0.5} = 386EH/s$$

which corresponds to 386×30=11 588 DH/min with DH=double strokes per minute. This calculation was done for the compression stroke. For combustion at lomda=1 the expansion pressure would be four times higher, 145.45 bar ×4=581.68 bar inserted, would yield:

$$EH/s = [200.04 \times 0.5 \times 0.0975 \times 5816800^{-1}]^{-0.5} = 772EH/s = 23169DH/min.$$

Therefrom the compression pressure would have to be subtracted, but one could at this first glance get the impression that the Stelzer engine in case of extremity of luck could make the announced 30,000 double strokes per minute. For calculating the strokes from the compression calculation for lombda=1,(four times higher pressure at expansion stroke), the result of the calculation for the compression stroke would have to be multiplied with √(4−1)=1.73. The number of double stokes per minute would then be 11 588×1.73=20 047 DH/min.

The above calculation was done, however, at a first glance only with the wrong assumption that the maximum of pressure would act over the entire expansion and compression stroke. That is, however, not the case because the pressure drops immediately when the piston moves away from the combustion point (the inner dead point at 2.5 mm) towards the outer dead point, the exhaust location of the piston. For a next simplified consideration it might be assumed that the arithmetic medial pressure of the stroke might be inserted. Neglecting the compression stroke, the arithmetic mean pressure at the expansion stroke would be Pme=(P6+P4)/2=(582+4)/2=293 bar. The calculation with equation (29) would bring:

$$EH/s=[200.04\cdot 0.5\cdot 0.0975\cdot 2930000^{-1}]^{-0.5}=[3.328^{-6}]^{-0.5}=548EH/s=16444DH/min$$

Considering the subtraction of the compression pressure with $\sqrt{\frac{3}{4}}=0.866$, this value multiplied with the 16,444 DH/min gives 14,240 double strokes per minute =14,240 DH/min. The maximally possible number of strokes has already drasticly reduced at this slightly more accurate calculation.

The above consideration is, however, also only a very simplified and wrong consideration. If one looks at the P-V diagram of FIG. 8 one sees that the curves of the pressures at compression and at expansion are no straight lines but curves. The next still only slightly more accurate assumption might now be to use the medial pressures of the compression and expansion strokes from equation (11). Inserting these values one obtains:

$$P=\frac{10000\ Kg/m^2\times 0.1^n}{0.0975}\ \frac{1}{-0.35}\ [8.1418-2.2387]=$$

$$77269\ KG/m^2=7.73\ KG/cm^2=7.73\ bar.$$

and the strokes per second and double strokes per minutes would be:

$$EH/s=[200.04\cdot 0.5\cdot 77269^{-1}]^{-0.5}=[1.26^{-4}]^{-0.5}=89EH/s=2670DH/min.\times 1.73=4619DH/min.$$

The maximally possible number of strokes per unit of time have now really drasticly decreased. They are down to almost a fifth of the first calculation. However, even this consideration is not accurate, because equation (2) is valid only for a constant acceleration over the entirety of the way of stroke. In actuality in the free piston engine the acceleration varies at any moment of the stroke of the piston. The inventor of this application has tried since a long time to find an analytic mathematical formula for the actual acceleration of the piston of the free piston engine which would take into consideration the at all times varying acceleration during the stroke of the piston. Regrettably, however, such formula has not yet been found. The remaining possibility to increase the accuracy is, therefore, to use the medial pressure for small intervals of the stroke and insert them into equation (11). That is not so simple but it can be done if a respective form is used. Such suitable form is shown in FIG. 9 and in FIG. 10 the form of FIG. 9 is used to calculate the above example of values actually through. It is learned from it that the maximally possible number of strokes is still far less than the number of strokes of the last calculation there before.

For further improvements of the consideration procedures the equation (29) is once looked upon again. It reads:

$$EH/s=[Bm(H_1-H_2)p^{-1}]^{-0.5} \tag{29}$$

or written in the other form:

$$EH/s=[1/\sqrt{Bm(H1-H2)/\boxed{P}}$$

which could still written differently bu using the rules of calculations with powers and roots as follows:

$$EH/s=\frac{1}{\sqrt{B}}\times\frac{1}{\sqrt{m}}\times\frac{1}{\sqrt{(H1-H2)}}\times\frac{1}{\sqrt{1/P}}$$

or:

$$EH/s=\frac{1}{\sqrt{B}}\ \frac{1}{\sqrt{m}}\ \frac{1}{\sqrt{(H1-H2)}}\times\frac{1}{\sqrt{\boxed{P}}} \tag{30}$$

From equation (30) is is immediately visible that the number of strokes increases with smaller values below the fraction line.

Therefrom the following rules are obtained:

1. The number of strokes increases with the root of decrease of the mass.
2. The number of strokes decreases with the root of increase of the mass.
3. The number of strokes increases with increase of the root of the medial pressure.
4. The number of strokes decreases with the root of decrease of the medial pressure.
5. The number of strokes increases with the root of the decrease (shortening) of the length of the stroke.
6. The number of strokes decreases with the root of the increase (lengthening) with the length of the stroke.

(The rules 5 and 6 are, however, in practical application not all times suitable since with the variation of the lengths of the strokes the pressures also variate. This has to be considered in cases of applications of rules 5 and 6.)

Samples of calculations with these rules may be seen in West German patent publication DE-OS-33 41 718.0 published on May 30, 1984.

The mentioned German publication contains also in detail explanations how by the above established rules the sample of the Stelzer engine could be considerably improved.

The stepwise calculation by stroke intervals as done in FIGS. 99 and 10 could be eliminated if the actually acting medial pressure " P " could be calculated. That is still not possible and a graphic methode might, therefore, be suitable. Before considering a graphical solution, some mathematical results of applicant's considerations shall be memorized. They do not yet lead to a mathematical solution but may be helpful for steps of calculations for which they are shown in the following:

Medial integral pressure "$\overline{P}$" at compression and expansion, calculated from the volumes:

$$PV^{\kappa}=\text{Konstant} \qquad P1V1^{\kappa}=P2V2^{\kappa}$$

$$P2=P1(V1/V2)^{\kappa}$$

-continued $$p = P1V1^{\kappa}\int (1/V2^{\kappa})dV = [P1V1^{\kappa}/(V2 - V1)] \int V2^{-\kappa}dV$$

$$p = P1V1^{\kappa}\frac{1}{V2 - V1}\ \frac{1}{1-\kappa}\ V2^{1-\kappa}\Big|_{V1}^{V2} \quad \boxed{p = \frac{P1V1^{\kappa}}{(V2 - V1)(1-\kappa)}[V2^{1-\kappa} - V1^{1-\kappa}]} \tag{31-A}$$

Medial integral pressure "$\bar{p}$" at compression and expansion calculated from the strokes:

-continued $$p = P1V1^{\kappa}\frac{1}{V2 - V1}\ \frac{1}{1-\kappa}[V2^{1-\kappa} - V1^{1-\kappa}]$$

$$= \frac{P1(d^2\pi/4)^{\kappa}H2^{\kappa}}{1 - \kappa(d^2\pi/4)^{\kappa}(H2 - H1)}[H2^{1-\kappa} - H1^{1-\kappa}] = \boxed{p = \frac{P1H1^{\kappa}}{(H2 - H1)(1-\kappa)}[H2^{1-\kappa} - H1^{1-\kappa}]} \tag{31-B}$$

Medial integral pressure "$P_{\Delta}$" at H2 minus interval $\Delta H$ for compression and expansion:

$$\boxed{P2^1 = \frac{P1H1^{\kappa}}{(H1 - H2)}[H2^{-\kappa} - 1]}$$

$$P\Delta = P1H1^{\kappa}H2^{-\kappa} - P1H1^{\kappa}(\Delta H)^{-\kappa} = P1H1^{\kappa}[H2^{-\kappa} - (\Delta H)^{-\kappa}]$$

$$P\Delta = \frac{P1H1^{\kappa}}{\Delta H}\int [H2^{-\kappa} - (\Delta H)^{-\kappa}]dH = \frac{P1H1^{\kappa}}{\Delta H(1-\kappa)}[H2^{1-\kappa} - (\Delta H)^{1-\kappa}]_2^{2-(\Delta H)}$$

$$= \frac{P1H1^{\kappa}}{\Delta H(1-\kappa)}[H2^{1-\kappa} - (\Delta H)^{1-\kappa} - (\Delta H)^{1-\kappa} + (\Delta H)^{1-\kappa}] = \boxed{P\Delta = \frac{P1H1^{\kappa}}{\Delta H(1-\kappa)}[H2^{1-\kappa} - (\Delta H)^{1-\kappa}]} \tag{32}$$

Medial integral value "$\epsilon$" of the compression ratio "$\epsilon$":

$$P2 = P1(H1/H2)^{\kappa};\ (H1/H2) = \epsilon;\ p = \frac{1}{\Delta(H1/H2)}\int (H1/H2)^{\kappa}dH$$

$$p = \frac{P1}{\Delta(H1/H2)}\ \frac{1}{(\kappa+1)}[(H1/H2)^{\kappa+1} - (H1/H2)^{\kappa+1}] = \boxed{p = \frac{P1}{\Delta(H1/H2)(\kappa+1)}\left[\left(\frac{H1}{H2}\right)^{\kappa+1} - 1\right]} \tag{33}$$

Differential of pressure "$P_2$" relative to the stroke:

Caluclation of the time "t" if a medial acting pressure $$P2 = P1(H1/H2)^{\kappa}$$

$$P2^1 = \frac{P2}{dH} = P1\kappa(H1/H2)^{\kappa-1};\ \int P2^1dH = \frac{P1\kappa}{\kappa - 1 + 1}\left(\frac{H1}{H2}\right)^{\kappa-1+1} = P1\frac{\kappa}{\kappa}\left(\frac{H1}{H2}\right)^{\kappa} = P1\left(\frac{H1}{H2}\right)^{\kappa}$$

$$P2^1 = \frac{P1}{\Delta(H1/H2)}\int \kappa(H1/H2)^{\kappa-1}dH\Big|_{\Delta(\ )1}^{\Delta(\ )2} = \frac{P1}{\kappa\Delta(H1/H2)}(H1/H2)^{\kappa}\Big|_1^2 = \boxed{P2^1 = \frac{1P1}{\kappa\Delta(H1/H2)}[(H1/H2)^{\kappa} - 1]} \tag{34}$$

" $\bar{P}$ " would be known:

Medial integral of the differential of pressure "P2" relative to stroke:

$$P2 = P1H1^{\kappa}\ H2^{-\kappa} \tag{35}$$

$$P2^1 = \frac{P2}{dH} = P1H1^{\kappa} - \kappa H2^{-\kappa-1};\ \int P2^1dH =$$

$$P1H1^{\kappa}\frac{-\kappa}{-\kappa - i + 1}H2^{-\kappa-i+1} = P2 = P1H1^{\kappa}H2^{-\kappa}$$

$$P2^1 = \frac{P1H1^{\kappa}}{(H1 - H2)}\int -\kappa H2^{-\kappa-1}dH =$$

$$\frac{P1H1^{\kappa}}{(H1 - H2)}\ \frac{-\kappa}{-\kappa}[H2^{-\kappa-i+1}]_{H1}^{H2} =$$

$$K = mb;\ b = K/m = (d^2\pi/4)\ \boxed{P}/m \tag{36}$$

$$H = \frac{b}{2}t^2 = \left(\frac{d^2\pi}{8}\right)\ \frac{\boxed{P}}{m}\ t^2$$

$$t = \sqrt{\frac{2Hm}{d^2\pi/4}\ \frac{1}{\boxed{P}}} = \sqrt{\frac{8mH}{d^2\pi}\ /\ \boxed{P}}$$

$$\boxed{t = \sqrt{\frac{CmH}{\boxed{P}}}} \quad \text{with} \quad \boxed{C = 8m/d^2\pi}$$

(This calcualtion is valid only if the acting medial pressure " $\overline{P}$ " would be known. Rgrettably, this acting medial pressure is not yet known.)

Calculation of the time "t" if the calculation from the pressure "P2" would be possible (which regrettably is not possible):

$$K = mb;\ b = K/m = d^{2\pi}/4\ \boxed{P}\ /m \tag{37}$$

mit $P2 = b = (d^{2\pi}/4)P1H1^{\kappa}H2^{-\kappa}/m$

-continued $$Z = \frac{1}{\Delta H\kappa H2^{\kappa-1}}\ \frac{2}{3}\cdot(\Delta H\ H2^{\kappa})^{3/2}$$

$$\boxed{t = R\frac{1}{\Delta H}\ \frac{1}{\Delta H\kappa H2^{\kappa-1}}\ \frac{2}{3}\cdot(\Delta H\ H2^{\kappa})^{1.5}}$$

MEMO (39)

| | | | | | |
|---|---|---|---|---|---|
| $K = mb$ | | $m = G/9.81 = \frac{Kgs^2}{m}$ | $\Delta H = \int\int bdtdt$ | | $\Delta H = (b/2)t^2$ |

| | | | | |
|---|---|---|---|---|
| $V$ = Geschwindigkeit = $bt$ | | $b = 2H/t^2 = 2(H1 - H2)/t^2$ | | $t^2 = 2\Delta H/b$ |

| | | | | |
|---|---|---|---|---|
| $P2 = P1V1^{\kappa}V2^{-\kappa} = P1H1^{\kappa}H2^{-\kappa}$ | | $K = mb = d^2\frac{\pi}{4}\boxed{P}$ | | $t^2 = (8m/d^2\pi)(\Delta H)/\boxed{P}$ |

mit $P2 = (d^{2\pi}/4)P1H1^{\kappa}H2^{-\kappa}$ und

Medial integral pressure "$P_{\Delta}$" by difference P2 minus " ":

$$\boxed{P\Delta = P2 - \Delta P = P1H1^{\kappa}[H2^{-\kappa} - (\Delta H)^{-\kappa}]} \tag{40}$$

$$\boxed{P\Delta = \int P\Delta dH = \frac{P1H1^{\kappa}}{(\Delta H)}\left[\frac{H2^{1-\kappa}}{1-\kappa} - \frac{(\Delta H)^{1-\kappa}}{1-\kappa}\right]_{H1}^{H2} = \frac{P1H1^{\kappa}}{(\Delta H)(1-\kappa)}[H2^{1-\kappa} - (\Delta H)^{1-\kappa}} \tag{41}$$

$$\frac{1}{P2} = (d^{2\pi}/4)^{-1}P\,1^{-1}H\,1^{-\kappa}H2^{\kappa}$$

$$t = \sqrt{\frac{2H}{b}}$$

$$t = \sqrt{2Hm(d^{2\pi}/4)^{-1}P1^{-1}H1^{-\kappa}H2^{\kappa}} = \sqrt{8Hm(d^2\pi)^{-1}P1^{-1}H1^{-\kappa}H2^{\kappa}}$$

Calculation of time "t" if P2 would be constant over stroke:

$Y$ = CONSTANT $\quad Y = (8m/d^2\pi)$ $$t^2 = Y(H2 - H1)/H1^{\kappa}H2^{-\kappa} \tag{42}$$

$$\boxed{t^2 = Y(H2 - H1)H1^{-\kappa}H2^{\kappa}}$$

Calculation of time "t" if "$\overline{P}$" would be constant over stroke $$t^2 = Y(H2 - H1)/\frac{P1H1^{\kappa}}{(H2 - H1)(1-\kappa)}[H2^{1-\kappa} - H1^{1-\kappa}] \tag{43}$$

$$\boxed{t^2 = Y(H2 - H1)^2(1-\kappa)^{-1}P1^{-1}H1^{-\kappa}[H2^{-1+\kappa} - H1^{-1+\kappa}]}$$

Calculation of time "t" if "$P_{\Delta}$" would be constant over stroke:

$$t^2 = Y(H2 - H1)/\frac{P1H1^{\kappa}}{(H2 - H1)(1-\kappa)}[H2^{1-\kappa} - (\Delta H)^{1-\kappa}] \tag{44}$$

$$\boxed{t^2 = Y(H2 - H1)^2P1^{-1}H1^{-\kappa}(1-\kappa)^{-1}[H2^{\kappa-1} - (H2 - H1)^{\kappa-1}]}$$

mit $R = \sqrt{8m/d^2\pi P1H1^{\kappa}}$ $\quad R$ = Constant (38)

$t = R(H \times H2^{\kappa})^{\frac{1}{2}}$ $\quad$ mit $H = H1 - H2$ $t = \frac{1}{\Delta H}\int(H \times H2^{\kappa})^{\frac{1}{2}}dH$ = (function of a function)

Integration by Substitution; $Z = (H \times H2^{\kappa})$ $$\frac{dZ}{dH} = H\kappa H2^{\kappa-1}$$

$$dH = 1/H\kappa H2^{\kappa-1} = (\Delta H)^{-1}\kappa^{-1}(H2^{\kappa-1})^{-1}$$

$$dZ = (H\kappa 2^{\kappa-1})dH$$

$$dH = 1/(\Delta H)\kappa H2^{\kappa-1} \quad Z = \frac{1}{dH}(Z)^{\frac{1}{2}}d2$$

Since the acting medial pressure " P " has still not been found it shall now be defined for the sample of the Stelzer engine which was calculated herebefore, at hand of compression ratio "$\epsilon = 40$". It can be obtained by modifying column 34 of FIG. 10 to: " P ". It yields:

$\Sigma t$(column 38)=0.0558; $(\Sigma t)^2=3.1136^{-3}$;
$t^2=2\Delta Hm/K=2\Delta Hm/P^F$ and $$P=2\Delta Hm/F(\Sigma t)^2=2\cdot 0.0975 \cdot 0.5/100\cdot 3.1136^{-3}=0.313138$$

This value of only 0.313138 bar (Kg/cm square) is, however, a great surprise. At the start of the stroke the pressure P2 or P4 was extremely high. At the earlier calculations the medial pressures at compression were still a number of atmospheres but now the acting medial pressure is only a fraction of an atmosphere. That is so because the high pressures act only at extremely short times during the strokes.

Since the result is such a big surprise the matter shall now be further investigated. The equation for the calculation of the time "t" was:

$$t=\sqrt{2\Delta H/b}=\sqrt{2\Delta Hm/F\boxed{P}}$$

and can be transformed to:

$$P=2(\Delta H)m/Ft^2 \quad (45)$$

It now looks as if the searched for acting medial pressure " P " could be found by summarizing the found values of the intervals to calculate with them. If that would work a so found medial acting pressure might probably in future be used if written in a graph. The acting medial pressures " P " could then be taken from such a graph and be used for calculation in the earlier established formulas. For that purpose equation (45) would have to be written to define that the sum of the intervals of the times "t" have to be used. On so obtains:

$$P=2(H_1-H_2)m/F(\Sigma t)^2 \quad (46)$$

Figure 39:
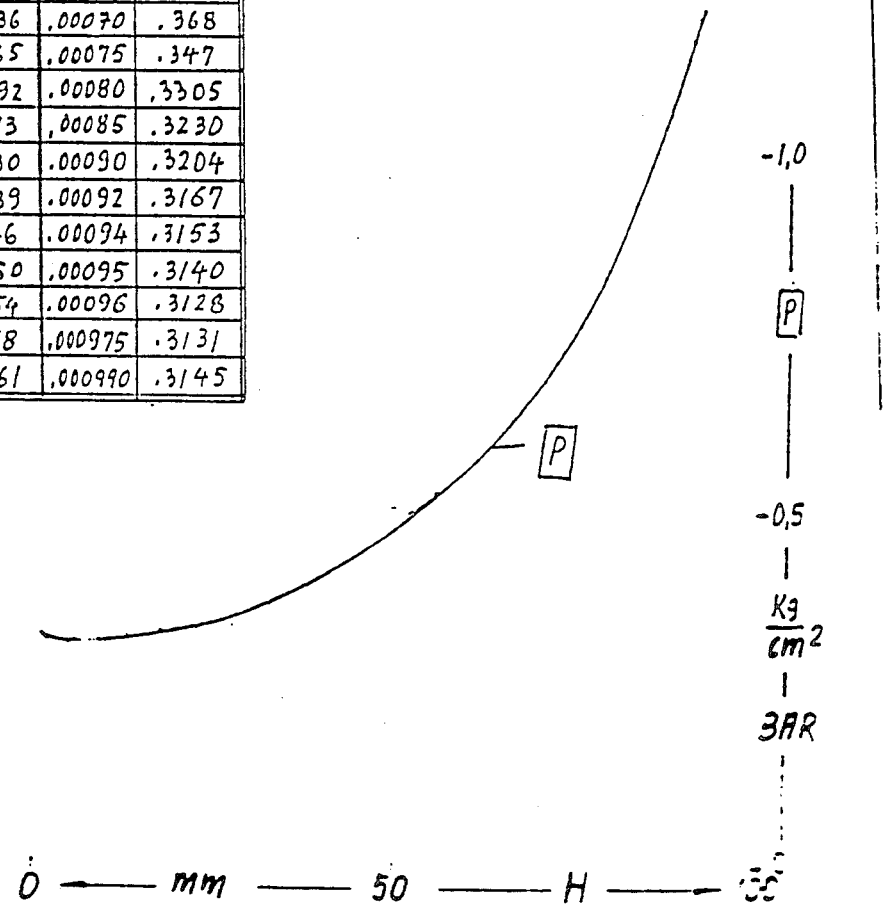
FIG. 39 shows a diagram with a table.

The result is shown in FIG. 39 and it is calculated in the table of FIG. 39.

((Memo: for control of the consideration equation (29) may be applied with the obtained " P ". The control calculation would bring 658 DH/min for the entire engine. That is different from the above consideration, and, consequently, the above defined calculation for " P " may not yet be correct and should be considered as such, be used only with care.

$$EH/s=[Bm(H_1-H_2)\ P^{-1}]^{-0.5}=[200.04\cdot 0.5\cdot 0.09\cdot 75/3145]^{-0.5}=12.67 EH/s=380 DH/\text{min.}))$$

COMPARISON WITH OTHER ENGINES

Applicant's 1978 aircraft engine with 811 CC run with 10,000 RPM and gave 120 HP. The weight of the conrod plus piston per cylinder was about 500 grams. The mass was thereby only about 0.05. Compression ratio was "$\epsilon=9$" about. Using these values in the above equations for the free piston engine one would obtain: $\phi$ of piston=6.1 cm. Stroke=6.3 cm. $6.1^2\pi=116.89$ cm$^2$; B=8/116.89=0.068. M=0.05. $\Delta$H=6.3 cm. For $\epsilon=9$ from FIG. 39 follows P =0.3210 kg/cm$^2\times 3$ for entire engine=0.963.

$$EH/S=1/\sqrt{0.068\cdot 0.05\cdot 0.063/0.963}=67.05\times 30=2011\ DH/\text{min.}$$

This comparison shows that the aircraft engine could have run only 2011 RPM if the free piston engine equations would be used. But actually the engine run 10,000 RPM. This shows that the equations for the free piston engine can not be used for the engine with a crankshaft. In the above case the crankshaft of the aircraft engine had a weight of about 9.5 Kg. The engine had four pistons and about 6 Kg were located at half of the radius. This gives a mass of about 0.15 per piston's crankshaft counter weights. This mass did, however, not make just the stroke, but 1 times pi/2=1.57 times of the stroke as rotary movement. The kinetical energy of the counterweights of the crankshaft was, therefore, (1.57) square=2.47 times of the kinetical energy of the reciprocating piston of the free piston engine. Since the mass of the conrod plus piston was only 0.05 the kinetical energy was (0.15/0.05)/2=7.4/2 times higher than the kinetical energy required to accelerate the piston and its conrod.

One obtains the following important conclusion:

The common engine with a crankshaft has counter weights which move a 1.57 times longer way than the stroke of the free piston engine is and thereby the engine with a crankshaft has a permanently available kinetical energy at a given revolution which overcomes the required acceleration forces which are required to accelerate the conrod and the piston to the reciprocating stroke. The crankshaft engine has thereby an ability to obtain any desired RPM (until it breaks) while the free piston engine does not have such a bank of avialable kinetical energy and is forced to accelerate its piston by the pressure in the cylinder at each individual stroke. Thus, the free piston engine is limited in the number of strokes while the engine with a crankshaft can obtain any desired RPM until it breaks or until the ports are too small to bring or expel enough fluid.

Since in the free piston engine the compression requires at least one fourth of the power of the expansion stroke and since the expansion stroke must drive the compression stroke, the free piston engines loses at least one fourth of the energy of its fuel for the operation with the compression stroke.

This is an important consideration and shall therefore be more deeply inquired.

For that purpose FIG. 10 has in column 37 the kinetical energy of the piston of the free piston engine. Column 42 gives therefrom the HP of the engine. To check column 37 of FIG. 10 equation (13), which is a pure thermodynamic equation, may be used. It gives:

$$Ac=\frac{P1H1^{\kappa}}{1-\kappa}[H1^{1-\kappa}-H2^{1-\kappa}]d^2\pi/4=$$

$$\frac{1\times 10^{\kappa}}{-0.35}[10^{-0.35}-0.25^{-0.35}]11.28\frac{2\pi}{4}=$$

$$\frac{22.39}{-0.35}[0.4467-1.6245]100=7535\ \text{Kgcm}=75.35\ \text{Kgm.}$$

Compared therewith column 42 in FIG. 10 gives 54.35 Kgm. The results are not equal but not very much different. It shows that the actual results of FIG. 10 are not too much wrong for the first calculation attempt.

Comparing consideration for the balance of the energies:

FIG. 12 shows the conrod and the piston of the mentioned aircraft engine of 1978 in a 1:1 scale. It corresponds to the 750 CC Honda motorbike engine of the seventies.

FIG. 13 shows the mechanism of the crankshaft engine with the therein applying equations. The equations are partially simplified by neglecting values of small results.

At one half of a revolution the kinetical energy for the acceleration of the piston and conrod is taken out of the crankshaft and at the next half revolution it is added to the crankshaft by which the crankshaft maintains its kinetical energy over the time. For acceleration and slow down of the RPM of the crankshaft engine more or reduced fuel energy is supplied by opening the throttle wider or by reducing it.

Improvements of the free piston engine:

Using the rules which were established above it will now be attempted to improve the free piston engine for a greater number of strokes per revolution.

Figure 14:
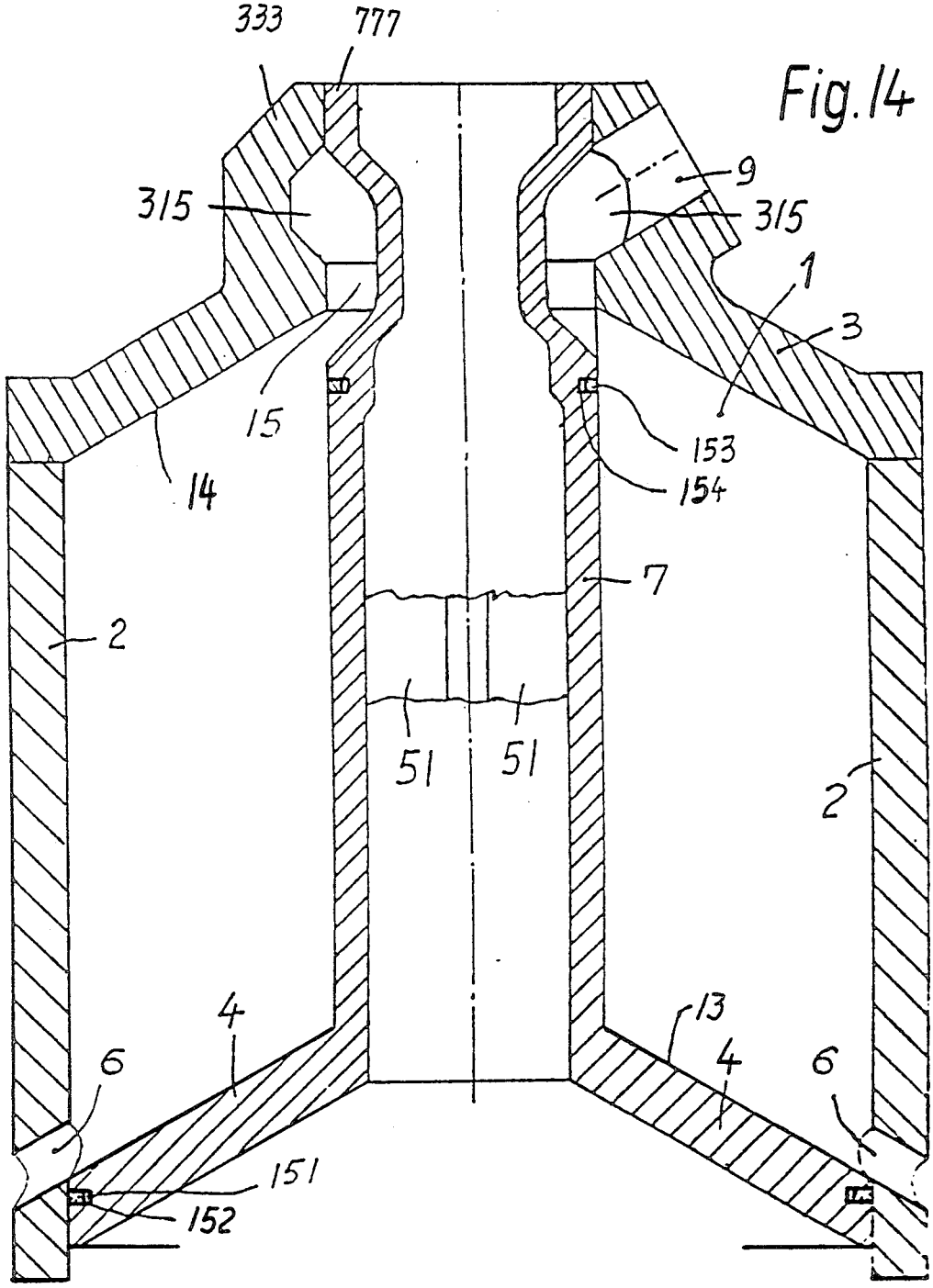
FIG. 14 is a longitudinal sectional view through a cylinder arrangement.

FIG. 14 shows an important embodiment of a free piston engine of the invention in a 1:1 scale in longitudinal sectional view. The improvement compared to the Stelzer engine is a reduced weight of the piston to about 1.5 Kg in case of a piston of steel. The Figure has additional improvements. However, the reduction of weight of the piston brings according to the in this specification established rules a considerable and important increase in the number of strokes which are possible in a unit of time. The detailed calculations of the number of strokes etc. is not given in this specification.

In FIG. 14 a charger (turbo) supplies pre compressed air or air-fuel mixture from inlet 9 over control recess arrangement 15 into the working chamber (cylinder) 1. Head cover 3 is mounted onto the wall 2 of the cylinder. Inclined faces 14 and 13 may be provided on the cover 3 and piston 4 to streamline the flow of air or gas. The gas leaves the chamber 1 through outlets or exhaust ports 6 when the piston has the location as shown in the Figure. The chamber 1 is now flashed. From piston 4 extends in the axially outward direction the piston shaft or control shaft 7 which has the control recess 7 which opens and closes the inlet port 9 to and from the cylinder or chamber 1 at the up and down stroke (reciprocation) of the piston. Shaft 7 may be provided with a piston ring groove 154 to have therein the piston ring (seal ring) 153.

Figure 15:
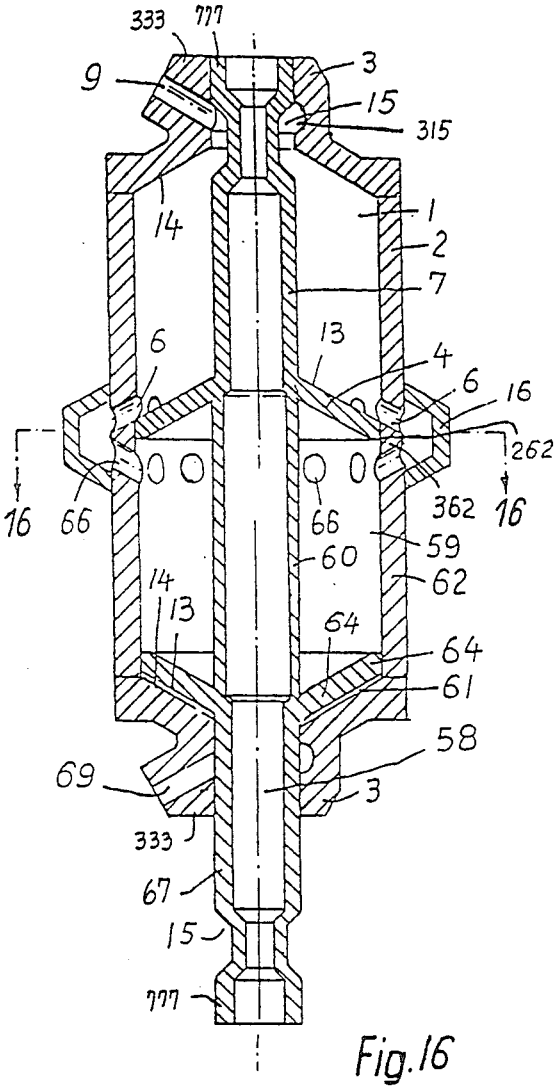
FIG. 15 is a longitudinal sectional view through an engine.

In FIG. 15 the engine portion of FIG. 14 which may also be used in a crankshaft engine, is shown in a scale reduced to one third and mounted to form with a second opposing cylinder a free piston engine. The weight of the piston is about 3.8 Kg and the engine of FIG. 15 would as free piston engine obtain about two times the number of strokes compared to the earlier discussed Stelzer engine. Details of calculation are available in the mentioned German DE OS. The bottom of FIG. 15 shows the opposed cylinder, cover and piston with pre-indices 6. The bottom portion of the engine acts similar as the top portion, however, at opposed strokes and times. The pistons 4 and 64 are connected by the medial piston connecting portion 60. When one of the cylinders 1 or 61 acts in the expansion stroke the opposed cylinder 61 or 1 acts in the compression stroke. Ignition means and fuel injection means are not shown in the Figures of this specification because they ar known in the art. The engine of FIG. 15 and the similar embodiments of this specification are thereby one cycle engines because at every stroke the engine has a power stroke. Once the respective cylinder is flashed and filled with fresh air, the piston moves and closes the exhaust ports 6,66, whereby the compression begins and the ignition occurs when the respective piston 4,64 is close to the cover 3,63 while thereafter the direction of movement of the piston(s) reverses and the power stroke begins until the respective piston opens at the end of the power stroke the exhaust port(s) 6,66 for the exhaust of the used gases.

As a further speciality of this Figure an exhaust collecter 16 is mounted around the medial portion of the cylinders and the exhaust ports 6,66 port into the exhaust collection chamber housing 16.

Figure 16:
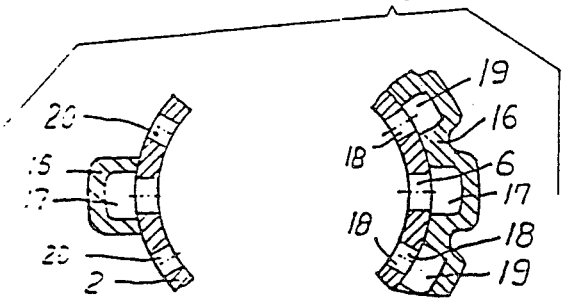
FIG. 16 is a cross sectional view through FIG. 15 along line 16—16.

FIG. 16 is a cross sectional view through FIG. 15 along the arrowed line XVI—XVI of FIG. 15 and illustrates that instead of providing just an exhaust gas collection chamber 16 the arrangement may include exhaust chambers 16 and additionally therefrom separated cool fluid supply chambers 19 with cool fluid supply entrances 18. They will press cooling fluid into the space 59 between pistons 4 and 64 around medial connecting portion 60 to cool the neighboring parts. A passage or a plurality of passages may be provided through the medial piston connecting portion 60 in order to lead the cooling fluid also through the hollow piston shafts 7,67. These passages are not shown in FIG. 15. Passages 20 may also be provided in the cylinder wall to connect with the free outside if so desired.

Figure 17:
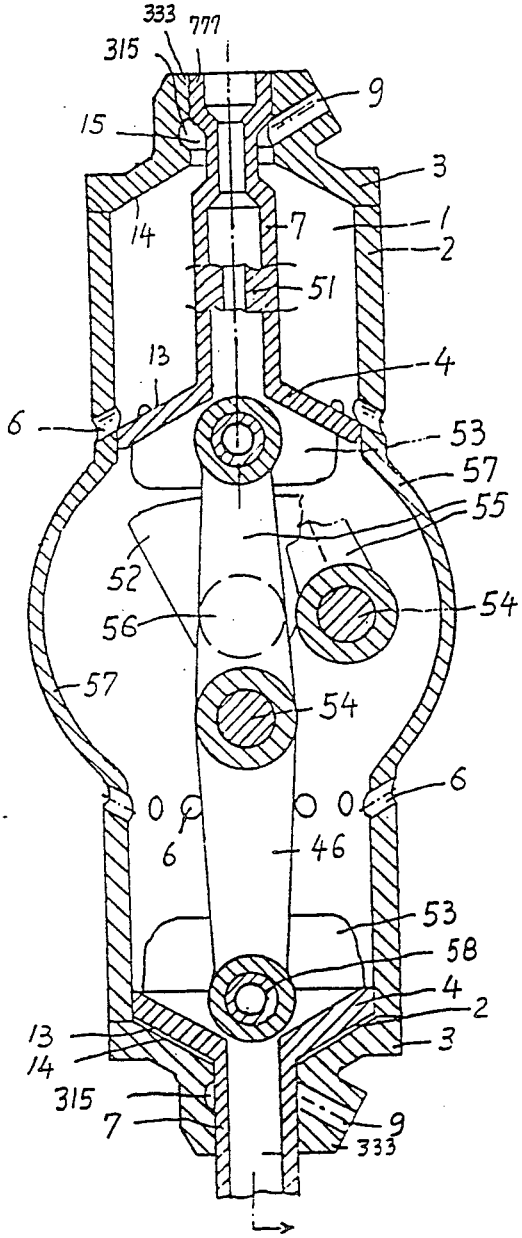
FIG. 17 is a longitudinal sectional view through an engine.
Figure 18:
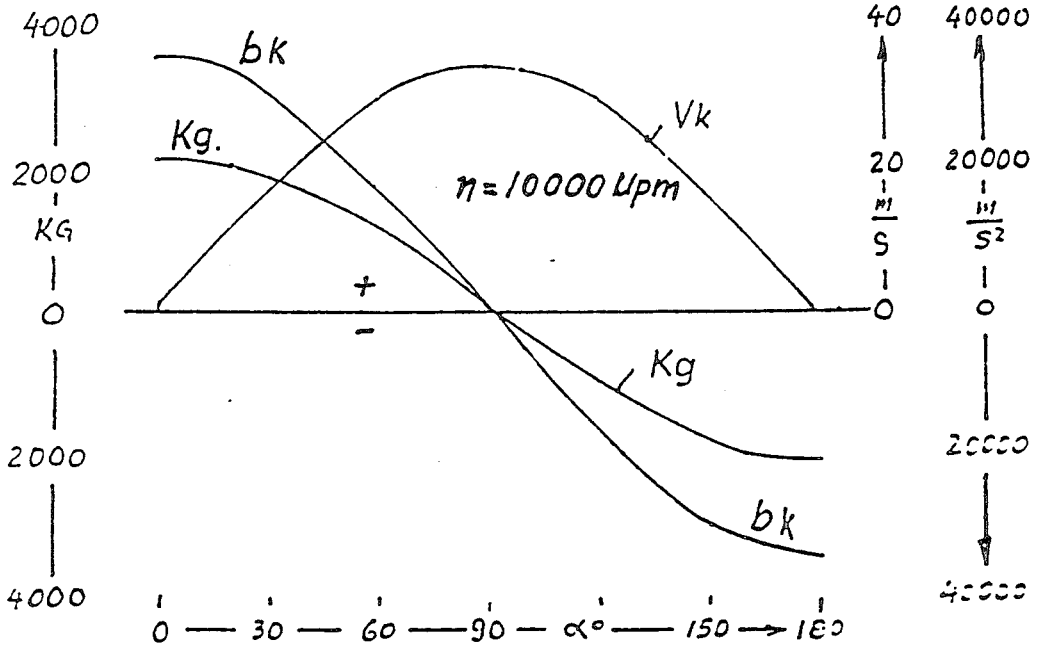
FIG. 18 shows a diagram.

FIG. 18 shows how the number of strokes per a given unit of time can become increased in accordance with the analysis of this specification. The top and bottom portions of FIGS. 14 or 15 are assembled to a medial housing 57. In this housing 57 a crankshaft 54 is revolvably borne in bearings 56 and it has the counter weights 52. Connecting rods 55 are borne by the crankshaft at 54 and connect to the piston(s) at 58. Cooling ribs 53 may be provided on the pistons. Now the formerly free piston engine has obtained a revolving crankshaft with the revolving mass which forms the bank for the containment and supply of the kinetical energy to accelerate the pistons to their reciprocating strokes. The number of strokes per unit of time of the engine of the invention of FIG. 17 can now make any desired strokes per unit of time until it would break. The limitations to number of strokes of free piston=double piston engines is now overcome by this Figure. Instead of using the term "connecting rod" for part 55 the common term "conrod" is used in this specification.

FIG. 18 shows the velocity, acceleration and required forces K for the acceleration for reciprocation of piston and conrod of a sample of an engine over the rotary angle "alpha" of the crankshaft.

Figure 19:
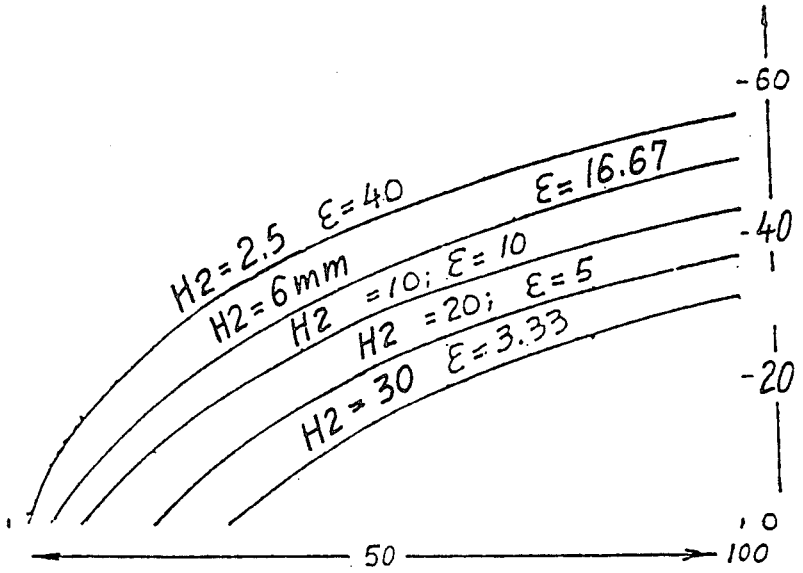
FIG. 19 shows also a diagram.

FIG. 19 shows a diagram of the powers obtainable from a sample of an engine at different strokes and compression ratios.

Figure 20:
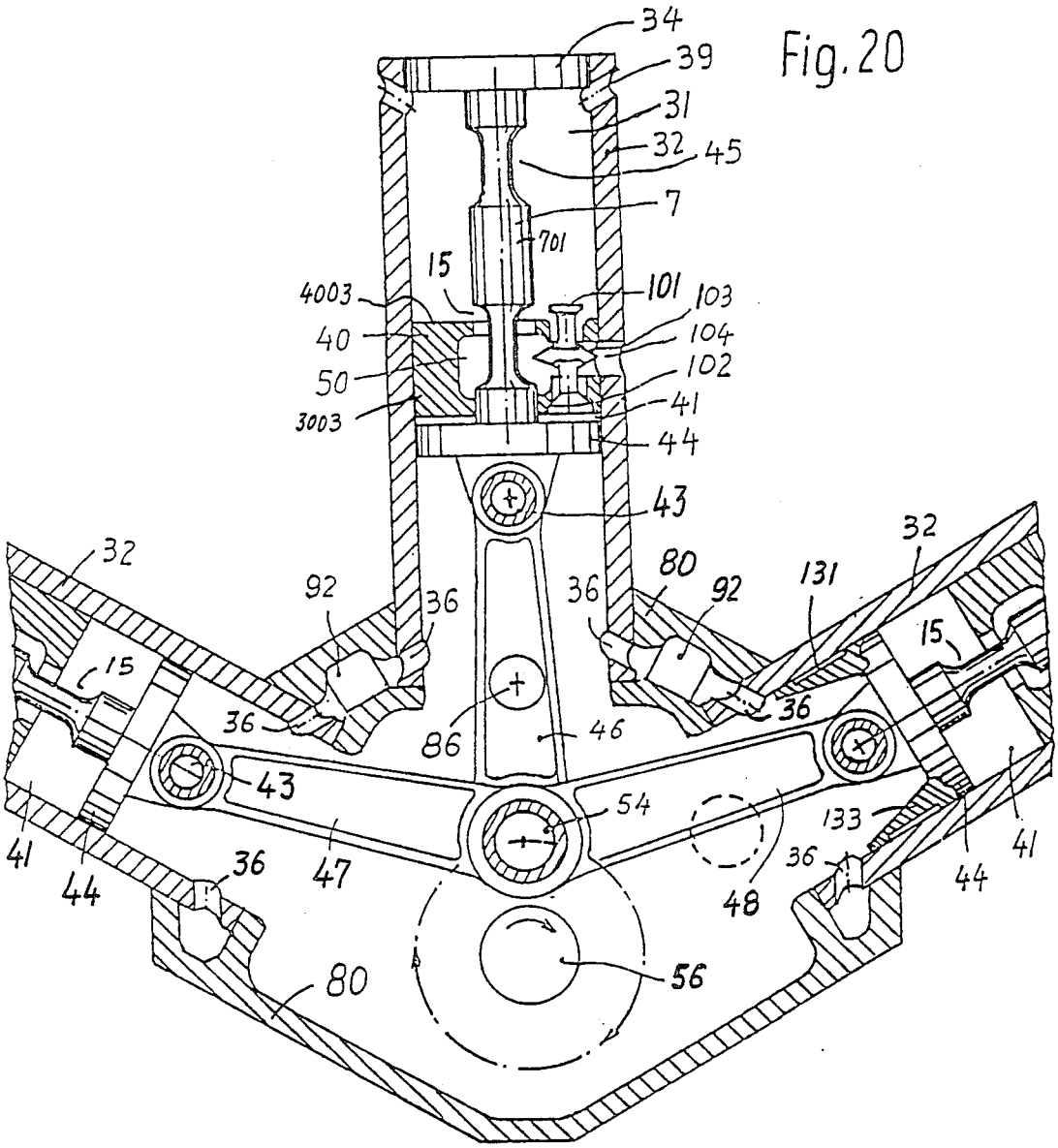
FIG. 20 is a sectional view through an engine.

FIG. 20 shows in a cross sectional view through the housing 80, which brings longitudinal sectional views through the cylinder and piston arrangements, a multiple double piston engine of the invention. The housing 80 bears in 56 a crankshaft with an eccentric bearing portion 54 which bears the conrods 46 to 48. The outer ends of the conrods connect to the double pistons at 43. This engine has 3 double cylinders 31 angularly spaced by 60 degrees. The engine might have any other number of double cylinders if they are respectively angularly spaced. Each cylinder 32 has two cylinder chambers 31 and 41 which are separated from each other by the medial inserts 40 through which the respective piston shaft(s) 7 extend. The piston shafts 7 bear on their axial ends the pistons 34 and 44 respectively. Instead of using this kind of double cylinders and pistons any other suitable arrangements may be applied, for example, those of FIGS. 14,15,31 32 or the like. The medial inserts 40 may have an internal control chamber 50 if the piston shafts 7 have the inlet flow control recesses 45. These control recesses communicate temporarly the inlet port 104 with a respective one of the working chambers 31 or 41. Air or air-fuel mixture under natural or supercharged pressure enters then from inlet port 104 over control recess and internal chamber 50 into the respective working chamber 31 or 41. An alternative assembly is the provision of inlet valves 101 and 102 in the insert 40. These valves may by connected by traction spring means 103 and the valve will be closed at the respective power strokes. The inlet flow of air or mixture flows then from port 104 through the respective opened inlet valve 101 or 102 into the respective working chamber 31 or 41. The exhaust ports 39 or 36 will be opened respectively when the respective piston 34 or 44 moves close to its outer dead point location. The cylinders may be mounted into seats in housing 80 and exhaust ports 36 may then lead the exhaust gases into an exhaust gas collection chamber 92 in housing 80. This engine requires only small space and is very powerful at little weight. Since the double piston engines are one cycle engines, it is not required to have cylinders and pistons on the bottom portion of the housing because the double pistons provide not only thrusting strokes but also tracting strokes to the crankshaft 56. It is convenient to set a cooling fan along the axis 86 because such single fan would then cool the housing as well as all six cylinders. The fan can be driven simply by chain, belt or gear from the crankshaft 86. Three cylinder two cycle engines were in the fifties in Europe called 3=6. This engine of FIG. 20 could then be called 3=12 because it would have 12 power strokes instead of 3 power strokes of a four cycle engine with 3 cylinders. The configuration of this engine permit to set the cylinders into the airstream on aircraft and vehicles while the housing would remain in the body of the vehicle.

FIG. 21 is the form of FIG. 9 with the engine of FIG. 10 calculated therein, however, in opposite direction. While FIG. 10 starts with compression ratio 1, FIG. 21 starts with compression ratio 100 which is better for the power stroke. The results of maximally obtainable strokes per minute are 1205 in FIG. 21 while they were 929 in FIG. 10. Thus, FIG. 21 may be more accurate than FIG. 10.

FIG. 22 shows a Stelzer engine in a 1:1 scale which could obtain the 30 000 strokes per minute, according to German language Literature. This is really a mini engine with very little power. It has Stelzers medial piston 12 with the pre compression chambers 28,29 about inlet 30. Inlet and exit valves 26,27 are shown to operate the outer cylinders 210 and 211 with their inlets 6.

FIG. 23 with cross sectional FIG. 24 illustrate that the engine of FIG. 22 is not the best solution for the supply of compressed air. The detailed calculation in the mentioned DE OS 32 31 718 show that the compression piston for the supply of compressed air should have a larger diameter than the engine piston 4. Consequently, FIG. 23 shows that the compressed air supply arrangement has a compressor piston 33 of a larger diameter than the diameter of the engine piston 4. The turbo 68 may be mounted after the exhaust to supply pre compressed air either into the inlet of the engine or also into the compressor chamber. In order to obtain the high number of strokes per unit of time the engine piston and compressor piston must be provided with a shaft 38 (or 38 and 37) to extend shaft 38 outwards from the cover of the engine to be connected there at 43 with a conrod 46 of a crankshaft 63 with a revolving mass 52. Crankshaft 56 may be borne in a bearing 35 in crank housing 42. By the provision of the crankshaft with the revolving mass the number of strokes of this engine can be multiplied compared to the free piston engine without the crankshaft.

Figure 25:
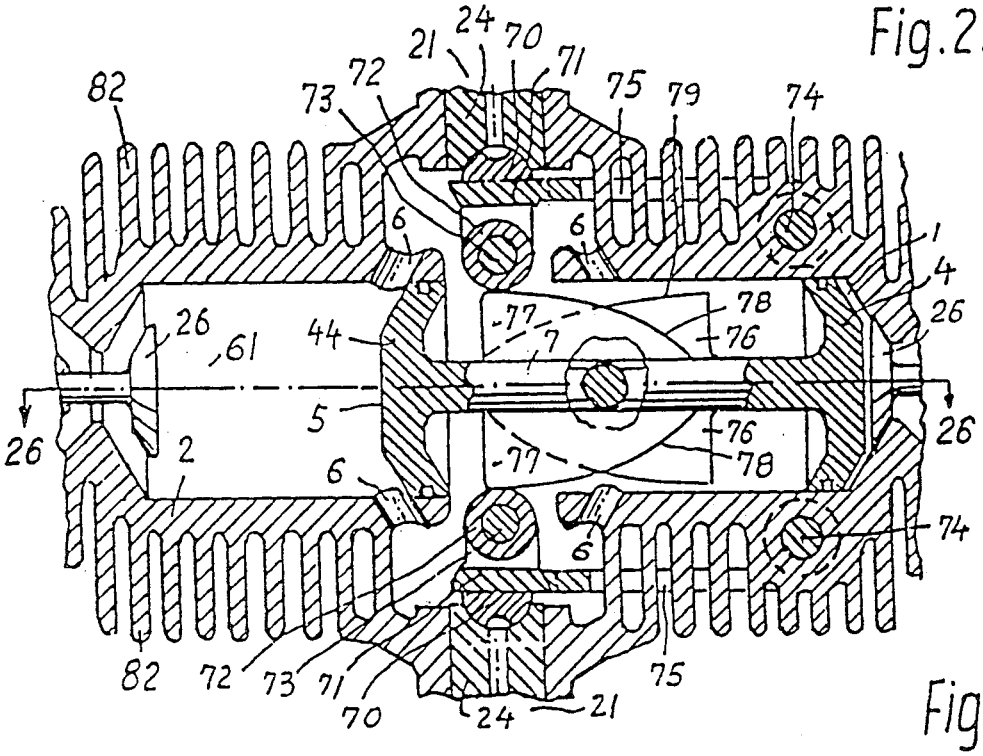
FIG. 25 is a longitudinal sectiona view through an engine.
Figure 26:
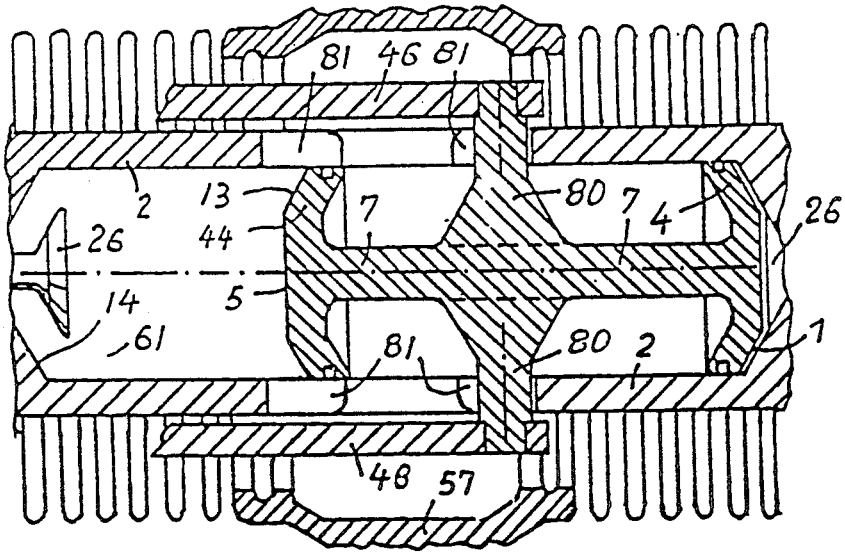
FIG. 26 is a sectional view through FIG. 25 along the arrowed line therein.

FIG. 25 shows a longitudinal sectional view through a hydrofluid conveying combustion angine of the invention. The parts thereof which are already known by their referential numbers from other Figures of this specification are eliminated from the description of this Figure. FIG. 26 is the cross sectional view through FIG. 25 taken along the arrowed line in FIG. 25 and FIG. 26 should be read together with FIG. 25. The cylinders have the inlet valves 26 of FIG. 32. The medial piston shaft 7 is provided with stroke cam portions 76,77 to drive with their stroke guide faces 79 the pistons 24 of the hydraulic pump over the rocker arms 71 the on their thrust faces sliding piston shoes 70 while the arms are borne by the cams over the rollers 72 on bars 73. The pump pistons 24 are thereby pressed into the hydrofluid cylinders 21 an let them be returned to the outgoing positions at the opposite strokes of the engine pistons and piston shaft. A further specific arrangement of these Figures is that slots 81 are provided through the housing or wall of the cylinders to permit the application of piston shaft arms 80 provided on the medial piston shaft 7 and to be extended radially outwardly through the mentioned slots 81. That permits the provision of bearing bars on the axial ends of the arms 80 to bear pivotably thereon respective conrods 46 or 48 for connection of the piston arrangement 7,4.44 with a respective crankshaft which is not shown in the Figures. A housing portion 57 may hold the cylinders 2 together. The connection of the piston arrangement to the revolving crank shaft again serves to make many strokes possible per unit of time and thereby to multiply the power of the engine compared to the free piston engines.

Figure 27:
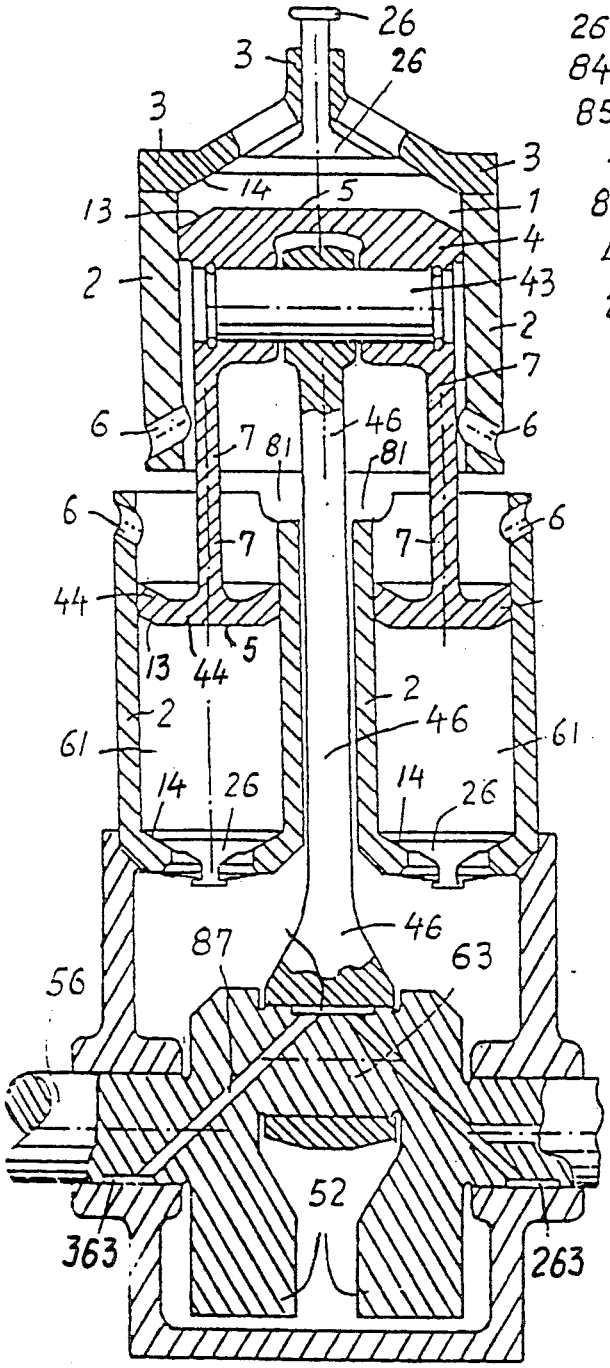
FIG. 27 is a longitudinal sectional view through an engine.
Figure 28:
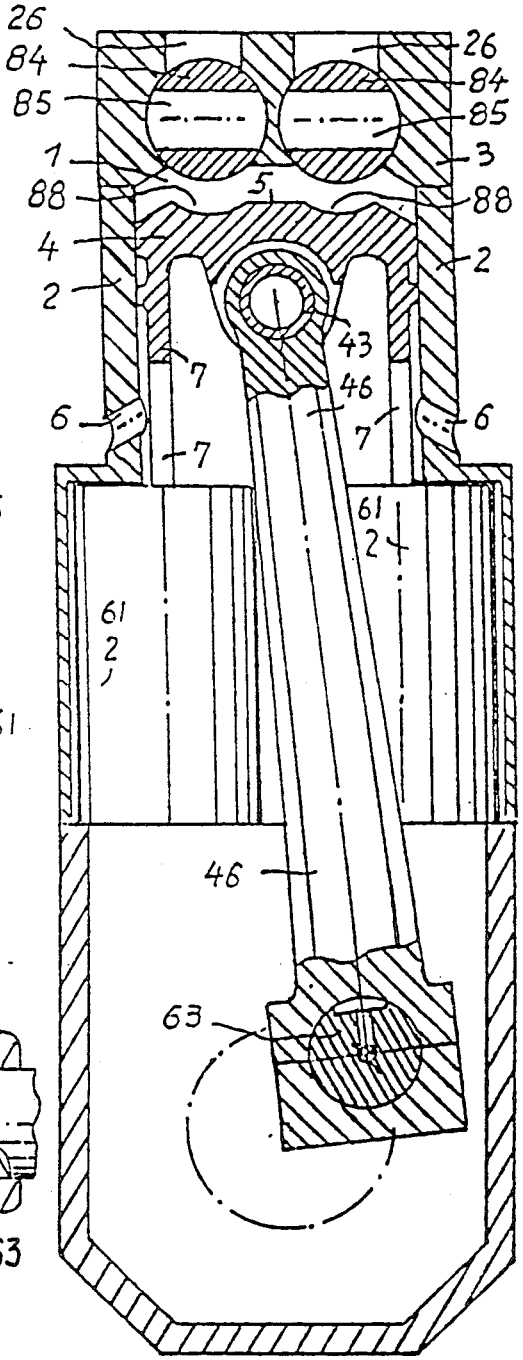
FIG. 28 is a sectional view through the medial face of FIG. 27.

FIGS. 27 and 28 show a modified engine of the invention. Crankshaft 56 revolves in the crank housing. Crankshaft 56 bears at 63 the conrod 46. As a novel arrangement of the invention the crankshaft is subjected to fluid pressure pockets from which passages 87 extend through crankshaft portions to communicate to a fluid pressure pocket in the eccentric portion 63 of the crankshaft. By this arrangement it becomes possible to lead fluid fluid under pressure from the outside through a housing portion into the crankshaft and bear the crankshaft and the conrods on fields of fluid in the mentioned fluid pressure pockets. Another novel arrangement of this Figure is, to set a plurality of smaller cylinders as the opposing cylinders to the one cylinder 2 with piston 4 therein. The sum of the cross sectional areas of the four opposing cylinders with pistons 44 therein is equal to the cross sectional area of piston 4. Seen are two opposing cylinders in the Figures. Instead of two, three or four such opposing cylinders may be used, whereby the sum of the cross sectional areas of the opposing cylinders and pistons should correspond to the cross sectional area of the one single piston 4. The Figures illustrate in details how the connection means and locations are provided in order to obtain this arrangement.

As a further novelty of the invention, FIGS. 27 and 28 show dead spaces preventing valves 84 and the thereto belonging complementary configuration of the top face(s) of the piston(s) 4. Piston 4 has on its top the valleys 88 of a configuration complementary to the outer diameters of the cylindrical bar valves 84. Valves 84 may be revolved or pivoted to open and close the the working chamber 1 by the passages 85 through valves 84. The radii of valleys 88 correspond to the radii of the outer faces of the valves 84.

Figure 30:
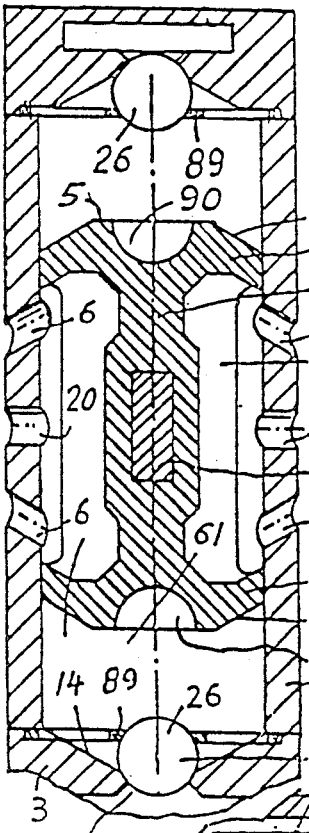
FIG. 30 is a sectional view through the medial face of FIG. 29.
Figure 29:
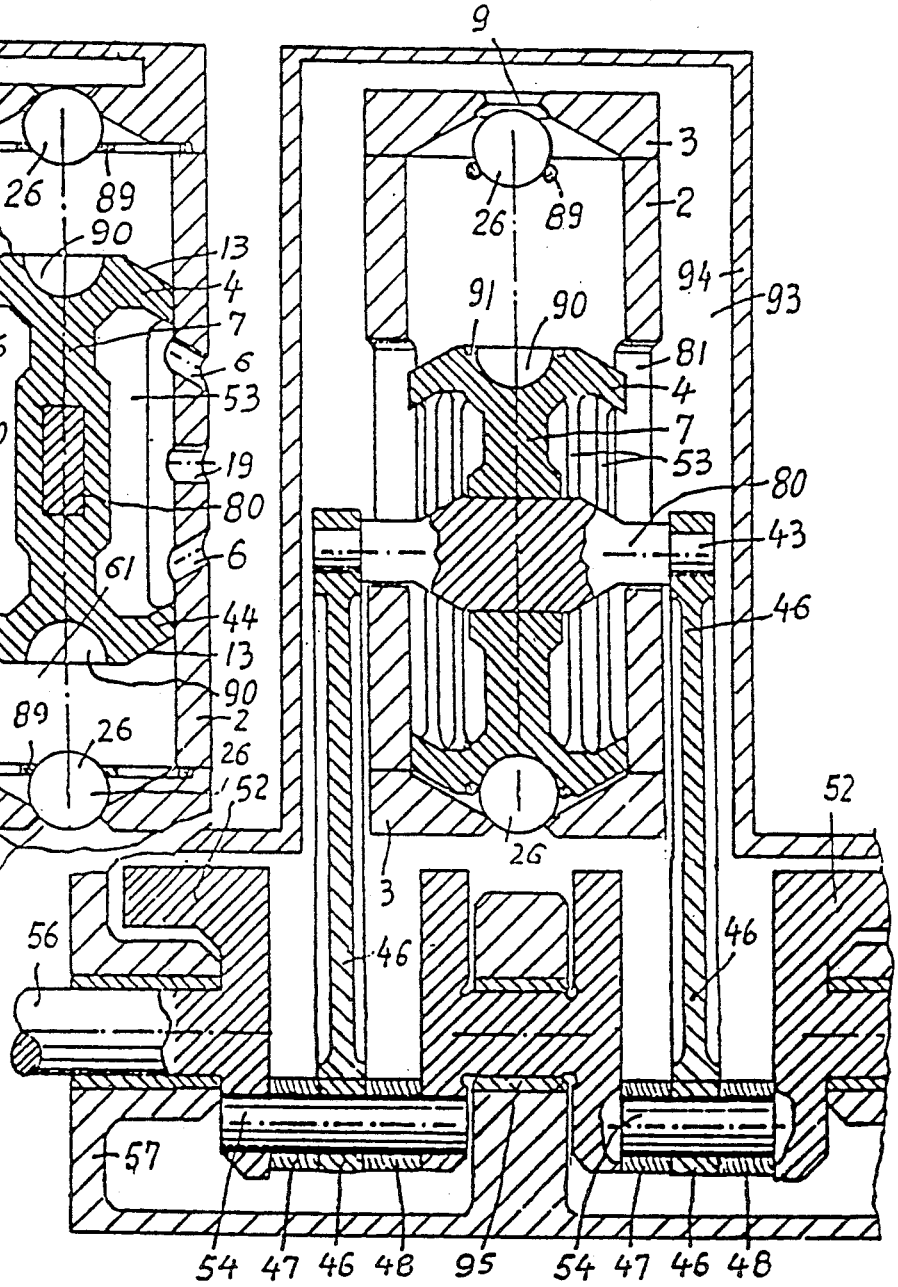
FIG. 29 is a longitudinal sectional view through an engine.

FIG. 29 shows in principle the engine of FIG. 26 with the slots 81, arms 80 and conrods 46. However, FIG. 29 includes a longitudinal sectional view through the crankshaft housing with the crankshaft 56 with the revolving masses 56 thereon. The Figure further includes a novel valve of the invention, namely the inlet valve 26 with a thereto belonging complementary configuration of the piston to reduce or eliminate dead space. The valve 26 is an inlet valve and is a ball which may be hold by a soft spring 89. To prevent dead space the piston head is provided with a valley of the form of a hollow ball with a radius which corresponds to the radius of the ball of valve 26. A groove 91 may be provided in the piston head to take in temporary the spring 89. The piston can now as in FIG. 28 move so close to the cover of the cylinder that it almost meets the bottom of the cover 3 and thereby eliminates or prevents dead space. The elimination of dead space in this and in other Figures of the specification is desired to obtain high compression ratios and thereby to operate the engines with great power and efficiency. FIG. 30 is a cross sectional view through the medial plane of the upper portion of FIG. 29. Both Figures illustrate that the arms 80 may be assembled to the piston shaft 7 by providing a recess through piston shaft 7 and extending arm(s) 80 therethrough.

FIG. 30 further shows the important princple that cool fluid inlet ports 19,20 may be provided in the medial portion of the wall of the cylinder(s) in order to lead cooling fluid into the space between the pistons 4,44 and around shaft 7, whereby, if the pressure in the cooling fluid is kept high enough, back flow of exhaust gases from the exhaust pipe or pipe to the turbocharger through outlet ports 6 into the space 5 between the pistons 4,44 and shaft 7 would be prevented.

Figure 31:
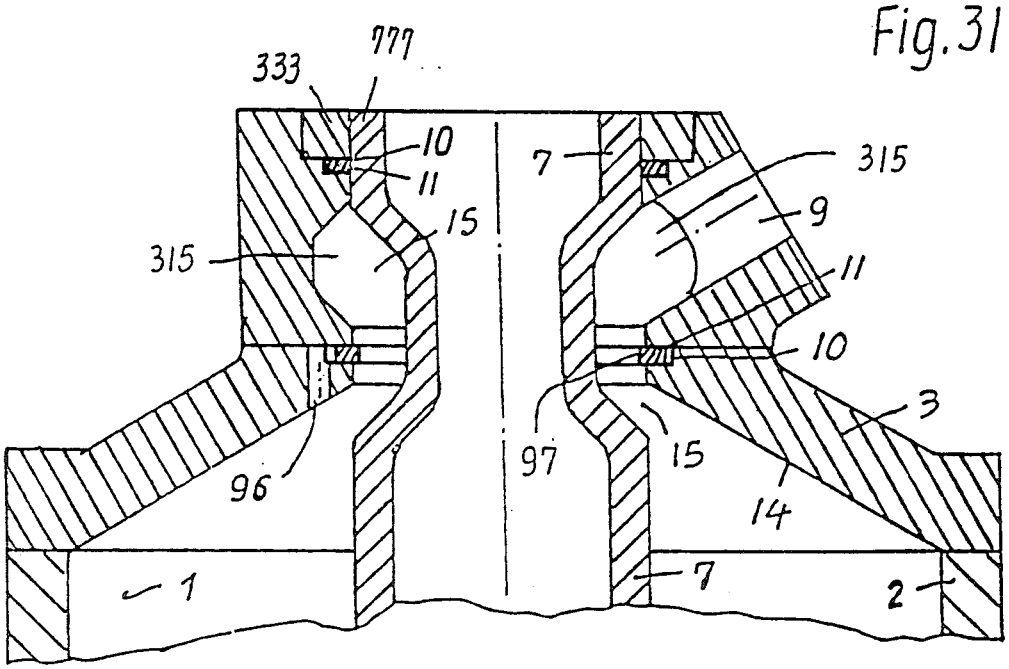
FIG. 31 is a longitudinal sectional view through a portion of an engine.

FIG. 31 shows an important modification of FIG. 14 of the invention. Instead of providing the piston ring in the piston shaft 7 as it was done in FIG. 14, the arrangement of FIG. 31 shows the provision of a radially inwardly thrusting piston ring 11 in piston ring groove 10 in the top of the cylinder. Piston ring 11 has an inner face 97 to fit and seal on the outer face of shaft 7 when shaft 7 meets the inner face 97. The feature of this arrangement is that the piston ring, which is not a piston ring any more but a seal ring, seals along the entire stroke of piston shaft 7 as long as not the control recess 15 moves through the seal ring 11. To make an easy assembly of the seal ring 11 possible and to make an accurate machining of the seal ring seat possible, the cover 3 may be axially divided into two sections as shown by the line therein. After the seal ring is inserted into its bed 10 the two portions are set together again. A second seal ring 11 may be provided in a second seal ring bed 10 in the axially outer portion of cover 3 to seal the outer portion of shaft 7 against leakage of gas or fluid axially outwards from inlet port and port ring groove 9.

Figure 32:
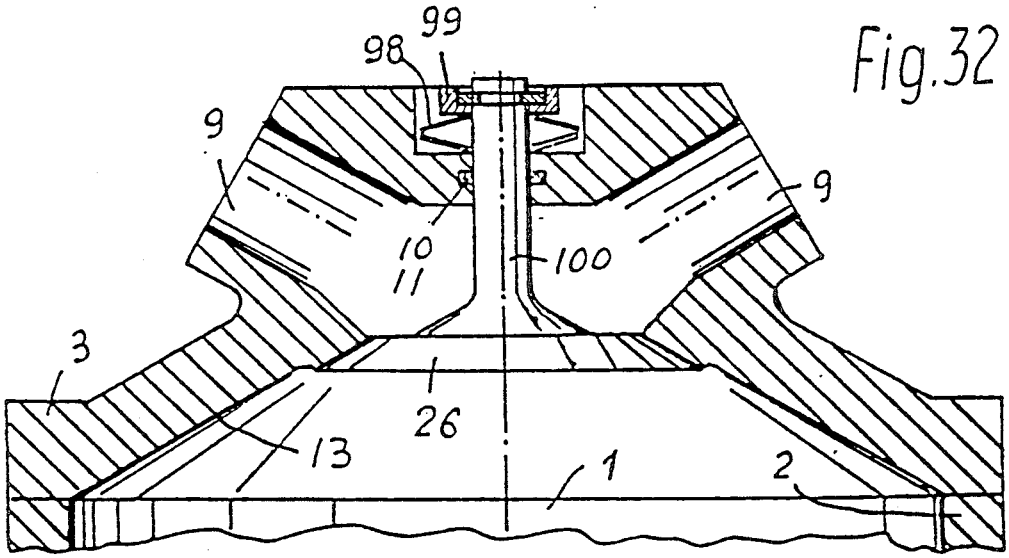
FIG. 32 is a sectional view through a portion of an engine.

FIG. 32 shows that instead of providing a piston shaft 7 with a control recess 15 it is also possible to eliminate the piston shaft 7 and replace it by a single concentricly located inlet valve 26 which may be slightly loaded by a holding spring arrangement 98.99. The shaft 100 of valve 26 may be sealed by a seal ring 11 in a bed 10. The tapered seat of valve 26 and the concentric location of the single inlet valve makes a large cross sectional area for the inflow of fluid or air into working chamber 1 (or 61) possible with an inexpensive and simple valve arrangement. The valve 26 is opened at the inlet stroke or location of the piston by the suction from pressure below inlet flow pressure in chamber 1,61 or by the loader pressure in the inlet port(s) 9 and the valve 26 is closed by the higher pressure in chamber 1,61 when the compression therein builds up. Thus, the valve of FIG. 32 is supposed to open and close automatically under the pressures before and behind it alternating with time. Instead of such an automatic operation a controlled forced opening and closing could also be provided on the axial outer end portion of the shaft 100 of the inlet valve 26.

Figure 33:
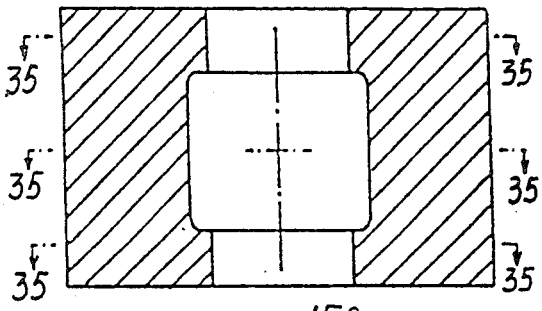
FIG. 33 is a sectional view through a portion of an engine.

FIGS. 33 to 36 illustrate a medial insert, for example, as such of FIG. 20, in a larger scale and in sectional views. The medial insert 40,140 is in these Figures preferred to be divided along line 150 of FIG. 36 in order to make the insertion into the cylinder 2,62 possible without dividing the pistons 1,61 with medial shaft 7. FIG. 33 would show the medial insert portion in a longitudinal sectional view along line 150 of FIG. 36 if the insert would not be radially divided allong line 150 into two equal symmetric portions.

Figure 34:
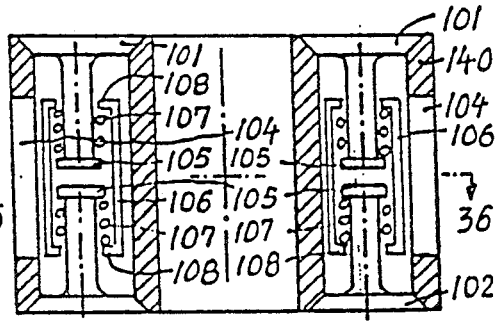
FIG. 34 is a sectional view through a portion of an engine.
Figure 35:
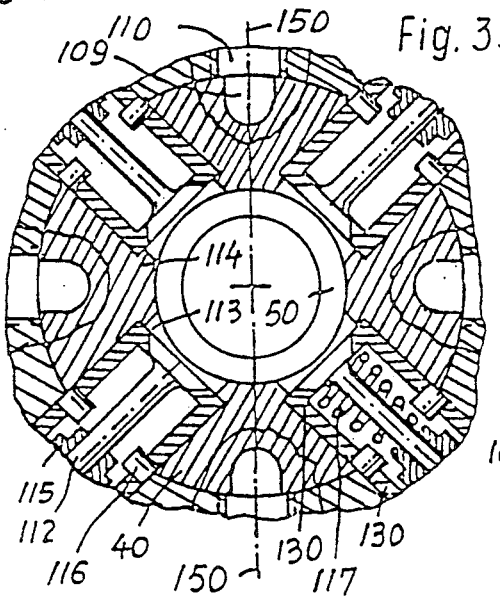
FIG. 35 is a sectional view along the arrowed lines 35—35 of FIG. 33.
Figure 36:
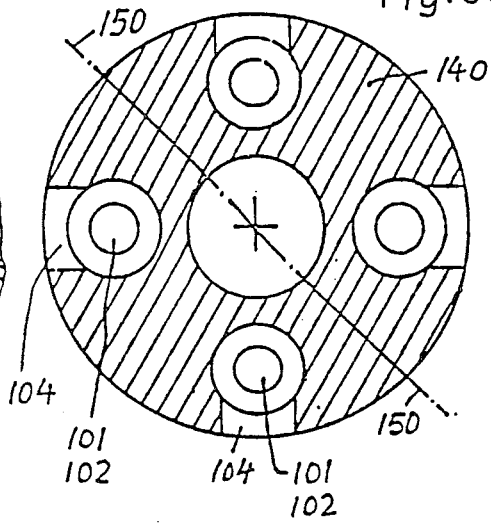
FIG. 36 is a sectional view through the medial face of FIG. 34.

FIG. 34 would be a sectional view along the horizontal medial plane of FIG. 36 or the sectional view through the medial plane of FIG. 33. FIGS. 35 and 36 are sectional views along the medial arrowed lines of FIGS. 33 or 34. FIGS. 34 and 35 show alternatives of valves which may be inserted into the medial insert 40 or 140. FIG. 33 shows the longitudinal sectional neutral view of the insert 40 without any assembly of valves and needs no further description. FIG. 34 illustrates in a larger scale the valves 101 and 102 and their assessories of FIG. 20. These are already described in principle at the description of FIG. 20. FIG. 34, therefore, merely illustrates an alternative to the spring means of FIG. 20. Thus, valves 101 and 103 have valve shafts with end holders 105. Springs 107 are assembled around portions of the shafts of valves 101 and 102. A springs holding housing 106 surrounds the springs and is provided with outer bords 108 to hold thereon the outer ends of the springs 107. The assembly may be done to axially passages or inlets 104. In the alternative of FIG. 35 the inlet valves 112 are radially arranged. To make their assembly convenient, the tapered valve seats 113 seat in valve housing 130 and are able to open and close the tapered seat 113. Springs 117 are at one end borne on bords on the spring housings 130 and at the other axial ends on the holder portions 115 which are provided on the shafts 112 of the valves. Stoppers 116 should be provided, if necessary to prevent an inwards movement of the valve heads beyond the internal space 50 of the medial insert 40 which may have bords 140 to prevent an inwards movement of the valve housings 130. Ignition spaces 109 may be provided in insert 40 and ignition plugs may be bolted into the threads 110 of the cylinder's wall 2,62.

Figure 37:
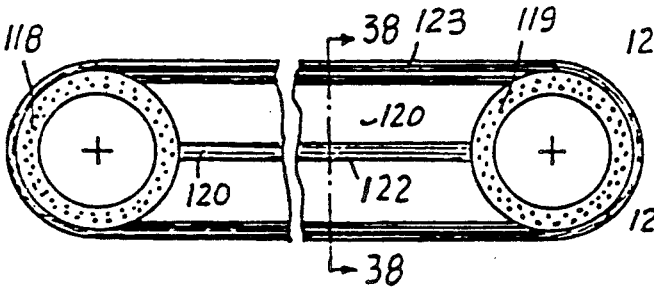
FIG. 37 is a sectional view through a conrod.
Figure 38:
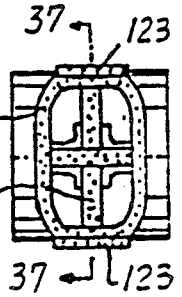
FIG. 38 is a sectional view through the medial face of FIG. 37.

Since the analysis of the engine disclosed that the weights of the reciprocating parts should be as low as possible, FIGS. 37 and 38 illustrate a conrod (pluel, connecting rod) of little weight which can also be used in other, for example, in common engines. It is made of FRP, for example, of carbon fiber. It has two cylindrical and portions 118 and 119. A distance bar of a cross sectional configuration of a cross also made by carbon fiber, namely portion 120,122 of a cross sectional configuration of a cross is inserted between the two cylindrical end portions 118 and 119. A holding layer, also of FRP or carbon fiber is then led around the periphery of the assembly as shown by referential number 123. The carbon fiber cloth is glued with epoxy resin or other suitable glue and after drying the assembly gives a reliable conrod of a weight many times smaller than a conrod of steel. This conrod is also easily produced because the carbon fiber will not require expensive machining.

FIG. 39 shows the calculation table for the calculation of the pressure value " P " as an addition to FIG. 10 and it also shows the values obtained in the table in a diagram.

Figure 41:
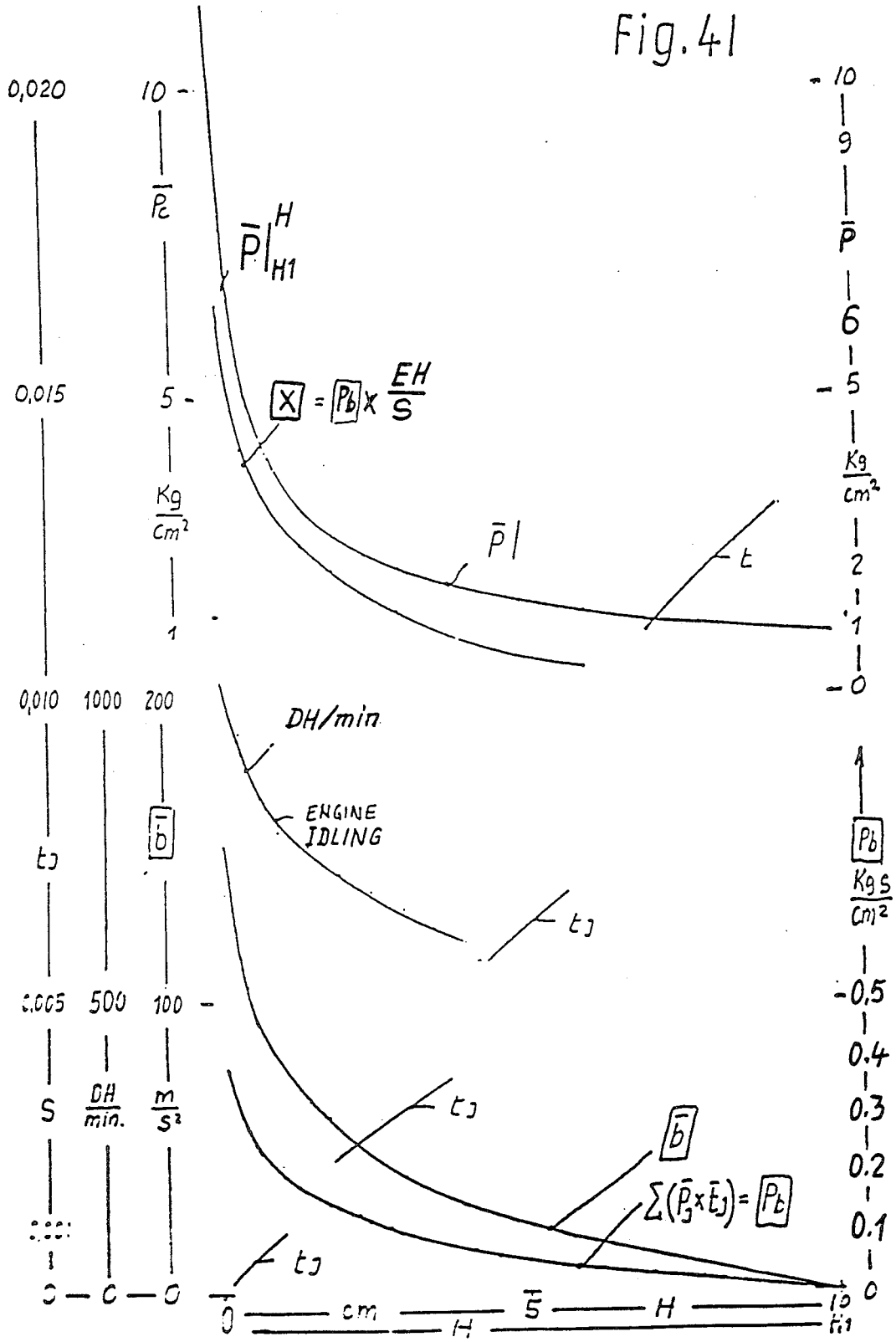
FIG. 41 shows a diagram.
Figure 42:
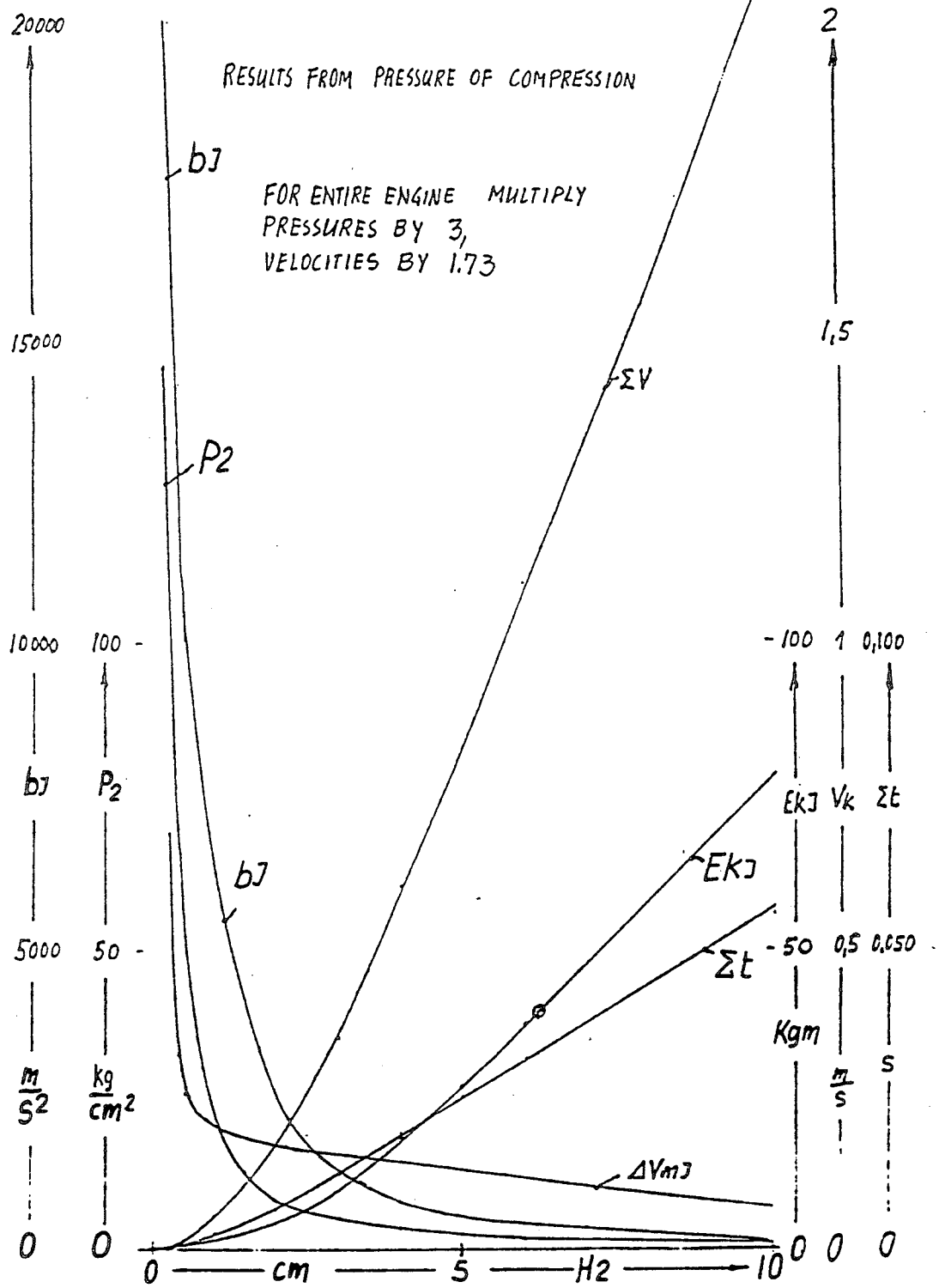
FIG. 42 shows a diagram.
Figure 43:
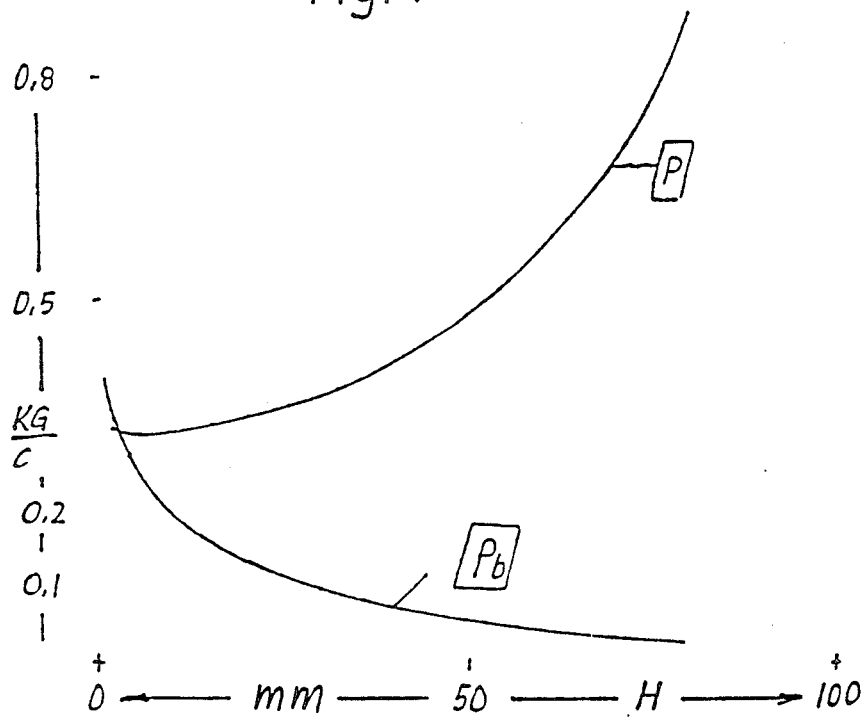
FIG. 43 shows a diagram.

FIG. 40 shows the calculation table for the calculation of the pressure " P " and of the pressure " P ". The purpose of this table and of the calculation is in details described in my mentioned German DE OS 31 32 718. FIGS. 41 and 42 show in diagrams the results of calculations by the analysis of the engine. FIG. 43 compares in a diagram the values of " P " and of " P ".

Figure 44:
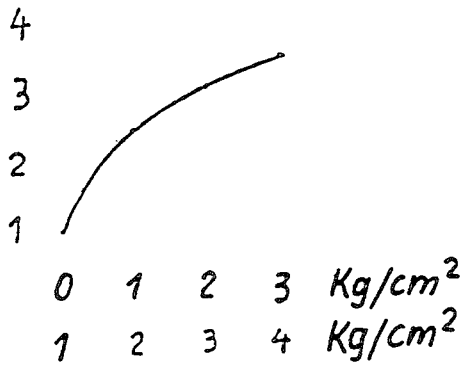
FIG. 44 shows a diagram.

FIG. 44 shows in a diagram the increase factor of the power of the engine at different pressures of supercharging or pre loading of the ingoing air or mixture.

FIGS. 45 to 50 deal with improvements of free piston engines by the invention. FIG. 93 adds a further improvement and will be discussed already now at the discussion of FIGS. 45 to 52. Free piston engines, which serve as hydrofluid conveying combustion engines, are known for example from my U.S. Pat. Nos. 3,260,213 and 3,269,321. Free piston engines are also known for example from the West German patent application publications 1,451,662 and 3,029,287. The last mentioned publication provides a medial piston in a medial chamber between two pistons on yhe axial ends. The medial piston and chamber provide the suction and pre-compression of fresh air which is then flashed or pressed into the working cylinders on the axial locations of the engine. The medial, piston has a heavy weight, which has a heavy mass and which prevents high frequencies of reciprocation because the heavy mass of the medial piston can be stopped at high masses and kinetical energies only with difficulties. The pistons of the last mentioned publications thereby tend to run against the cylinder heads at high frequencies of reciprocation. That limits the frequencies of reciprocation per unit of time and thereby limits the power of the engine. The object and aim of the embodiment of the invention of the now discussed Figures is, therefore, to overcome the difficulty of the known former art and to provide a free piston engine with a capability of high frequencies per unit of time. A further aim of these Figures is, to improve the hydrofluid conveying combustion engine of my former art to a better uniformity of flow and reliability of operation.

Figure 45:
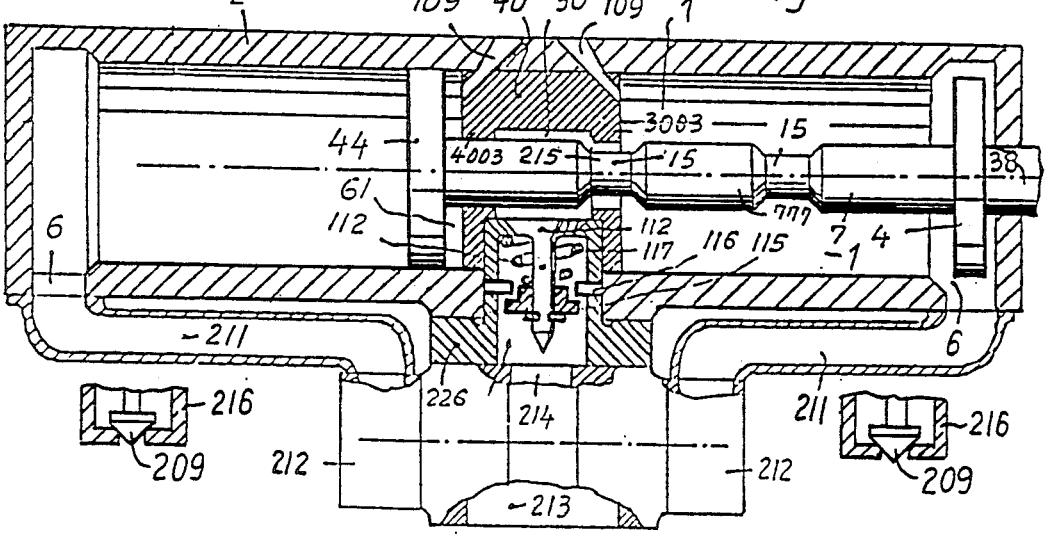
FIG. 45 is a sectional arrangement through an engine.
Figure 46:
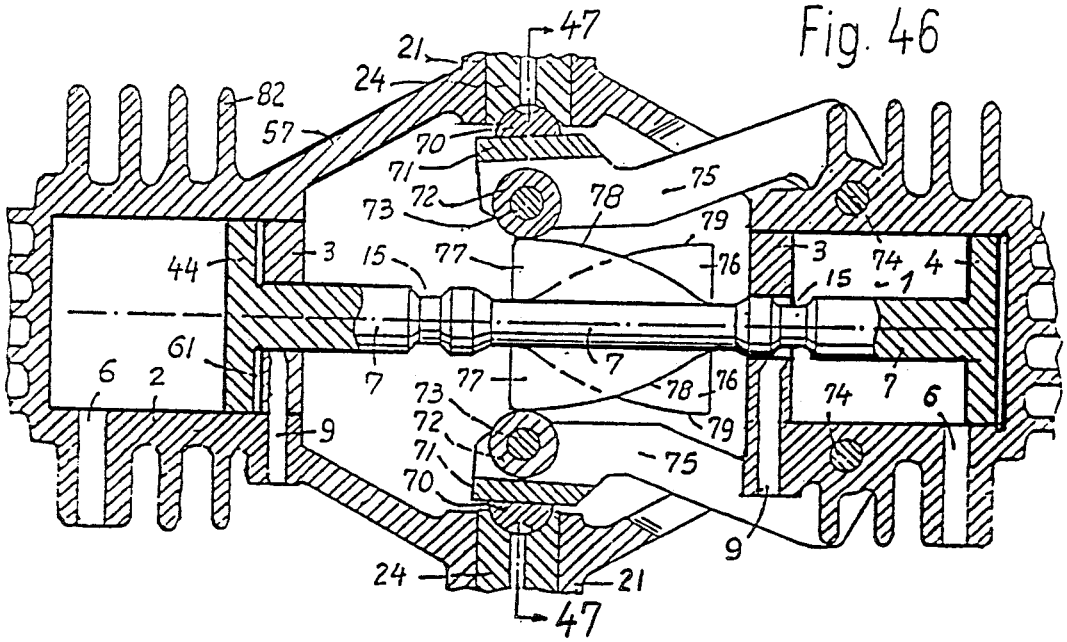
FIG. 46 is a sectional view through the medial face of FIG. 45.

FIGS. 45 and 46 therefore show a cylinder housing 1 which may have an equal inner diameter over the entire length in order to make a simple inexpensive machining or honing possible. In the medial portion of cylinder 1 a control body 15 is mounted, which surrounds a piston shaft 3. Piston shaft 3 connects the first end piston 2 with the second end piston 3. Pistons 2 and 4 as well as the medial control body 15 fit in the inner face of cylinder 1, where medial body 15 is fixed, while the pistons 2 and 4 reciprocate with piston shaft 3 between them in the cylinder housing 1. Thereby the cylinders 27 and 29 are formed endwards of the medial portion 15. Cylinder 29 between 15 and 2, while cylinder 27 is formed between 15 and 4. These cylinders 27 and 29 alternatingly increase and decrease their volumes when the piston 2,3,4 reciprocates in cylinder housing 1. Endwards of the straight inner face of cylinder wall 1 there are widened passages or annular grooves 29 provided between the sealing face of cylinder wall 1 and the end covers 8 of cylinder wall 1. Passages 29 are extending from the recesses 29 by passages 11 to form the exhaust passages 11. The piston shaft 3 is provided with a first control recess 5 and a second control recess 6. The medial control body 15 has the bore wherethrough the shaft 3 fittingly extends and this bore is surrounded medially of member 15 by a radially outwardly extending recess 18. The cylinder wall 1 is radially of the oitcut or recess 18 provided with an entrance passages 25, wherein a one way inlet valve 19 is mounted. Valve 19 opens in the direction towards the medial recess 18 and closes into its seat on inlet housing 26 in the opposite direction. A spring 20 may hold the valve 19 in closed position as long as it is not opened by pressure in the entrance housing 26. A stopper arrangement 22,24,21 should be provided to prevent a running of valve head of valve 19 against the medial piston shaft 3. The cylinder 1 and, or medial control body 15 is, are, further provided with either ignition means or injection means 16,17 or ignition and injection means 16,17. These means extend to the respective cylinders 27 or 29 respectively. It is in accordance with the invention preferred, to mount a turbo charger 12 and connect its exhaust gas entrance ports to exhaust passages 11. The compressor stage of the turbo is driven by the exhaust gases of passages 11 and drive the compressor stage of the turbo which takes in fresh air through entrance 13 and delivers slightly compressed air, turbo-charged air through charger outlet 14 into the entrance passage 25 in entrance housing 26 and thereby against the bottom of the one way valve 19 to open it, if it gives way.

The engine of this Figure may operate as follows: At the position of the piston 2,3,4 as shown in FIG. 45, compressed air or mixture is present in cylinder 29. The fuel is now injected through injector 16, if only air is in cylinder 29. But if mixture is compressed in cylinder 29, the referential 16 will be an ignition means. In both cases the air and fuel in cylinder 29 will now ignite and the gas will burn and expand, whereby the piston 2,3,4 is forced leftward. Thereby the piston portion 4 closes recess 29 on the right side of the Figure and starts to compress air or mixture of air and fuel in cylinder 27. After the expansion stroke towards the left end is completed, the left piston portion 2 gives the recess 29 free to communication with cylinder 29. The expanded and used gas, which has giben power at the leftward stroke flows into exhaust passage 11 on the left side of FIG. 45 and thereby into the turbine stage of the turbo charger 12 to drive therein the compressor stage for the supply of prepressure charged air or air-fuel mixture. At the time, when the piston 2,3,4 was the position as shown in FIG. 45, the medial recess 18 was over the first shaft recess 5 in communication with the cylinder 27. Cylinder 27 was thereby cleaned from burned gases and flashed through with fresh air and filled with fresh air. This fresh air or air fuel mixture was compressed at the movement of the piston 2,3,4 to the most leftward position. There the second annular recess or recess 6 communicated the chamber or recess 18 with the left cylinder 29 while the fitting of shaft 3 in the medial bore in part 15 prevented communication of recess 18 with cylinder 27. At this time the recess 18, which receives pre-pressed air or mixture from entrance 25 over the then open valve 19, passes the fresh air or mixture over the second control passage 6 into cylinder 29 to flush the exhaust gas out thereof and to fill the cylinder 29 with fresh air or mixture. Thereafter the fuel in air in cylinder 27 which is now highly compressed, becomes ignited similar as that in cylinder 29 was ignited earlier and the now burning and expanding gases in cylinder 27 now drove the piston 2,3,4 rightwards and into the final rightmost position, which is shown in FIG. 45. Thereafter the double cycle, which was described, starts again.

During the axial movement of the piston shaft 3 both recesses 5 and 6 move at every axial full one stroke through the medial chamber 28 in medial control and cylinders separating body 15. That would lead to a backflow of a fluid stream from each cylinder one after the other, when the respective control recess 5 or 6 would communicate the passage 25 over recess 18 with the cylinder 27 or 29 when such cylinder has still a higher pressure than is present in entrance passage 25. Such backflow would happen once at every stroke of one direction of shaft 3 between piston portions 2 and 4. Since such back flow would disturb the effective operation of the engine, which the invention clearly discovers, the invention also takes care to prevent such a back flow out of cylinder 27 or 29. It does it by the insertion of the very important one way valve 19 into the entrance passage 25 and thereby between entrance passage 25 in housing 26 and the medial chamber or recess 18 in the medial body 15. It is convenient to mount the one way valve 19 into an entrance housing 26 as shown in the Figure, but otherwise it could also be mounted into the medial body 15. For assembly of the engine, either at least one of the pistons 2 or 4 is made separable and mountable onto shaft 3 or the medial body 15 is divided into two halves which are sealing together on each other when they are radilly inwardly moved to meet at shaft 3 and then moved radially into the inner face of cylinder wall 1 which then holds the two piece medial body 15 together and under seal. When the entrance housing 26 is inserted as shown into an outcut in a portion of the medial body 15, the medial body 15 is thereby also fastened axially in place. Inlet valves 9 may be set into seats 16 communicated to passages 11 to draw in air at times when there is no exhaust gas under pressure in the respective exhaust passage 11.

The replacement of the pre-compression medial piston portion of the publication of the former art by the straight shaft 3 and the medial body 15 with chamber 18 and the one way inlet valve 19 has very drastically reduced the weight of the reciprocating piston and thereby made it possible to run the engine with much higher frequencies of reciprocal movements then the engine of the mentioned former art could do it. At the same time the engine is very much simplified and made inexpensive and easy to be produced. A single straight through pipe can now be used as a cylinder for the engine and contain both cylinder chambers 27 and 29 as well as the medial arrangement 15,18,19. The shaft 3 with piston portions 2 and 4 can easily be machined and grinded for accurate fit. With these improbements the engine has also very considerably reduced its overall weight, whereby the aim to use it in aircraft and other vehicles is practically fully ontained. Piston set 2,3,4 may on one or both ends be provided with an outgoing shaft 7 if so desired.

FIG. 46 with the thereto belonging cross sectional FIG. 47 improves my earlier hydrofluid conveying combustion engine of my mentioned older US patents. The engine of these Figures is similar to that of FIG. 46. However, the shaft 3 is made longer, the medial assembly 15 is replaces by two closing covers 115 and 215 and a cam drive assembly 40,43 is set onto the medial portion of shaft 3. Cam plates 40 and 43 are provided with radial outer faces 41 or 44 respectively. See hereto also FIG. 47, which shows that each cam 40 or 43 consists of a pair of two cams which are diametrically and oppositionally directed and located. Instead of providing 4 cams as in FIG. 47, it would also be possible to provide thre or four cams pairs, which would result in 6 or 8 cams 40,43 etc., The cylinder housings around cylinders 27 and 29 are connected to a medial engine housing 42, which bears the cylinders 38,138 etc of hydraulic pumps. The cylinders may have axes which are normal to the longitudinal axis through piston 2,3,4. Pistons 39,139 are able to reciprocate in the mentioned pump cylinders 38,138 and they may be provided with pivotable piston shoes 37 to be borne on bearing planes of partially plane bodies 36. Planes 36 may be the ends of arms 32, which are pivotably bearable by pins 31 in the walls of the cylinders 27 and 29. They may extend through outcuts 33 in medial housing 42. The arms 32 are or may be also provided with senser rollers or slides 34, for example with rollers 34 bearable in shafts or pins 35. The pressure or pre pressure in the pump cylinders 38,238,138 and 338—see also FIG. 47—presses the pistons 39, 139, 239,339—see again also FIG. 47—against the piston shoes 37 and the piston shoes 37 into engagement on the plane faces of partially plane bodies 36, while thereby the inner ends of the arms 32 are pressed towards the cams 40,43 etc. with their sensere 34,35 to run along or be pressed against the cam faces 41 or 44. When now the piston 2,3,4 moves leftward in FIG. 46, the pump pisyons 39,139 move outwards in cylinders 38,138 and thereby towards the shaft 3 because the configuration of the cam faces 41 of ams 40 permit now this movement because the cam faces 41 now reduce the distances from the axis of shaft 3. At the same time, however, the cam faces 44 of cam 43 press the pistons 239 and 339 away from the axis of piston 2,3,4 and thereby inwardly in and into their pump cylinders 338 and 238.

FIG. 48 shows a portion of FIG. 46 seen from the side, whereby the left cylinder is seen from the outside and with its cooling ribs 30 and its holding levers or pins 31 which pivotable bear the pivot arms 32.

FIG. 48 shows the further important improvement over my older mentioned patents, that it overcomes the ununiformity and partial uneffectiveness of my former patents by providing properly configurated cam faces 44 etc.

The hydrofluid conveying combustion engines of my mentioned earlier US patents never obtained their full possible efficiency, because it was desired to make the powers of engine piston and pump piston equal, but it was never found or disclosed how they could be made equal. The present invention now provides the possibility of making them equal by defining measures "S", "H", and angle "$\theta$" of the cam and cam face 43 and 44. For the dead space less engine the cam faces 44 shall now correspond substantially to the equaitions of FIG. 50.

FIG. 50 brings the following important equations:

$$S = K1 \cdot K2 \cdot \sqrt[\kappa]{(P1/P2)H1^{\kappa}} \quad \text{(A-01)}$$

and:

$$\theta = K1 \cdot K2P1H1^{\kappa}(-\kappa H2^{(-\kappa-1)}) \quad \text{(A-02)}$$

By these equations the cams and cam faces 43 and 44 as well as the other cam faces can be made to maintain a power equilibrium between the engine piston 2,3,4 and the hydraulic fluid or pneumatic fluid or gas pumping pistons 38,138,238 and—or 338 and—or more or some of them. In the equations above the following values apply:

$\theta$=local angle of cam face respective to axis of shaft 3;
$\kappa$=polytropic or adiabatic exp nent of gas or air;
K1=the constant deriving from the design;
K2=the second constant caoming the from design relation;
P1=intake or atmosphereic pressure;
P2=pressure in combustion or compression cylinder.
H0=zero stroke of piston 2,3,4
H2=actual stroke of piston 2,3,4 according to FIG. 50.

When these equations and values are followed, the engine and pump will work according to the invention and will thereby work with good efficiency and power.

FIG. 49 shows the arms 32—they are double arms laterally of plane face body 36 and holder 45 on the cylinder—in a view along the arrow above FIG. 50 from above. There is nothing special in this Figure, but it shows in the view, what FIG. 50 could not show on the plane sheet of the paper.

Figure 51:
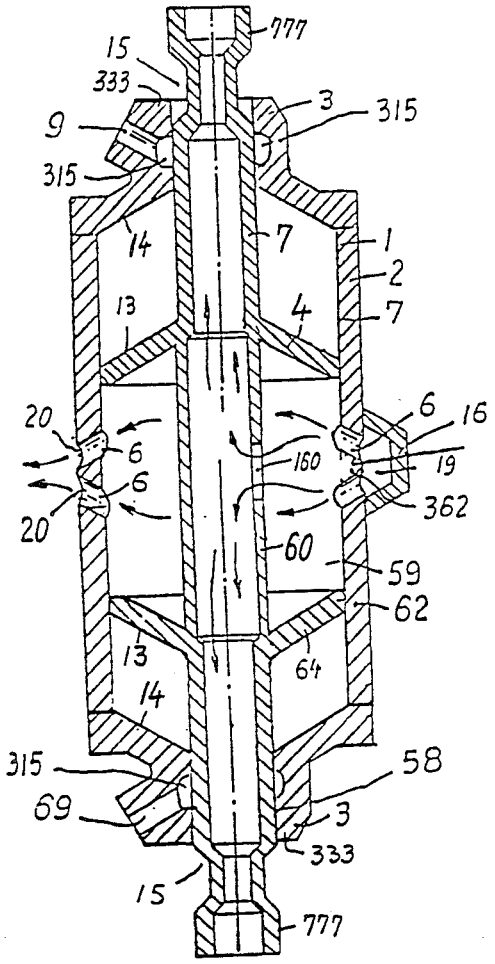
FIG. 51 is a longitudinal sectional view through an engine.

FIG. 51 corresponds in principle to FIG. 15. However, FIG. 51 shows the improvement or alternative that a cooling fluid supply chamber 19 is provided which blows cooling fluid through ports 6 into medial chamber 59 between pistons 4 and 64. This cool fluid is then partially led through passge 160 into the hollow piston shafts 60 and through shafts 7 and partially out of space 59 through exit ports 20. It is also possible to send all cooling fluid through the shafts 60,7 or all cooling fluid out of chamber 59 through outlets 20.

Figure 52:
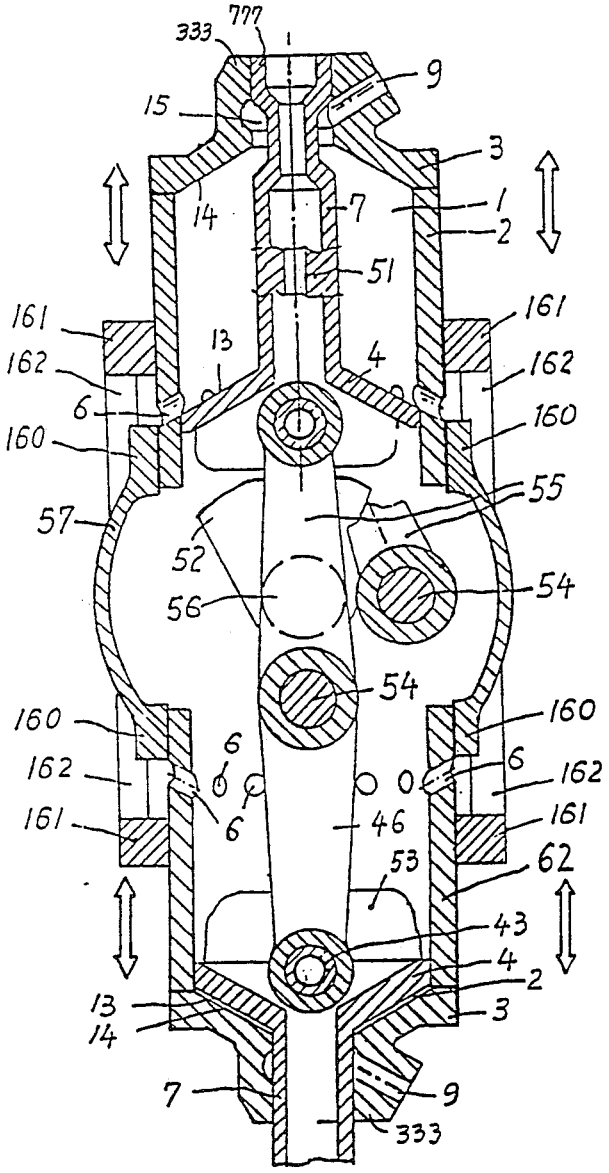
FIG. 52 is a longitudinal sectional view through an engine.

FIG. 52 is a longitudinal sectional view through a double piston engine with variable pressure ratio. Instead of providing this embodiment of the invention to double piston engines it could also be applied to single piston engines with a single piston in the respective cylinder 2 or 62. The application to a single cylinder is, however, not shown in this Figure because it is easily understood to do so by eliminating the bottom portion or the top portion of the Figure. The principle of this embodiment of the invention is, thereby, applicable also to common combustion engines or engines, devices, pumps or motors of the known art with a reciprocating piston in a given cylinder.

Crankshaft housing 57 is provided with a cylinder guide or cylinder guides 160 wherein the respective cylinder 2,62 is axially moveable along its longitudinal axis. A compression ratio adjustment housing 161 is provided to the engine. It forms a space or slot 161 wherein the crankshaft housing 57 is provided. Adjustment controllers can be provided to the adjustment housing portions 161 to move them axially towards each other or away from each other in the direction of the arrows in the Figure. The portions 161 keep axially the respective cylinder 2 or 62. By moving the adjustment holders 161 axially, the respective cylinders 2 and/or 62 are also moved axially along the arrows in the Figure. Thereby the compression ratio is varied because the distance between the pistons 4,64 and the covers 3,63 varies, whereby the compression ratio is varied in accordancee with the definitions of FIGS. 3 and 5. The other parts of the engine of this Figure are known from FIG. 17.

Figure 53:
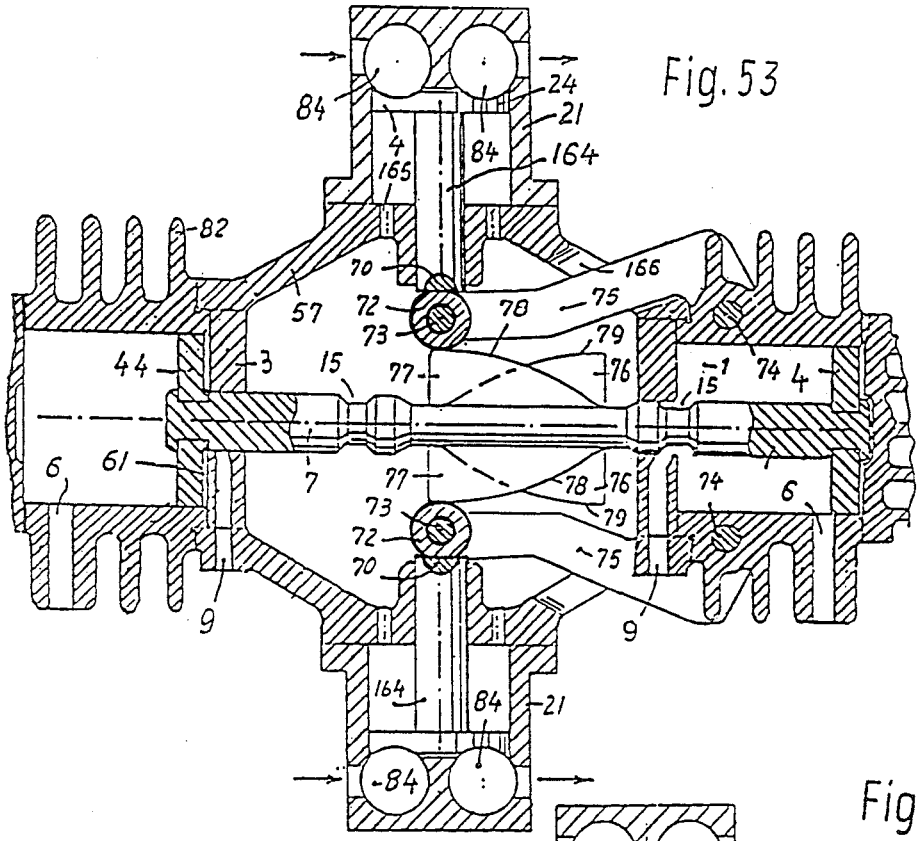
FIG. 53 is a longitudinal sectional view through an engine.

FIG. 53 corresponds in principle to FIG. 46. However, instead of a hydraulic piston a gas pressure supplying piston 4 with shaft 164 is provided in the fluid flow creating cylinder 21. Pluralities of such pistons and cylinders are commonly provided and two of them, opposingly directed, are shown in the Figure. Inlet valves 84 are provided and the pistons have respective configurations of the head faces as described at hand of FIG. 28. Passages 165 are provided to prevent varying pressures below in cylinders 21. The piston shoes 70 are inserted into shafts 164 instead of into hydraulic fluid pressure pistons as in the other respective Figures. The embodiment of FIG. 53 of the invention is very convenient as a compressed air providing engine. It is of little weight and inexpensive in production. The diameters of the cylinders 21 and of the pistons therein make different ranges of air pressure possible.

Figure 54:
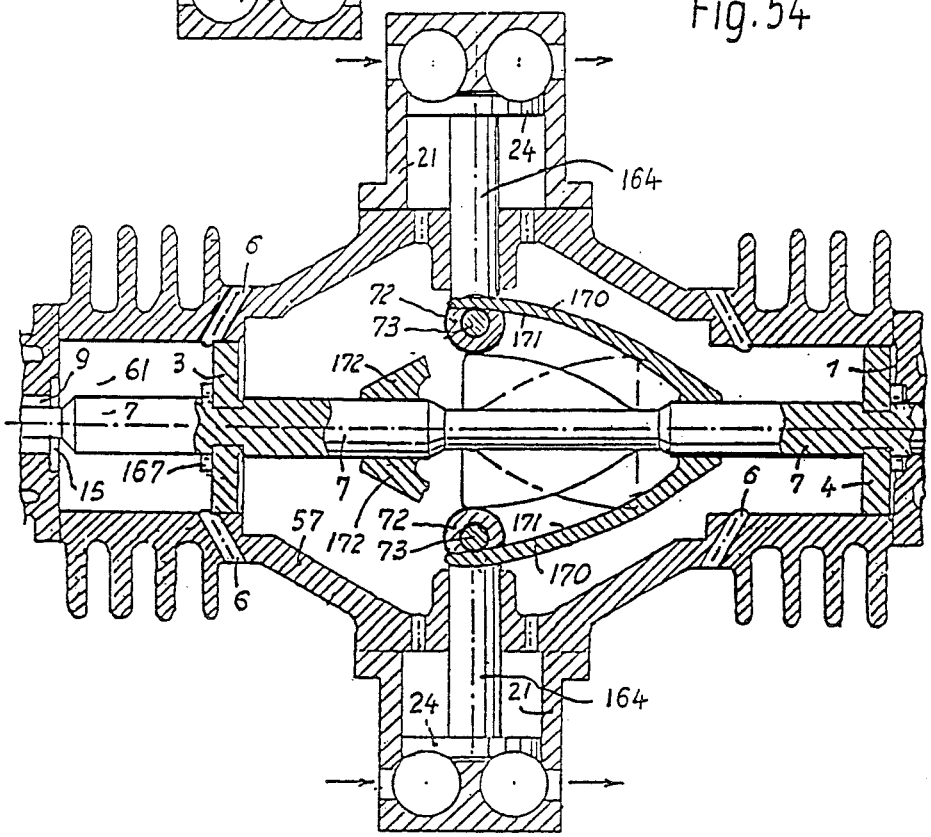
FIG. 54 is a longitudinal sectional view through an engine.

FIG. 54 corresponds in principle to FIG. 53. However, piston shafts 164 retracting guide rails 170 with guide faces 171 which guide the bars 73 of the rollers 72 in the retraction stroke. Thereby the pistons in cylinders 21 are forced inwardly and obtain the ability to suck fluid into the working chambers in the fluid flows producing cylinders 21. Oppositionally acting guide rails 172 may be provided on engine shaft 7 if they are angularly spaced from the guide rails 170.

Figure 55:
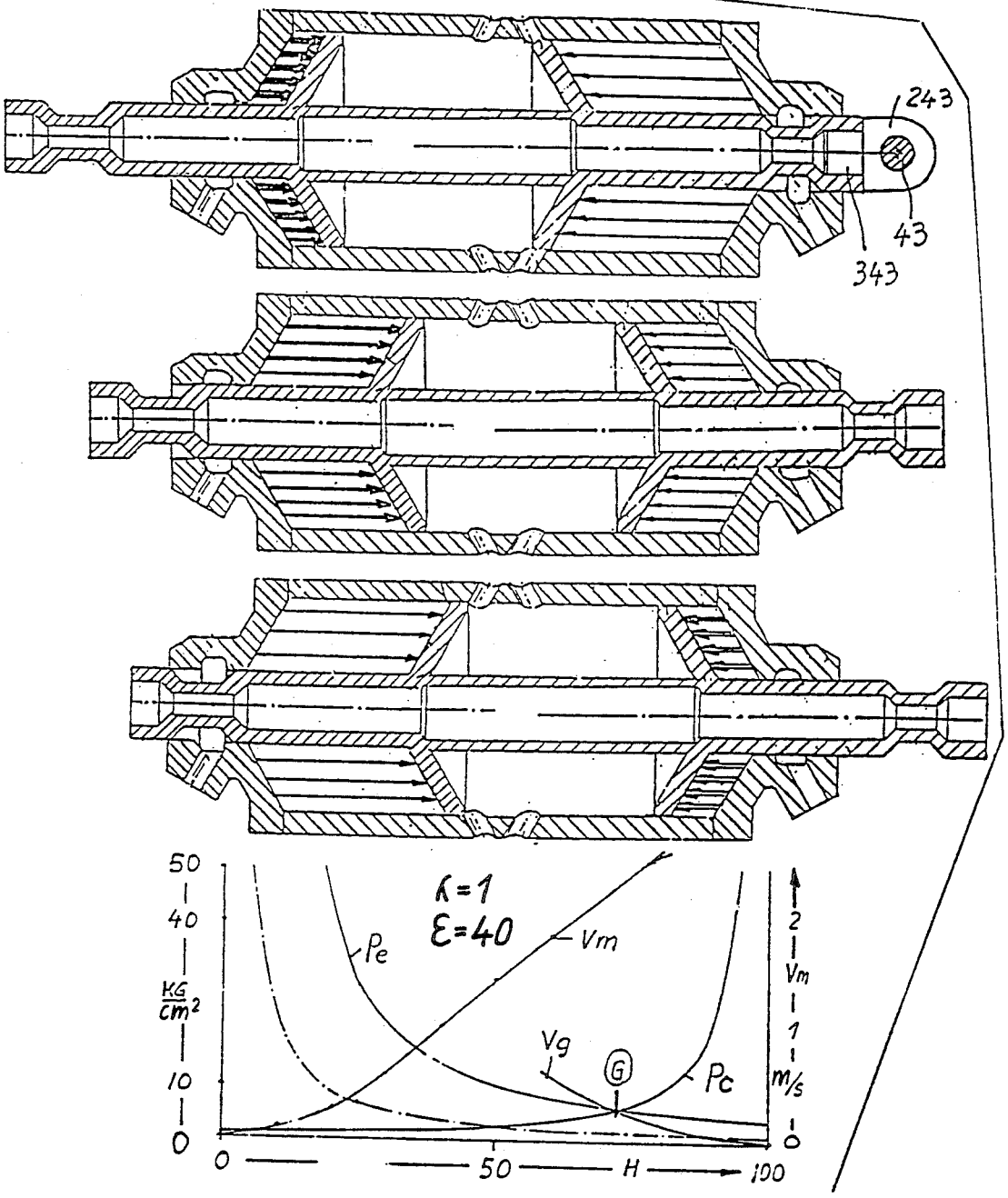
FIG. 55 illustrates the working of an engine in views and a diagram.
Figure 56:
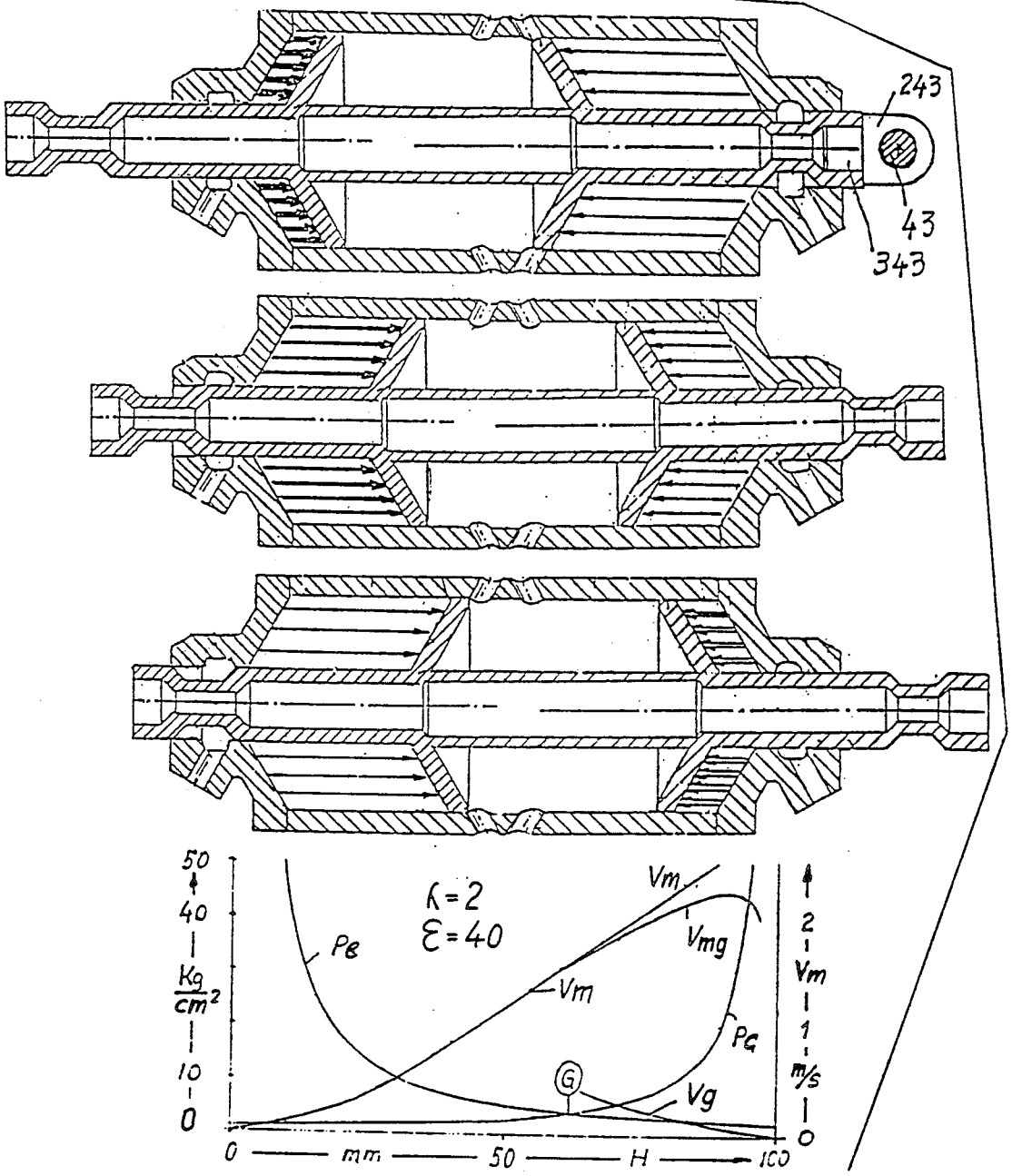
FIG. 56 shows the working of an engine in views and a diagram.

FIGS. 55 and 56 show the engine of FIG. 15 in 6 locations of the piston in longitudinal sectional views. Therein arrows are provided which with teir thickness and length indicate the concentration of pressure in the respective working chamber. Below the sectional views diagrams are provided which show the expansion pressures, the compression pressures, the medial velocity of the piston, the braking velocities and the points "G" where the braking of the running piston starts. More details thereof are, again, found in my mentioned German DE OS 31 32 718. It should be noted, that according to this invention the pistons should be provided with connection means to make the connection of a conrod to a revolving crankshaft with a revolving mass possible in order to make an increase of the number of strokes per unit of time possible. That is indicated by the insertion of connecting portion 343 into or onto the end of one of the piston shafts. A cross pin 43 may connect the connecting portion 243 to the respective conrod.

Figure 57:
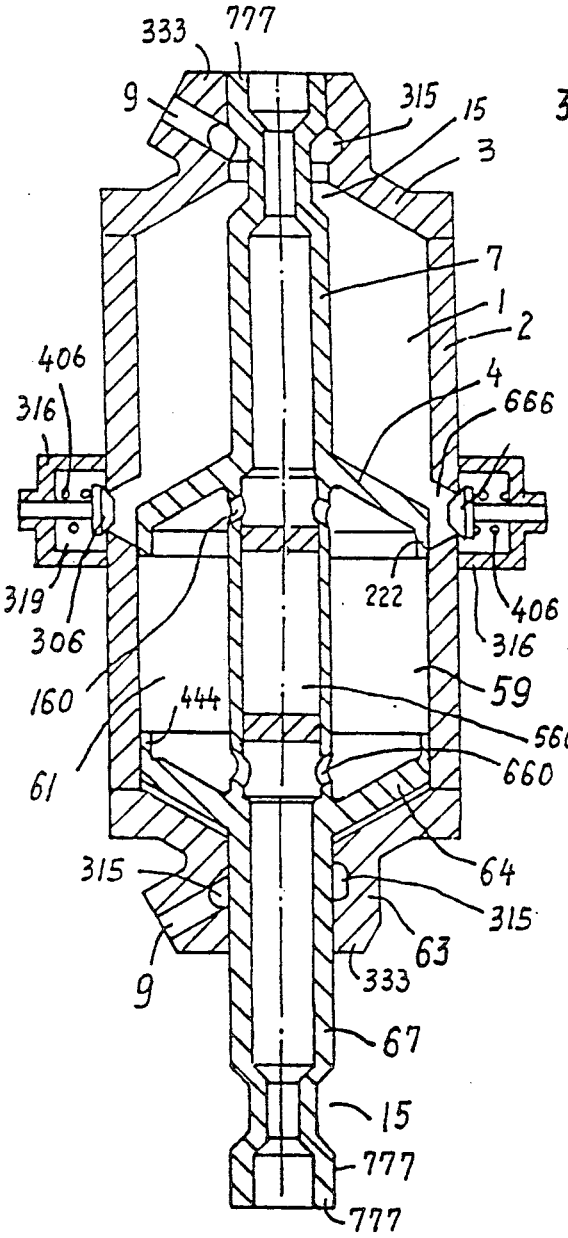
FIG. 57 is a longitudinal sectional view through an engine.

FIG. 57 shows in a longitudinal sectional view the arrangement of means to prevent backflow of hot gases from the exhaust or fluid line to the turbocharger into the interior space between the pistons 4 and 64. For that purpose the one way check valves 306 which may be loaded by springss 406 are set into the exhaust passages 6 and 66 or one of them or into a combined exhaust passage 666. These valves prevent that exhaust gas which has already left the respective cylinder 1 or 61 after the end of the exhaus stroke could flow back from the collection chamber 19-16 or 319-316 into the space 59 between pistons 4 and 64. The arrangement of this valve is important to prevent excessive heating of the walls 2,62 of the cylinders and of the pistons 4,64 or the medial piston connecter portion 60.

Figure 58:
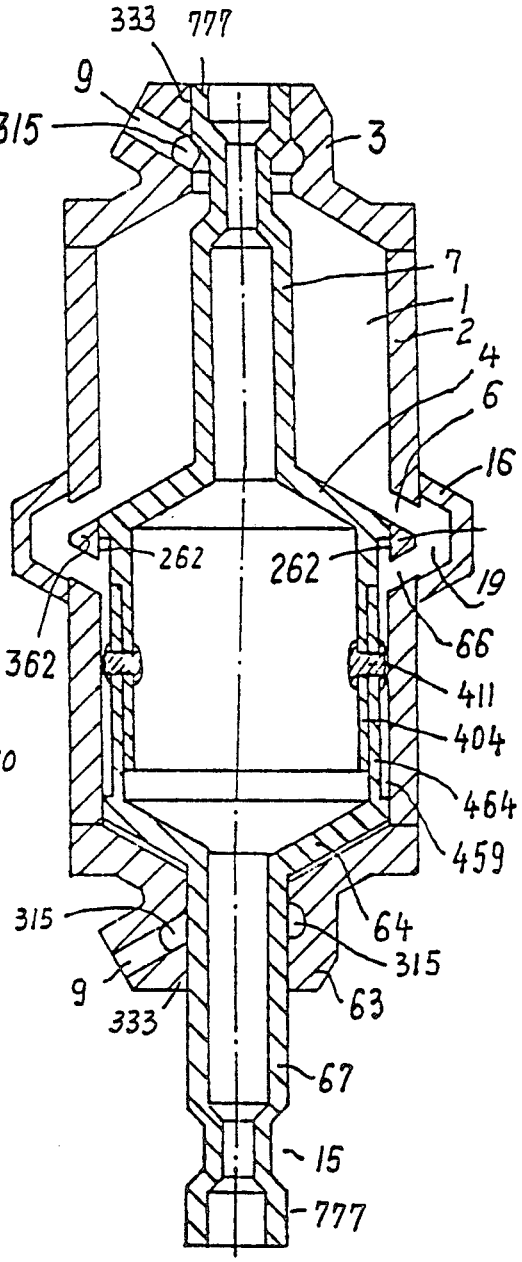
FIG. 58 is a longitudinal sectional view through an engine.

FIG. 58 shows in a longitudinal sectional view another provision to prevent excessive heating and back flow in and into the chamber 59 between the pistons 4 and 64. In this Figure the medial piston rod or connecting portion 60 is replaced by a medial portion 464 of larger diameter or by two medial portions 404 and 464 of a larger diameter. The mentionaed larger diameter is so large that the outer diameter is so big that only a narrow space 59 remains between the medial portions 404,464 or one of them and the inner diameter of the cylinder 2,62. Thereby it is secured that only a small amount of fluid can flow back from the exhaust or from the collection chamber 19 in collecter 16 into the space 59 between the pistons, the medial portion(s) and the wall(2) of the cylinder. That prevents uniniformity of exhaust flow due to fluctuating flows into space 59 and in addition it permits the application of a larger cooling surface from the interior space of the medial portion(s) 60,404,464. For convenience of manufacturing the circular portions 404 and 464 may be of different diameters to permit the one of them to fit into the other. A holding means, a rivet 411 in the Figure, may be set to hold both medial portions 404 and 464 and thereby the pistons 4 and 64 together.

In FIGS. 57 and 58 it is of further interest that the cover 3,63 should have an annular recess 315 communicated to inlet 309 in order to permit a large cross sectional area for the inflow of the fluid when control recess 15 meets the annular groove 315. The recess 15 should also be an annular groove and the faces of the recess 15 should be taperedly inclined in order to abtain a streamlined flow to prevent losses by friction and by directional changes in flow. To prevent break of piston rings forward extensions of shaft or cover 7 or 3 and/or extensions (in axial directions) of the grooves or recesses 15,315 may be applied to obtain a gradual application of seal and deformation of the piston for sealing purposes. These arrangements should also be done in FIGS. 14,15 and the respective other Figures; the referentials 315 and 15 will indicate these applications in the mentioned other Figures of the specification. Also applied in FIG. 58 and in the respective other Figures, like Fig. 15 etc., are the cylindrical face portions 262 of the portion of the wall(s) 2,62 of the cylinders 1,61 between the exhausts 6 and 66. Thise face portions 262 on the medial wall portions 362 have the purpose to guide the respective piston 4 or 64 at the respective portion of its (their) stroke (strokes).

Figure 59:
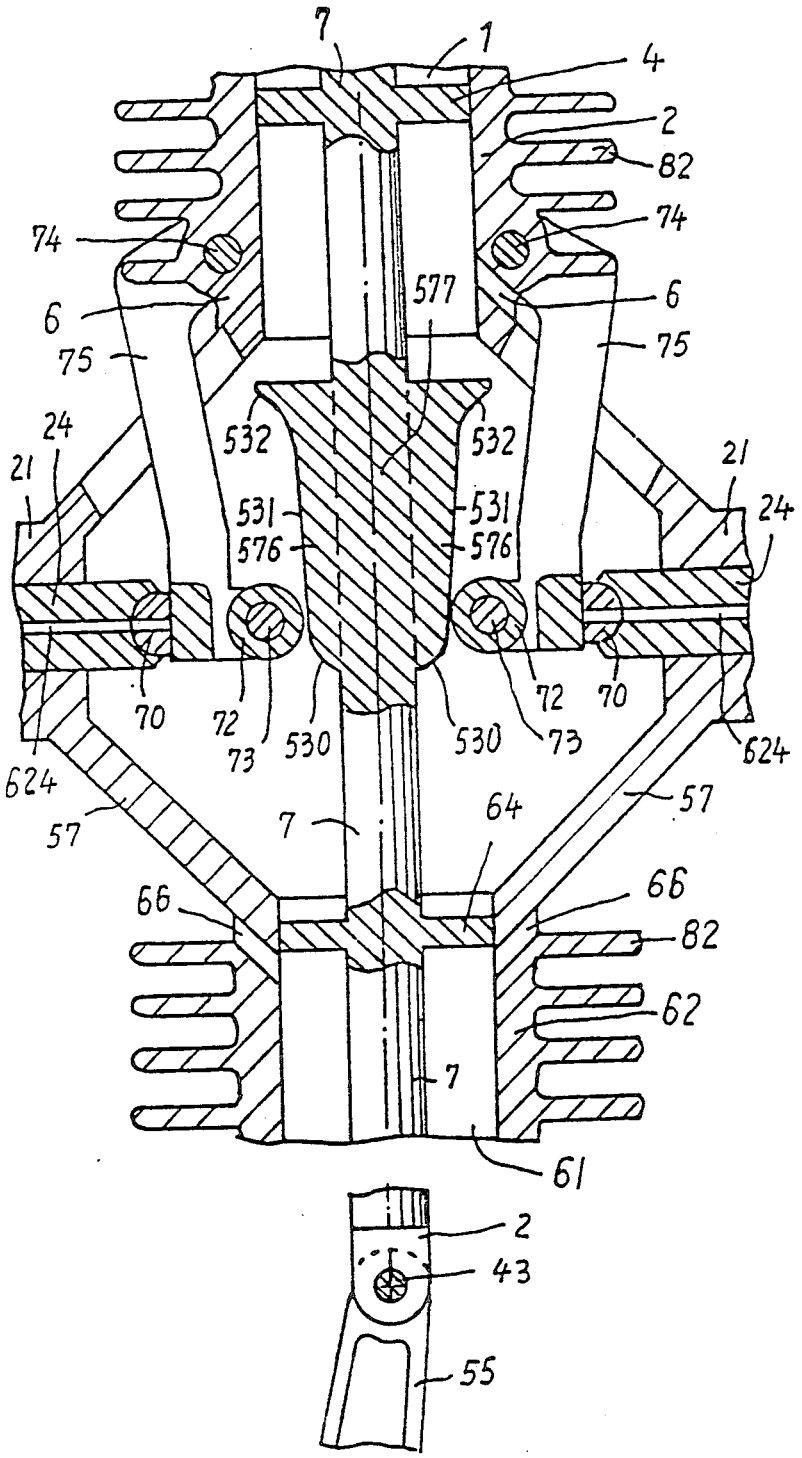
FIG. 59 is a longitudinal sectional view through an engine portion.

FIG. 59 is a longitudinal sectional view through a portion of another hydrofluid conveying combustion engine of the invention. It is related and partially similar to FIGS. 45 and 46 to 48; however, the cams on the medial piston shaft 7 are different and serve different purposes. The cams 576 on the medial shaft 7 between the pistons 4 and 64 have in this embodiment pump piston stroke guide faces 531 of a very different configuration for a very different purpose. The cams form portions and guide faces 530 with a steap angle at the begin of the expansion stroke of the engine piston 4,64 and steap rear portions 532 near the ends of the mentioned expansion strokes while in the middle between portions 530 and 532 the flatter portions 531 with less steep inclinations are provided. This arrangement serves to obtain equal rate or almost equal rate of flow in the hydrofluid pump cylinders 21 over the entire length of a single power stroke of an engine piston 4 or 64. The Figure shows only those cams and stroke guide faces which are visible in the section, while those angularly spaced thereto for the reverse direction of the engine strokes are indicated only by referential 577. It is known from FIG. 47 that these may be 90 degrees angularly spaced relative to cams 576 of FIG. 59.

Figure 60:
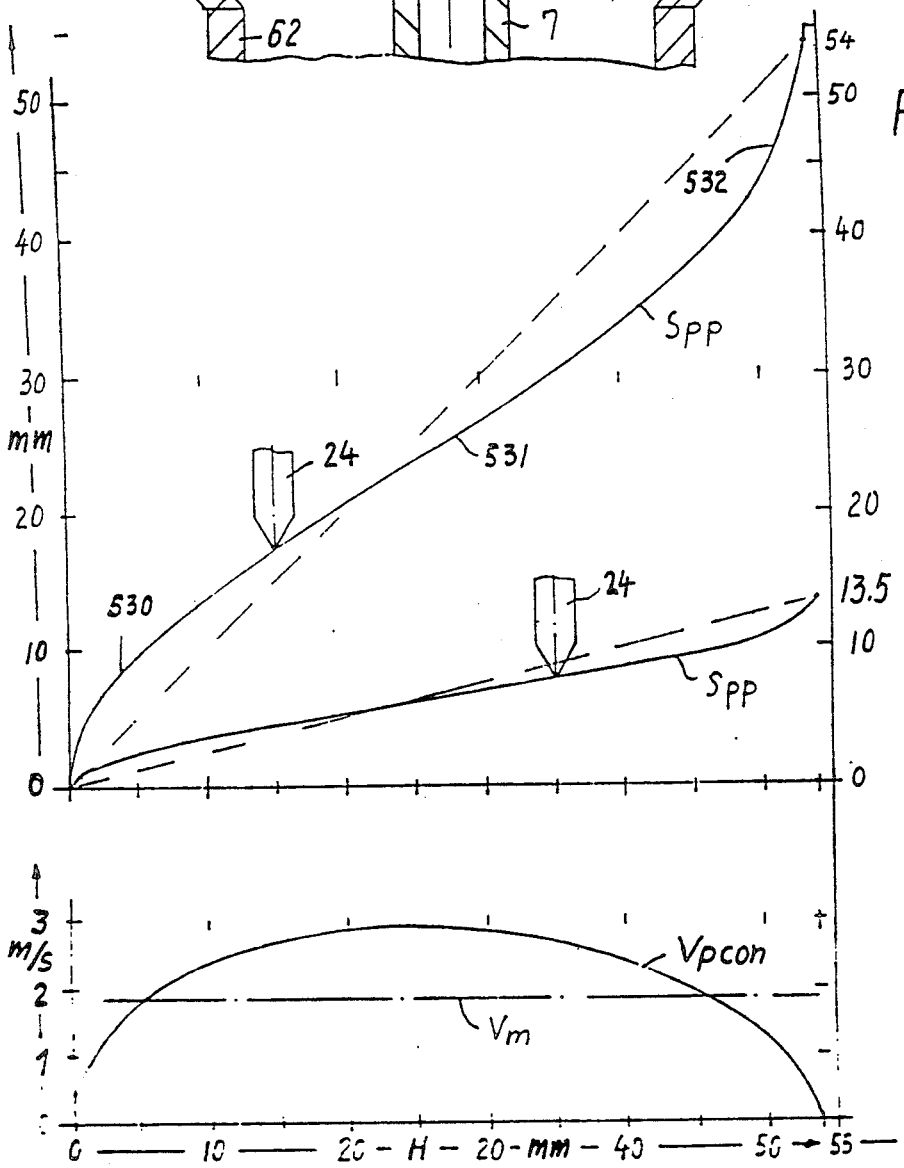
FIG. 60 is a diagram, giving sizes of cams and guide faces.

FIG. 60 is a diagram and explains the values of the cam arrangement(s) of FIG. 59. The diagram of FIG. 60 has as the x-axis the stroke "H" of the piston 4 or 64 of the engine portion of FIG. 59. The velocity Vpcon of the engine piston is shown thereover in the direction of the y-axis. Please note, that FIG. 59 shows that the piston 4,64,7 is connected to the conrod 55 of a crankshaft and that the crankshaft revolves with a given RPM whereby the velocity of the piston at any location of its stroke is defined and calculable from the rotary angle alpha of the crank of the crankshaft. A straight face, inclined relative to the axis of the piston would bring the dotted lines of pump stroke Spp of the pump pistons in cylinders 21. Such strokes would give a straight face on the cam(s) but it would bring a very ununiform flow in the cylinders 21 whereby all piping or hosing connections on cylinders 21 would break. The present invention discovers this important occurrance and takes the consequences thereof thereby that the cam's stroke face gets the mentioned portions 530,531 and 532 also shown in FIG. 60.

FIG. 60 shows by a dotted line also the medial velocity Vm of the piston(s) of the engine. The actual velocity Vpcon is very different therefrom. It is slower at the beginning, higher at the medial portion and again slower near the end of the expansion stroke. To nivelize this matter to a uniform medial piston speed in the pump pistons 24, the cam's piston stroke guide faces must get the steep portion 530 to complement the slower Vpcon and get the steeper portion 532 to complement the slower speed portion of Vpcon close to the end of the piston stroke of the engine with the flatter medial portion 531 therebetween. The Figure shows a stroke of the engine piston 4,64 of 54 mm. The crankshaft is calculated to have the conrods centered on a radius of 27 mm around the concentric axis of the crankshaft and the length of the conrod = distance between the center axes of the eyes of the conrod = is calculated to be 110 mm. This corresponds to one of the Yamaha motor bike engines. The guide face "Spp" = 530,531,532 would then bring also 54 mm stroke to the pump pistons 24 and the velocity of the pump pistons 24 would then be equal at the entire stroke to the medial velocity Vm of the engine's piston(s) instead to the actual velocity Vpcon of the engine's piston(s) 4,64,7. This is accurate, if the pump pistons 244 meet the stroke guide face 530-532 in points or parallel lines as shown in FIG. 60. For actually applied rollers 72 respective adjustments might be required. Since commonly the pressure in the pump cylinders 21 is higher than the pressure in the engine's cylinders 1,61, a shorter stroke of the pump pistons 24 is suitable. FIG. 60 shows therefore, a second curve "Spp" for a stroke of 13.5 mm which means for a four times shorter stroke. In summary, the courves Spp are actual sizes relative to the written dimensions in the Figure, for the actual machining of the piston stroke guide faces of cams 576 of FIG. 59. The other parts of FIG. 59 correspond to respective part of others of the Figures of the specification.

Figure 61:
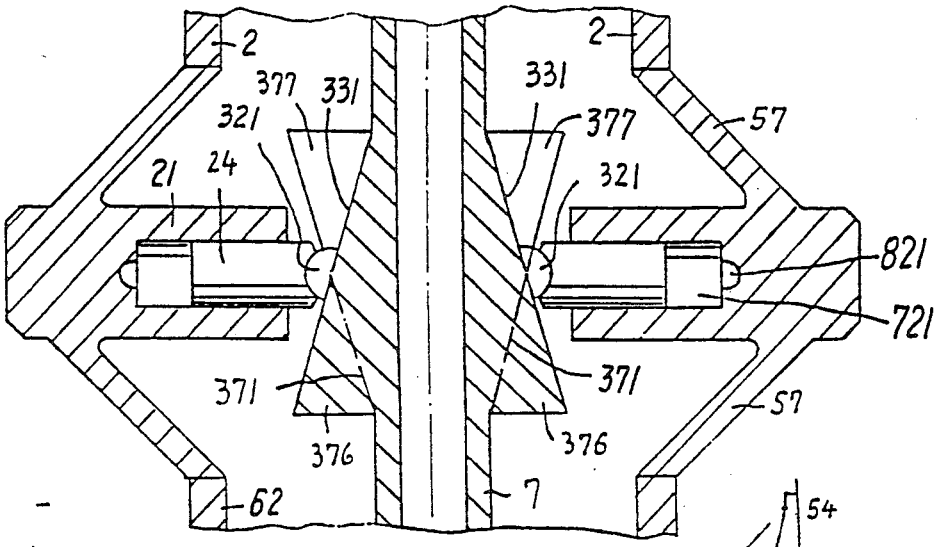
FIG. 61 is a longitudinal sectional view through an engine portion.

FIG. 61 shows in a longitudianl sectional view a modification of the cam arrangement to a high pressure hydrofluid conveying hydrofluid conveying combustion engine. The earlier Figures have rollers 72 which meet the piston stroke guide faces of the cams only in a line contact. Line contact has only a limited bearing capacity. To obtain a higher pressure in the hydraulic pumps the line contact should be changed to a face contact which permits a higher bearing capacity. To obtain that in FIG. 61 the pistons 24 bear therein pivotable piston shoes 321 with plane slide faces which are complementary configured relative to the piston stroke guide faces 331 of cams 376 whereon they actually slide. The piston stroke guide faces 331 are, consequently, also plane faces whereby the stroke cams 376 form inclined plane faces which are angularly inclined relative to the longitudinal axis of the piston(s) of the combustion engine. The Figure also indicates by 377 the cams for the oppositionally directed stroke. Shown are also the hydrofluid cylinder spaces 721 in cylinders 21 with the outlets or inlets 721. The arrangement of the Figure has the feature that it can operate the pumps with higher pressure because of the higher bearing capacity of the faces bearing instead of the lines bearing. However, it has the disadvantage that the delivery of fluid out from the pumps 21-24 is very ununiform because of the straight plane inclined faces 331 of these cams 376 of this Figure.

Figure 62:
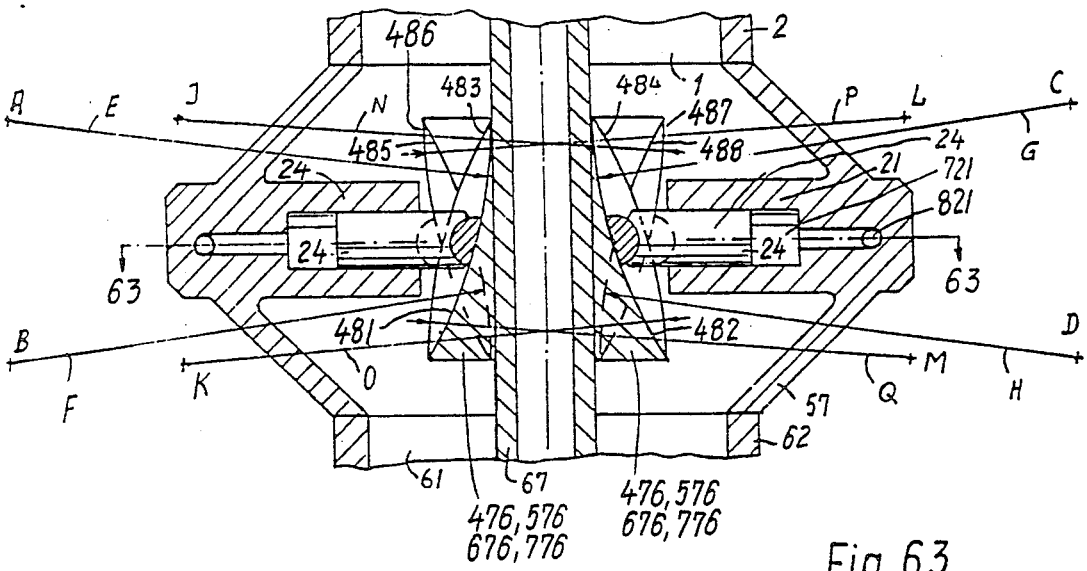
FIG. 62 is a longitudinal sectional view through an engine portion.
Figure 63:
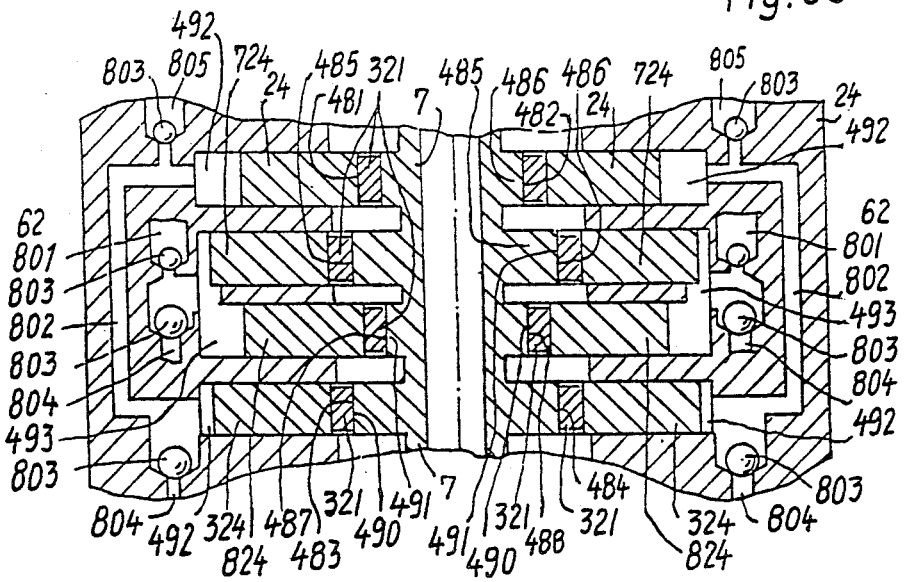
FIG. 63 is a cross sectional through FIG. 62 along its arrowed line.

FIG. 62 with the thereto belonging cross sectional FIG. 63 through the arrowed line of FIG. 63 partially overcome the problem of the ununiformity of flow of FIG. 61. FIG. 62 is a sectional view through FIG. 63 along the arrowed line B—B in FIG. 63. The pistons 24 have again, as in FIG. 61, piston shoes with slide faces which are complementary configurated relative to the respective piston stroke guide faces. Thus, also this arrangement is capable of high pressures because faces slide on faces instead of lines rolling on faces. The difference, however, compared to FIG. 61, is that the stroke guide faces 481 to 488 are configurated as portions of faces of cylinders and that the thereto complementary configurated slide faces 490,491 of the piston shoes 321 are portions of outer faces of cylinders or of round bars. The stroke faces are provided on the cams 476,576,676 and 776. The stroke face 481 is formed with radius E around axis A; stroke face 485 is formed with radius F around axis B; stroke face 482 is formed with radius G around axis C; stroke guide face 487 is formed with radius H around axis D; stroke guide face 488 is formed with radius N around axis J; stroke guide face 484 is formed with radius O around axis K; stroke guide face 486 is formed with radius P around axis L and stroke guide face 483 is formed with radius Q around axis M. In actuality the radii are shorter than shown in the Figure by which the axes are more close to the shaft 7 of the engine. The Figure shows four concave piston stroke guide faces and four convex piston stroke guide faces. One convex face forms together with a concave piston stroke face a piston stroke faces pair. The next speciality of these Figures is, that the pistons of the respective stroke face pair form together a single pump in which both pistons pump into a common pumping chamber. For example, pistons 24 and 324 are one piston pair and pistons 724 and 824 are another piston pair of the respective pump of a piston pair. Each pump has thereby two pistons for a common pumping chamber with one of the pistons sliding on a concave piston stroke guide face and the other piston of the same pair sliding on a concave piston stroke guide face. The piston shoes have, consequently, per each pump chamber with two pistons of the respective piston pair a concave slide face and the other piston shoe a convex slide face, either 490 or 491 to be complementary configurated relative to the respective piston stroke guide face whereon the respective piston shoe slides.

The important feature of this embodiment of the invention is that a concave cam face and a convex cam face act together into a single common pump chamber. The common pump chambers per piston pair are shown by 492 and 493 in FIG. 63. One of the convex or concave piston stroke guide faces thereby has a relative steep angle of inclination at the start of the stroke and the other at the end of the stroke of the engine, while in the middle area of the stroke both faces are relatively little inclined relative to the axis of the engine's piston shaft 7. Since both pistons of the pair act together into the same chamber the sum of the delivery of both pistons of the same pair is more uniform than that of FIG. 61 and nears the uniformity of flow of FIG. 59 with diagram 60. A full uniformity is, however, not easily obtainable with two pistons in a singe pumping chamber, but is almost perfectly obtainable by a plurality of more than two pistons per common pumping chamber. Chamber portions 492 are communicated to form a common chamber by passage 802. Each common pumping chamber has at least one inlet valve 803 and one outle valve 803. Each common chamber has an inlet passage 804 and an outlet or delivery passage 801 or 805.

Figure 64:
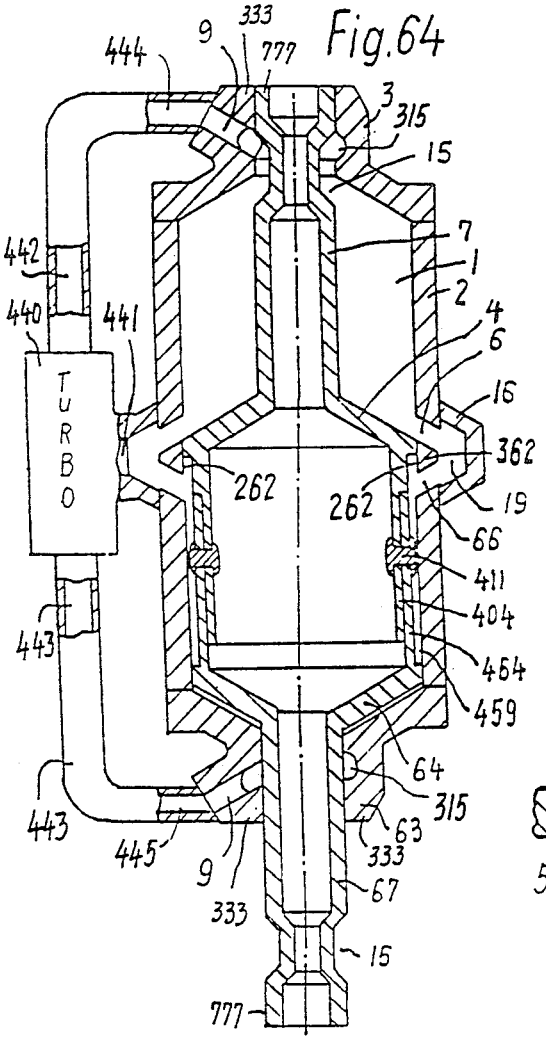
FIG. 64 is a longitudinal sectional view through an engine.

FIG. 64 shows in a longitudinal sectional view that it is preferred to set a turbocharger between the exhaust port and the inlet ports in FIGS. 15,14,17,20,57,58 and the other respective Figures. Exhaust port 19 delivers the exhaust gases into the entrance 441 of the turbine of the turbo charger 440. The pre compressed air or air-fuel mixture leaves the compressor stage of the turbo 440 to flow over the pipes or fluid lines 442,443 and their ports 444,445 into the entrance ports 9 of cylinder chambers 1 and 61 of the engine of the invention.

Figure 65:
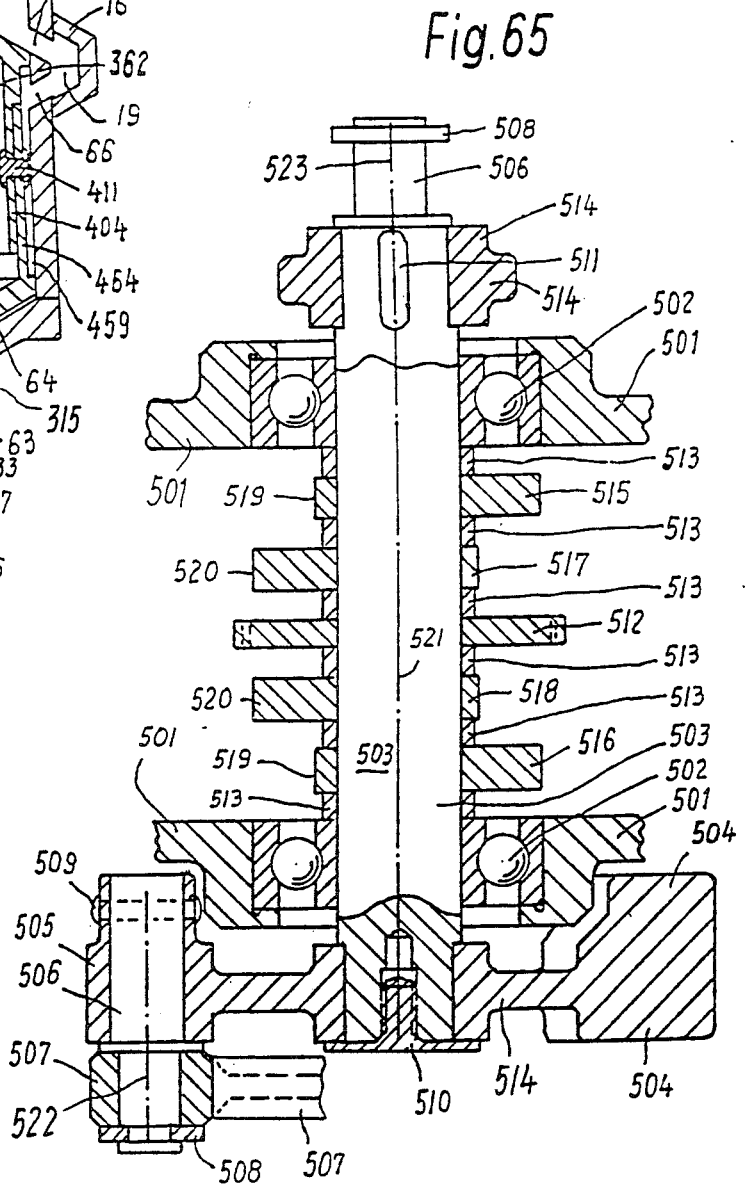
FIG. 65 is a longitudinal sectional view through a crankshaft-assembly.

The embodiment of FIG. 65 shows a crankshaft arrangement of the invention. The aim of this arrangement is to provide a crankshaft which is easy in production without Jigs or machines for eccentric machining. At the same time it may or shall have means to run at least one or a plurality of pumps. The housing 501 carries in bearings 502 the revolvable shaft 503 with axis 521. The ends of the shaft 503 hold the crank portions 514. Key means 511 and holders 510 may be provided if so desired to fasten the crank portions 514 to the shaft 503. Actually the crank portions may be fastened by a press fit by warming the crank portions for assembly or by cooling the shaft for the assembly. The key and holder can then be spared. The crank(s) 514 are now simple forged or casted parts which can be drilled or bored by a boring machine with parallel axes of the bores. One bore for the fastening on the shaft and the other bore for holding a conrod bearing bar 506 therein. Holding means, for example, rivets 509 may be provided if so desired. The crank portion 514 has thereby a medial portion which is borne on the shaft 3, one radial portion 505 which bears the conrod bearing holder 506 with axis 522 which is distanced radially from axis 521 of shaft 503 but parallel thereto and in the diametrically opposite direction the mass or counter weight portion 504. The crank 514 on the upper portion of the Figure is shown to be 90 degrees turned relative to crank 514 off the bottom portion of the Figure. The 90 degrees turning is, however, only done by way of example. The cranks could also be equally angularly set or spaced angularly under a different angle, for example, 180 degrees or any other suitable degree. The simplicity of the design makes it possible to assemble onto the simple straight shaft 503 any desired drive means. In the Figure a medial gear 512 to drive accessories is assembled and endwards thereof are symmetrically eccentric cams 515 to 518 assembled to have outer faces to form piston stroke guide faces 519 and 520. Faces 519 form one stroke pair and faces 520 form another stroke pair. Each stroke pair might also consist of one stroke face 519 and one stroke face 520. These stroke faces may serve to guide pistons or piston shoes of a hydraulic or pneumatic pump arrangement which shall be driven by the conrods 507 which connect to the pistons of a respective combustion engine. This crank shaft of FIG. 65 is especially suitable and inexpensive to be assembled to the engines of FIGS. 15,64 and others of this specification. The crankshaft of this Figure can be machined on simple machine tools in small workshops.

In FIGS. 15,51 and the thereto related Figures, the pistons 4 and 64 might be combined to a single axially very short piston, just long enough to open and close the combined exhaust of FIG. 57. The stroke of the piston would then have to be substantially doubled if the cylinders remain of equal lengths. This arrangement would still further reduce the weight of the piston, but it is not shown in the Figures. In FIG. 29, bottom portion of the Figure, it is shown how the connecting rods 47 to 48 may be set directly onto a single eccentric portion of a crank shaft. Plural conrods 46,47 or 46 to 48 or more may by this way combine the piston strokes of multiple double or single piston engines, like, for example, that of FIG. 20 to working actions one after the other in timed relation relative to each other. The Figure shows how such arrangement may be obtained in a simple and inexpensive device and design.

In FIG. 58 it is of value that the outer diameter(s) of the medial connecter(s) 404,464 is (are) smaller than the diameter(s) of the seal portions of pistons 4 and 64. Because otherwise the required narrow space 459 would not appear between the pistons 4 and 64. Without such narrow space the entire length of the outer face of connecting portion 464 would run along the cylinder and wear there, by which it would run through a hot portion of the wall of the cylinder(s) 2,62 and might weld there under heat expansion or contraction under periodically varying heats.

The embodiments of this specification show samples of actuall design or of prospected designs. The embodiments should be evaluated in combination with the analysis of the engine of this specification. Many portions of the analysis are entirely exact. Others are present attempts to advance towards a better knowledge of the acting medial pressures " P " and " P ". The attempts to advance to a better knowledge can not presently be final and exact solutions. They may become improved with time in the future. Thus, only those portions of the analysis which are assumed to be exact should be used in exact values while those portions of the analysis which are only present attempts to advance towards a better knowledge should not be considered to be final exact values or solutions.

The pump portions may be hydraulic fluid pumps or pneumatic pumps or compressors respectively. They may also act as pneumatic or hydraulic motors to drive or to start the portions of the combustion engine. The appended claims should be considered to be portions of the description of the preferred embodiments of the invention and/or portions of the summary of the invention.

Figure 66:
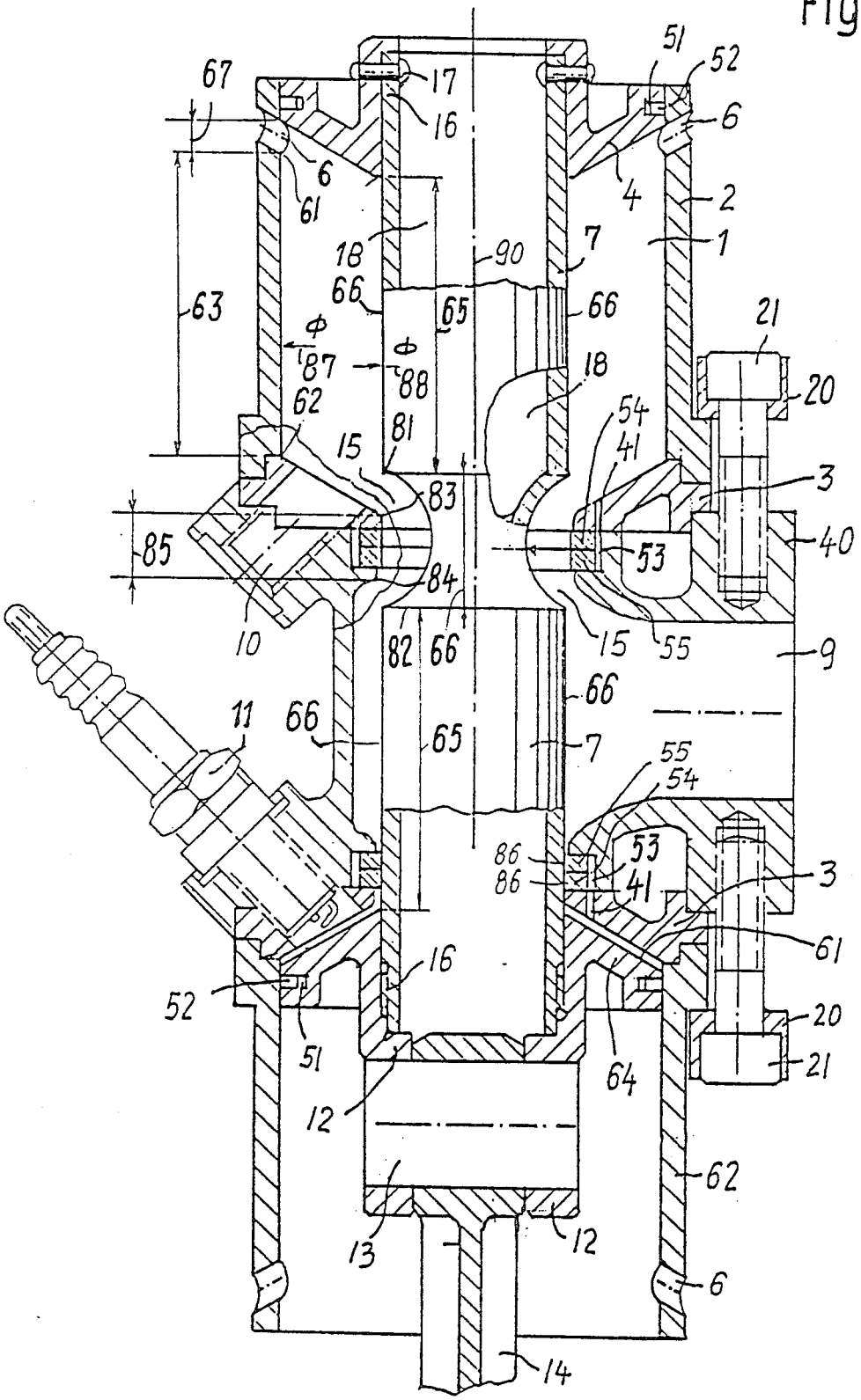
FIG. 66 is a longitudinal sectional view through an engine.
Figure 67:
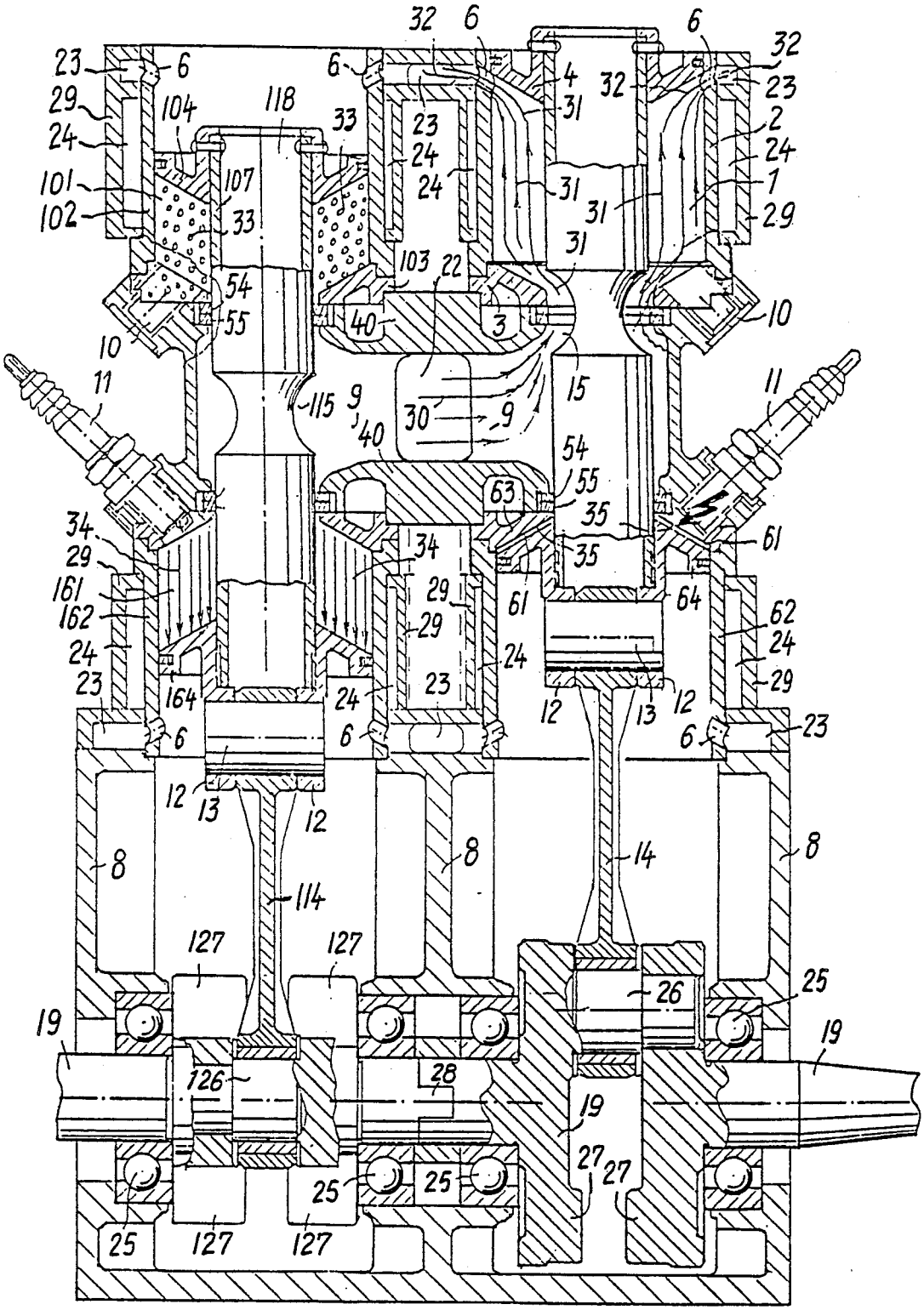
FIG. 67 is still another longitudinal sectional view through an engine of the invention wherein the common crankshaft to two cylinder arrangements and piston portions are partially shown in views from the outside.

FIGS. 66 and 67 show longitudinal sectional arrangements through an ultra power engine of the invention for which international priority of German (FRG) application P 36 20 691.1 of Jun. 20, 1986 is claimed. In FIG. 67 two double acting pistons, running in respective cylinders, are combined by a common crankshaft for operation in unison. FIG. 66 shows the arrangement in one of the cylinders in a larger scale than the arrangements are illustrated in FIG. 67. This engine is called "ultra-engine" because it produces greatest power in a lowest weight device which can be easily and inexpensively produced. The aim of this engine is to produce an engine for the twentieth of the costs of the Tornada accessory shaft gasturbines of the Tornado fighter plane of Europe.

Figure 7:
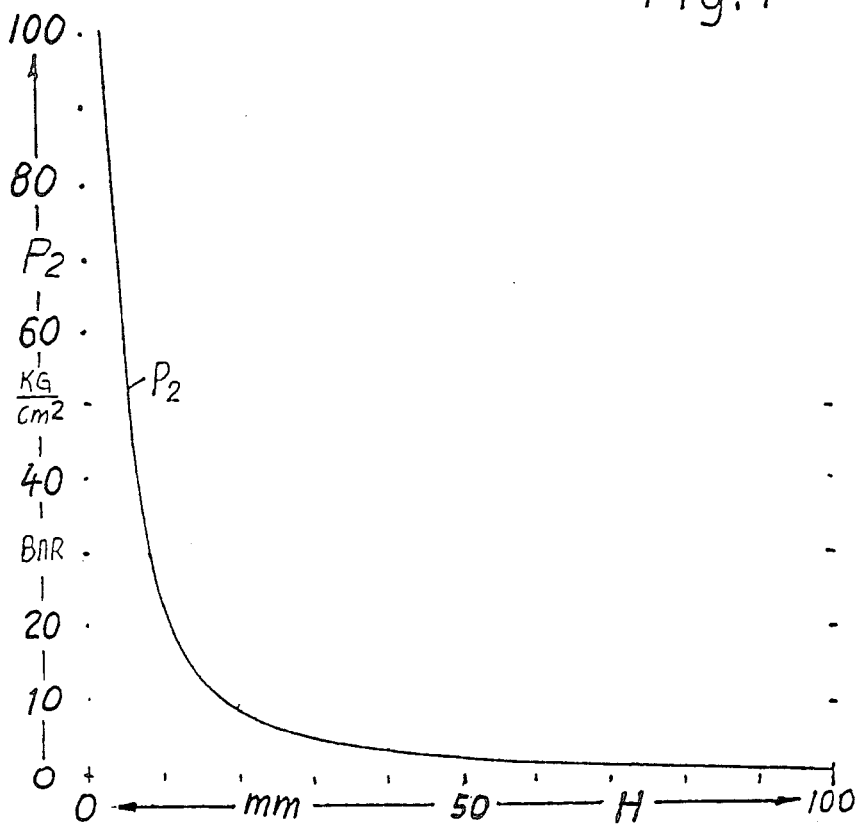
FIG. 7 is another diagram.

Both Figures will now be described together, since FIG. 67 has two devices of FIG. 66 with equal referential numerals. In FIG. 67, however, some of the portions have equal end numbers in the end digits but pre digits 1,10 or the like to explain different temporary locations. The equal end digits define that the parts are equal to those in the other cylinder of FIG. 7 or of FIG. 66.

In the respective cylinder 2,62 the double piston reciprocates and has the respective piston shaft 7,107 with one piston 4,104 on one of its ends and another piston 64,164 on the other of its ends. The pistons are fitted in the cylinders and seal on the inner faces of the cylinders, while piston rings may be inserted into the respective pistons to seal the pistons along the walls of the cylinders. The speciality of these Figures is that according to these embodiments of the invention the piston shaft 7,107 has a medial flow control recess 15,115 which extends through the outer face of the piston shaft into the piston shaft and which is located substantially axially in the middle of the piston shaft and thereby axially seen also in the middle between the pistons on the ends of the shafts.

A medial housing 40, is flanked axially by intermediate bodies 3,63 and axially endwards of these intermediate bodies are the cylinders 2,62,102,162 provided. Between the medial housing 40 and the intermediate bodies 3,63,103,163 are seal ring beds 53 provided which contain the seal rings 54 and 55, respectively. These seal rings are provided with inner faces which seal along the outer face of the respective piston shaft 7,107. The mentioned seal rings have an inner stress which spans them radially inwardly for close engagement and seal on the outer face 66 of the respective piston shaft. This spanning force may be assisted by pressure in fluid in a respective neighboring cylinder chamber by means of a respective passage 41 which leads the pressure from the respective cylinder chamber into the seal ring bed and onto the radial outside of the seal rings. The medial housing 40 is provided with an entrance passage 9 which forms a chamber portion radially around the piston shaft 7 or 107. The arrangement may be held together by the fastening or holding means, bolts, nuts, flanges etc., 20 and 21. Holding means 10 may be provided on the medial housing, cylinder or intermediate body for the insertion of ignition or fluid injection means, for example, 11. The piston rings 52 are provided in piston ring beds 51. The outer diameter of piston shaft 7,107 is 88. The medial recess 15,115 ends in control corners 81 and 82. The pistons may be fastened to the piston shaft by holding means 16,17,12,14,14 or the like. The cylinders have exhaust ports 6, In FIG. 66 the piston arrangement is in the upwardmost location, at which the exhaust ports 6 in cylinder 2 are opened because the piston 4 run upwards over them. The axial length of the exhaust ports is defined by 67. The length of the piston stroke is 67 plus 63 with 63 beeing the length at which the respective working chamber 1,61,101,161 is closed during the piston stroke. By 61 the distance between the piston and the respective corner 81 or 82 of the control recess 15,115 is defined. The control recess has an outer diameter 89 which is considerably smaller than the diameter 88 of the piston shaft.

The length and location of the control recess is such, that the recess 15,115 opens a communication between the entrance port 9 and the respective cylinder chamber 1,61,101,161 near the ends of the piston strokes. Thus, in FIG. 66 entrance port 9 is communicated by control recess 15 to the cylinder chamber 1. Fluid enters at this location and time from entrance port 9 through control recess 15 into cylinder chamber 1 and at the same time the old fluid of cylinder 1 is exhausted through exit port 6. It is preferred to lead fresh fluid under a certain loading pressure into entrance port 9, for example, by a turbo charger. When the piston assembly starts to move down in FIG. 66 and the piston 4 runs over the exhaust port 6 to meet the cylinder's wall at 61, the exhaust port 6 is closed and at substantially the same time the control corner 81 of the control recess 15 meets the respective inner face of the respective seal ring 54,55 to close and seal the entrance port 9 from the chamber 1. Similar actions take place at the bottom near location of the piston assembly with the then with entrance port 9 communicating and discommunicating cylinder chamber 61 on the other side of the medial housing 40. In FIG. 66 the engine is ready for ignition or fuel injection which will then lead to the expansion of the charge under pressure for driving the piston 64 downwards in the power stroke.

In FIG. 67 two assemblies of FIG. 66 are assembled side by side. Connecting rods (conrods) 14,114 connect the respective piston assemblies to the common crankshaft 19. The eccentric bearing portions 26 and 126, which bear the outer ends of the connecting rods 14,114, are angularly turned ninety degrees relatively to each other when seen along the axis of the crank shaft 19. The crank shaft is revolvably borne in bearings 25 in crank housing 8. There may be two crank shaft portions connected angularly together by connecting means 28 and the crank shaft has counter weight masses 27,127 relative to the eccentric bearing portions 26 and 126. This arrangement secures a certain timed running relation of the piston assembly strokes in the two cylinders of this engine. A turbo charger, not shown in the Figure, is connected with the delivery line to entrance 30 of the entrance ports 9 which are thereby combined to a common entrance 9 and a common loader or turbo before entrance 30. Exhaust collection chambers 23 take in the exhausts from the exhaust ports 6 and transfer the exhausts to the turbine of the turbo charger before entrance 30. Cooling fluid chambers 24 in cooling housings 29 or respective cooling ribs for air flow cooling may be provided on the cylinders. In the arrangement of FIG. 67 the right portion shows the arrangement of FIG. 66 with the piston assembly at this moment of time located as described at hand of FIG. 66.

Since the eccentric bearings of the crank shaft are 90 degrees turned relative to each other, the engine of FIG. 67 has four power strokes per each revolution. These power strokes act with 90 degrees turn of the crank shaft one after the other. Accordingly one sees in FIG. 67 the cylinder chamber 1 at exhaust and fresh loading timing, the chamber 61 ready for fuel injection or ignition, cylinder chamber 101 under compression of the gas in it and cylinder chamber 161 in the timing of power stroke. The arrowed lines in the Figure show the movements of flow of gas or fluid. Thereby 31 indicates the flashing of the cylinder chamber by fresh fluid from entrance 30,9 in combination with the exhaust 32. The compression of the fluid or gas is indicated by 33 and the power stroke of the charge is indicated by referential numeral 34.

With exclusively means of low weight, compact design and four power strokes per every single revolution, this ultra power engine obtains a superiorly high power per weight and size of the engine unit.

The engine of FIG. 66 thereby is:

a double piston device with endwards of a medial housing provided cylinders with a therein reciprocating piston assembly, consisting of pistons on the ends of a piston shaft between said pistons, exit ports on the axial outer end portions of the cylinders, inlet passage means in the medial housing with control means for the inflow of fluid into the respective cylinder and an improvement, wherein the improvement comprises, in combination, a control recess provided substantially in the middle between the pistons and on the piston shaft between the pistons extending radially into the piston shaft and having a length 66 while the piston assembly has a stroke of the length 63 plus 67 with the recess 15,115 ended by control corners 81,82, and a portion of the medial housing surrounding portions of the piston shaft and sealing along the respective portion of the outer face 66 of the piston shaft, whereby at the outer ends of the piston strokes the entrance port 9 of the medial housing communicates alternatingly with one of the cylinders while at the strokes between the end portions of the strokes the cylinders are discommunicated from the entrance port in the medial housing.

FIG. 67 defines a double acting device as in FIG. 66, wherein a plurality of piston assemblies are provided in a plurality of cylinder arrangements of FIG. 66, one end of each piston assembly is connected by a connecting rod to an eccentric portion of a crank shaft and the eccentric portions of the crankshaft are angularly spaced by a number of degrees suitable to the number of piston and cylinder assemblies in order to let the piston assemblies act one after the other in timed relation at a single revolution of the crank shaft.

FIG. 67 also defines a plurality of double acting piston assemblies in a respective plurality of cylinder and medial housing arrangements with the piston assemblies connected to a common crank shaft to move the piston assemblies per each revolution of the crank shaft in timed relation one after the other and wherein exhaust chambers collect the exhaust gases from the exit ports 6 of the cylinders to lead the exhaust to a turbine of a trubo charger while the compressor of the turbo charger is communicated to the entrance port 9 of the medial housing to press fluid under pressure through the medial housing over the control recesses in the piston shafts into the respective cylinder of the device in timed relation into one of the cylinders after the other.

Figure 68:
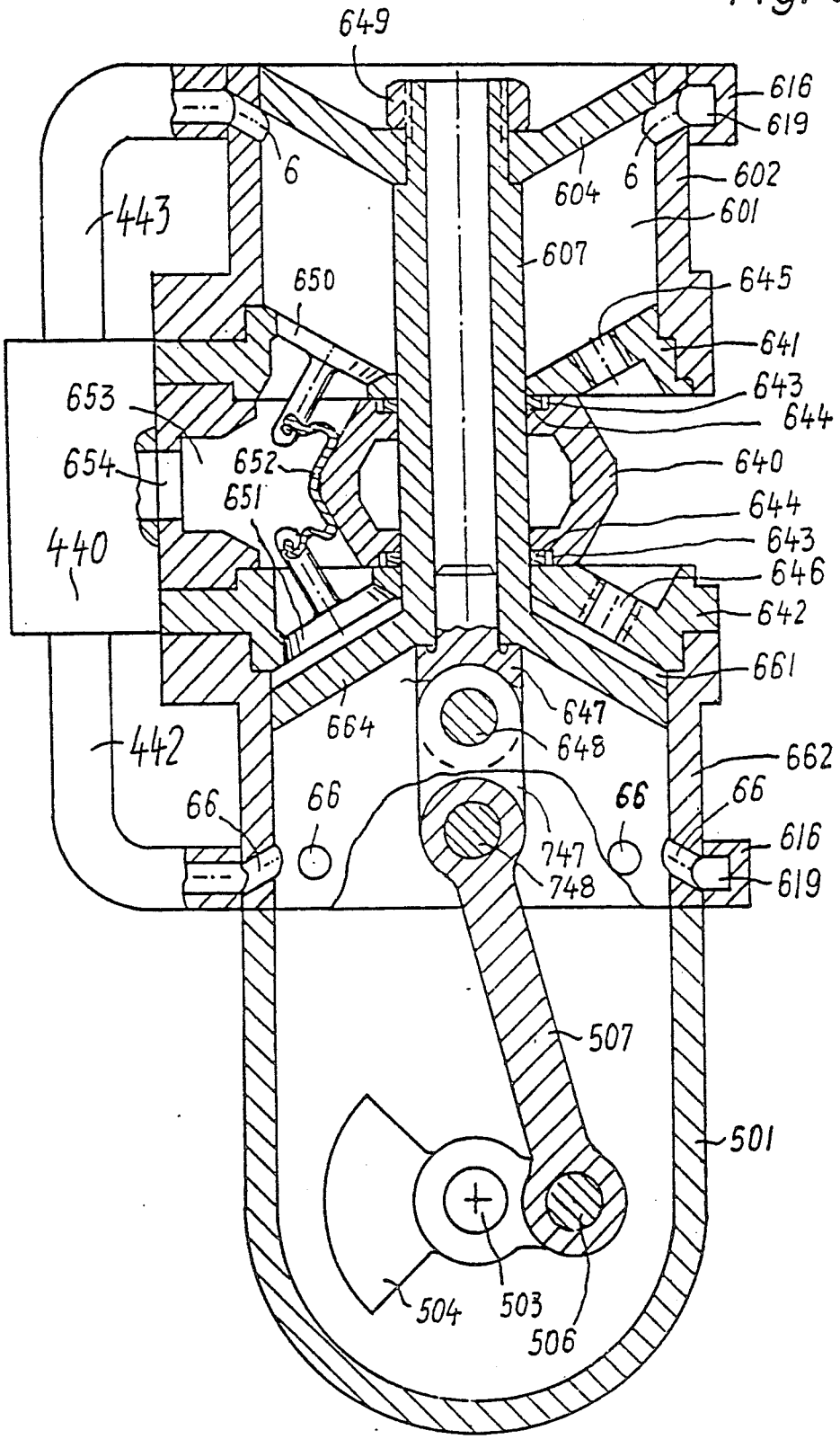
FIG. 68 is a longitudinal sectional view through another engine of the invention.

In FIG. 68 the engine has a crank shaft 503 with counter weigth 504 and connecting rod 507 in crank housing 501. Connecting rod 507 connects to piston shaft 607 by connecters 647,648,747 and 748. Piston 607 has the piston shaft 607 and the rear piston 664 while the front piston 604 is mounted on the front of piston shaft 607. The medial housing 640 and inserts 641,642 between the medial housing 640 and the cylinders 602,662 surround the piston shaft 607. Seal beds 643 are provided between the medial housing and the inserts while seal rings 644 are inserted into the seal beds. The seal rings have inner faces which slide and seal along the outer face of the piston shaft 607. The pistons 604,664 reciprocate in cylinders 602,662 and seal on their inner faces while piston rings may be inserted to improve the sealing. The cylinders are provided with exhaust ports 6,66 similar as in others of the Figures and exhaust collection chambers 619 in exhaust housings 616 collect the exhaust from the exhaust ports and lead it over passages 442,443 to the turbine of the turbo charger 440 to drive the turbine while the compressor of the turbo 440 presses gas or air out of its delivery port 654 into the entrance chamber 653 of the engine. Inlet valves 650,651 are provided between the entrance chamber 653 and the cylinder chambers 601 and 661, respectively, while springs 652 are set to close the inlet valves 650,651. If the pressure in the cylinder chambers becomes smaller than the pressure in the entrance chamber 653 the inlet valve opens to the respective cylinder chamber with the lower pressure. Holding means, for example, threads 645,646 are provided for the insertion of injection or ignition means. Since piston 664 may be intergral with piston shaft 607, the piston shaft can be easily inserted into the sealing and fitting bores in the medial housing and in the inserts. The other piston 604 can then be srewed or held by a nut 649 on the other end of the piston shaft. It is possible to make the shaft 607 hollow and to insert the holder 647. This engine works similar as that of FIG. 66, however, the flow control recess of FIG. 66 is here in FIG. 48 replaced by the multiple inlet valves 650 and 651. While for each cylinder only one inlet valve and one holder thread is shown in the Figure, a plurality may actualy be applied angularly spaced around the axis of the engine.

In FIG. 68 as well as in FIGS. 66,67 and others, it is preferred to obey the rules of FIG. 13 and of its explanations in order to make the counter weights of the crank shafts as small as possible in order to obtain the high power output of the ultra engine by a small weight and size of the engine assembly.

Since the invention is still more in detail described in the appended claims, the claims should be con sidered to be also a portion of the description of the invention and its preferred embodiments.

What is claimed is:

1. A device, comprising, in combination; a first cylinder of a first cross-sectional area with a sealingly reciprocable first piston, inlet means for the entrance of fluid, ignition means for the ignition of said fluid and outlet means for the expulsion of said fluid, wherein an improvement is provided to improve the power of the device; and said improvement comprises, in combination, in addition to said first cylinder and first piston, a plurality of secondary cylinders each with a sealingly reciprocable secondary piston, wherein said secondary cylinders are axially opposed to said first cylinder;

wherein the sum of the cross sectional areas of said secondary cylinders and pistons equals substantially the cross sectional area of said first cylinder, wherein connection means are provided between said first piston and said secondary pistons, and, wherein said connection means are rigid portions of said first and secondary pistons wherein said first and secondary pistons form an integral single body.

2. The device of claim 1, wherein said secondary cylinders are provided with inlet means for the supply of said fluid and with ignition means to ignite said fluid.

3. A device, comprising, in combination, a first cylinder of a first cross-sectional area with a sealingly reciprocable first piston, inlet means for the entrance of fluid, outlet means for the expulsion of said fluid, the improvement comprising, in combination, a plurality of secondary cylinders each with a sealingly reciprocable secondary piston, said secondary cylinders are directly axially opposed to said first cylinder, connection means provided to combine said pistons for parallel movement, the sum of the cross-sectional areas of said secondary cylinders equals substantially the cross-sectional area of said first cylinder, and;

said connection means are rigid portions of said first piston skirt forming shafts which project directly to a rear surface of each said secondary piston, wherein said first and secondary pistons form an integral single one piece body.

* * * * *